US006567345B1

(12) United States Patent
Furukawa et al.

(10) Patent No.: US 6,567,345 B1
(45) Date of Patent: May 20, 2003

(54) CLOCKING DEVICE

(75) Inventors: Tsuneaki Furukawa, Matsumoto (JP); Nobuhiro Koike, Chino (JP); Eiichi Hiraya, Shiojiro (JP); Akihiko Maruyama, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/554,234

(22) PCT Filed: Sep. 10, 1999

(86) PCT No.: PCT/JP99/04970

§ 371 (c)(1),
(2), (4) Date: Jun. 20, 2000

(87) PCT Pub. No.: WO00/16171

PCT Pub. Date: Mar. 23, 2000

(30) Foreign Application Priority Data

Sep. 10, 1998 (JP) ..... 10-257329
Sep. 10, 1998 (JP) ..... 10-257330
Sep. 10, 1998 (JP) ..... 10-257331

(51) Int. Cl.[7] ..... G04B 19/04; G04B 25/00; G04F 10/00; G04F 8/00

(52) U.S. Cl. ..... 368/80; 368/110; 368/113; 368/223

(58) Field of Search ..... 368/8, 76, 80, 368/88, 107, 110–113, 223, 276, 281, 185, 189, 190

(56) References Cited

U.S. PATENT DOCUMENTS

| | | | |
|---|---|---|---|
| 3,712,036 | A | 1/1973 | Morita |
| 3,739,570 | A | 6/1973 | Bachmann |
| 4,748,603 | A | 5/1988 | Ray et al. |
| 5,220,541 | A | 6/1993 | Vuilleumier |

FOREIGN PATENT DOCUMENTS

| | | |
|---|---|---|
| CH | 661 404 | 7/1987 |
| EP | 0 335 054 | 10/1989 |
| JP | 47-28700 | 8/1972 |
| JP | 60-189886 | 12/1985 |
| JP | 61-83991 | 4/1986 |
| JP | 63-29796 | 2/1988 |
| JP | 2-77679 | 3/1990 |
| JP | 5-215868 | 8/1993 |
| JP | 8-431 | 2/1996 |
| WO | 88 09530 | 12/1988 |

*Primary Examiner*—Vit Miska

(57) ABSTRACT

A timepiece has an ordinary time measuring section including an ordinary time display unit for measuring an ordinary time and time information (i.e., chronograph) measuring sections including chronograph displays for measuring time information other than the ordinary time (i.e., chronograph information). The timepiece is configured such that the ordinary time display unit and the chronograph display units, are disposed on a display surface of the timepiece without overlapping each other.

41 Claims, 52 Drawing Sheets

CLOCKING DEVICE

BACKGROUND OF THE INVENTION

1. Field of the Invention

The present invention relates to a multi-function timepiece having hands and to a time measuring method.

2. Description of the Related Art

FIG. 8 shows the display surface of an electronic watch as a conventional multi-function timepiece. In FIG. 8, an electronic watch 10 first includes an outer case 11. The outer case 11 has a dial 12 in the inside thereof in the figure.

The dial 12 has an ordinary time display unit disposed thereon as the display unit of an ordinary time measuring section. Specifically, first, an ordinary second time display unit 13 is disposed at the position of an approximately 6 o'clock of the dial 12. An ordinary second time small second hand 13*a* is disposed to the ordinary second time display unit 13.

Further, an ordinary hour and minute time display unit 14 is located at the center of the dial 12 and includes an ordinary time hour hand 14*a* and an ordinary time minute hand 14*b*.

The ordinary second time small second hand 13*a*, the ordinary time hour hand 14*a*, and the ordinary time minute hand 14*b* are hands disposed on the dial 12 to display an ordinary time. However, since the electronic watch 10 has multi-functions, component for exhibiting a chronograph function are disposed on the dial 12 in addition to the above hands.

As the components for exhibiting the chronograph function, first, a chronograph minute display unit 15 is disposed at an upper portion of the dial 12. The chronograph minute display unit 15 is provided with a chronograph minute CG hand 15*a*. Further, a chronograph ⅕ second CG hand 16 is disposed at the center of the dial 12.

In the multi-function electronic watch 10, when a user desires to confirm an ordinary time, he or she visually confirms the ordinary second time small second hand 13*a*, the ordinary time hour hand 14*a*, and the ordinary time minute hand 14*b*.

Further, when the chronograph function is to be exhibited in the electronic watch 10, first, for example, the user presses a start/stop button 17. With this operation, the electronic watch 10 starts measuring a time. At the time, the chronograph ⅕ second CG hand 16 and the chronograph minute CG hand 15*a* are rotated.

Then, when the start/stop button 17 is pressed again, the measurement of the time is finished, the chronograph ⅕ second CG hand 16 and the chronograph CG minute hand 15*a* are stopped, and the measured time is displayed.

Note that when the user presses a reset button 18 provided with the electronic watch 10, the measured time is reset and the chronograph ⅕ second CG hand 16 and the chronograph minute CG hand 15*a* are returned to a zero position.

The train wheels and the like of the ordinary second time small second hand 13*a*, the ordinary time hour hand 14*a*, the ordinary time minute hand 14*b*, the chronograph ⅕ second CG hand 16 and the chronograph minute CG hand 15*a*, which operate as described above, will be described below.

FIG. 9 is a view showing the train wheels of the respective hands 13*a*, 14*a*, 14*b*, 15, and 16. In FIG. 9, the train wheels and the like of the respective hands 13*a*, 14*a*, 14*b*, 15, and 16 will be mainly described and the description of the arrangement other than the train wheels are omitted.

First, the train wheels and the like of the ordinary second time small second hand 13*a*, the ordinary time hour hand 14*a* and the ordinary time minute hand 14*b* which display the ordinary time will be described.

In FIG. 9, an ordinary time step motor 3 is disposed on a main plate 1, which is composed of a molded resin, to display the ordinary time. The ordinary time step motor 3 is provided with a rotor 4 for it. The rotor 4 of the ordinary time step motor 3 is meshed with a fifth wheel 5. The fifth wheel 5 is meshed with a second wheel 6 which is further meshed with a small second wheel 136 through other wheel gear 7. The ordinary second time small second hand 13*a* shown in FIG. 8 is disposed at the extreme end of the small second wheel 136 and driven.

Further, the second wheel 6 is meshed with a center wheel 8 through a third wheel 24. The ordinary time minute hand 14*b* of FIG. 10 is disposed to the center wheel 8 and driven.

Further, the center wheel 8 is meshed with an hour wheel 10 through a minute wheel 9. The ordinary time hour hand 14*a* of FIG. 10 is disposed to the hour wheel 10 and driven.

FIG. 10 is a sectional view showing the relationship between the ordinary time hour hand 14*a* and the ordinary time minute hand 14*b* disposed as described above.

As shown in FIG. 10, the ordinary time hour hand 14*a* and the ordinary time minute hand 14*b* are disposed at the center of the hour wheel 10 so as to be overlapped in the thickness direction of the hour wheel 10.

Next, the train wheels and the like of the chronograph ⅕ second CG hand 16 and the chronograph minute CG hand 15*a* will be described.

In FIG. 9, a chronograph step motor 15 is disposed on the main plate 1. The chronograph step motor 15 is provided with a rotor 16 for it. Then, the rotor 16 of the chronograph step motor 15 is meshed with a ⅕ second CG second intermediate wheel 18 through a ⅕ second CG first intermediate wheel 17. Then, the ⅕ second CG second intermediate wheel 18 is meshed with a ⅕ second CG wheel 19, and a chronograph ⅕ second CG hand 16 is disposed at the extreme end of the ⅕ second CG wheel 19 as shown in FIG. 10 and driven.

Further, in FIG. 9, a chronograph minute display step motor 27 is disposed on the main plate 1. The chronograph step motor 27 is provided with a rotor 28 . The rotor 28 of the chronograph minute display step motor is meshed with a minute CG wheel 30 through a minute CG intermediate wheel 29.

The chronograph minute CG hand 15*a* shown in FIG. 8 is attached to the minute CG wheel 30 and driven.

The ordinary second time small second hand 13*a*, the ordinary time hour hand 14*a*, the ordinary time minute hand 14*b*, the chronograph ⅕ second CG hand 16, and the chronograph minute CG hand 15*a* are disposed as described above and train wheels and the like are provided accordingly. In particular, the ordinary time hour hand 14*a*, the ordinary time minute hand 14*b*, and the chronograph ⅕ second CG hand 16 are disposed at the center of the main plate 1 so that they overlap each other as shown in FIG. 9. Therefore, since the train wheels and the like also are disposed so as to overlap each other at the center, there is a problem that the thickness of the electronic watch 10 is inevitably increased.

Further, since all the hands 13*a*, 14*a*, and 16 are driven at the center of the dial 12, there is also a problem that it is difficult for the user to read them.

An object of the present invention is to solve the above problems and to provide a timepiece whose size and thickness are reduced and which can be visually viewed by a user easily.

Conventionally, there are, for example, wrist watches having an analog display type chronograph function as multi-function timepieces having hands. When the wrist watch is an electronic watch, it includes in the main body thereof train wheels for transmitting drive force to hands for displaying an ordinary time, train wheels for transmitting drive force to hands for displaying a chronograph, for example, an hour chronograph hand, a minute chronograph hand, and a second chronograph hand, a motor for generating the drive force of the hands for displaying an ordinary time, a motor for generating the drive force of the hands for displaying the chronograph, an electronic circuit for controlling the respective components, and a cell of, for example, a button type as a drive power supply of the motors and the like. When a start/stop button provided with the wrist watch is pressed, the electronic circuit is operated and the measurement of a time is started and the time chronograph hand, the minute chronograph hand, and the second chronograph hand are rotated. When the start/stop button is pressed again, the electronic circuit is operated and the measurement of the time is ended, the time chronograph hand, the minute chronograph hand, and the second chronograph hand are stopped, and a measured time is displayed. Further, when a reset button provided with the wrist watch is pressed, the electronic circuit is operated, thereby resetting the measured time, and the time chronograph hand, the minute chronograph hand, and the second chronograph hand are returned to a zero position (hereinafter, referred to as "reset to zero").

There is a mechanical reset to zero means (reset to zero mechanism) in addition to the electronic type reset to zero means described above as the reset to zero means of the wrist watch having the analog display type chronograph function. However, when the reset to zero mechanism is assembled to conventional electronic watches having the analog display type chronograph function, a problem is arisen in that the size of watch main body, in particular, the size thereof in a plane (lateral) direction is increased, and thus this arrangement has not been in practical use.

Further, electronic watches are now provided with a power generating unit for converting mechanical energy into electric energy as a power supply for driving motors and the like. However, there are disadvantages with assembling power generating unit to the conventional electronic watches having the analog display type chronograph function. For example, the size of watch main body, in particular, the thickness is increased similarly to the above case as well as reliability cannot be obtained in electric conduction. Additionally, the influence of the magnetic filed of generated power cannot be prevented, and thus this arrangement has not been in practical use.

OBJECTS OF THE INVENTION

An object of the present invention is to solve the above problems and to provide a timepiece which is small in size, has high reliability in the electric conduction to a power generating unit and can prevent the influence of the magnetic field of generated power.

Conventionally, there are available, for example, wrist watches having an analog display type chronograph function as multi-function timepieces having hands. The wrist watches have, for example, a mechanical reset to zero mechanism for operating a chronograph.

FIG. 53 is a plan view showing an example of the reset to zero mechanism of a conventional wrist watch having an analog display type chronograph function. The reset to zero mechanism is a mechanism for operating a chronograph second hand 62 disposed at the center of a watch main body 61.

When a start/stop button 63 is pressed, an actuation cam 65 is rotated by an actuating lever 64 by a tooth and the extreme end of a first chronograph coupling lever 66 is fallen between columns 65*a* disposed to the actuation cam 65. With this operation, since the first chronograph coupling lever 66 and a second chronograph coupling lever 67 are separated from a ring 68 for transmitting drive force to the chronograph second hand 62, the chronograph second hand 2 is rotated. When the start/stop button 63 is pressed again, the actuation cam 65 is rotated by the actuating lever 64 by a tooth and the extreme end of the first chronograph coupling lever 66 is lifted by a column 65 of the actuation cam 65. With this operation, since the first chronograph coupling lever 66 and the second chronograph coupling lever 67 come into contact with the ring 68 and lift it, no drive force is transmitted to the chronograph second hand 62. Thus, the chronograph second hand 62 is stopped and displays a measured time. Further, when a reset button 69 is pressed, the actuation cam 65 is rotated by an actuating lever 70 by a tooth and the extreme end of a reset to zero lever 71 is fallen between columns 65*a* of the actuation cam 65. With this operation, since the reset to zero lever 71 strikes a heart cam 72 coupled with the chronograph second hand 62, the chronograph second hand 62 is returned to a zero position.

In the wrist watch having the analog display type chronograph function as the conventional timepiece, since the chronograph second hand 62 is disposed at the center of the watch main body 61, the reset to zero mechanism thereof must be disposed on a side of the watch main body 61. Therefore, there is a problem that a useless space is liable to be made on the other side of the watch main body 61 and the size of the watch main body 61 is increased.

Further, since the actuation cam 65 of the reset to zero mechanism cannot be disposed at the center of the watch main body 61, when a watch includes a plurality of chronograph hands, the lengths of the reset to zero levers of the respective chronograph hands must be changed. Thus, it is difficult to design the watch so that the respective reset to zero levers strike heart cams at the same timing with the same torque, and there arises a problem that a higher accuracy cannot be achieved, a useless space is liable to be made in layout, and the size of the watch main body 1 is increased.

An object of the present invention is to solve the above problems and to provide a timepiece which is small in size and has a pinpoint accuracy.

SUMMARY OF THE INVENTION

The present invention is a timepiece having an ordinary time measuring section for measuring an ordinary time and a time information measuring section for measuring time information other than the ordinary time, the timepiece being characterized in that the parts, which constitute the ordinary time measuring section and the time information measuring section, are entirely or partly disposed without overlapping on a plane.

In the present invention, since the parts, which constitute the ordinary time measuring section and the time information measuring section, are entirely or partly disposed without overlapping on a plane, the ordinary time measuring section and the time information measuring section are not accommodated in the interior of the timepiece by overlapping each other.

In the arrangement of the timepiece of the present invention, the ordinary time measuring section has an ordinary time train wheel, an ordinary time drive unit and an ordinary time display unit and the time information measuring section has chronograph train wheels, a chronograph drive unit and a chronograph display unit.

Since the ordinary time display unit and the chronograph display unit are disposed without overlapping each other in a thickness direction, the display sections are not overlapped.

In the arrangement of the timepiece of the present invention any ones of the parts which constitute the ordinary time train wheel and the ordinary time drive unit of the ordinary time measuring section overlap on a plane.

In the arrangement of the timepiece of the present invention, any ones of the parts which constitute the chronograph train wheels and the chronograph drive unit of the time measuring section overlap on a plane.

In the arrangement of the timepiece of the present invention any ones of the parts which constitute the ordinary time train wheel and the ordinary time drive unit of the ordinary time measuring section overlap on a plane and any ones of the parts which constitute the ordinary time train wheel and the ordinary time drive unit of the ordinary time measuring section overlap on a plane.

Since the parts constituting each of the ordinary time measuring section and the time information measuring section overlap each other on the surface in sites, the plane sizes of the respective sites can be reduced and thus the size of the entire timepiece can be reduced.

a. In the arrangement of the timepiece of the present invention the ordinary time display unit and the chronograph display unit are disposed to portions other than the approximate center of the display surface of the timepiece and the ordinary time display unit and the chronograph display unit are separately disposed to an outer peripheral portion which has an arbitrary distance from the approximate center. Since the ordinary time display section and the chronograph display section are separately disposed, respectively, the display sections do not overlap each other.

In the arrangement of the timepiece of the present invention, the ordinary display unit is disposed at the position of an approximate 6 o'clock on the display surface of the timepiece and a plurality of the chronograph display units are separately disposed at positions other than the position of the approximate 6 o'clock on the display surface of the timepiece.

In the present invention, the ordinary time display section is disposed at the position of the approximate 6 o'clock on the display surface which is relatively near to the eyes of a user.

In the arrangement of the timepiece of the present invention, the chronograph display units are separately disposed at the positions of an approximate 2 o'clock, an approximate 12 o'clock, and an approximate 10 o'clock on the display surface of the timepiece, respectively.

In the present invention, the chronograph display units are gathered to the positions on both the sides of the approximate 12 o'clock on the display surface of the timepiece.

In the arrangement of the timepiece of the present invention, the ordinary time drive unit is an ordinary time motor which is disposed to a portion corresponding to the position of the 6 o'clock on the display surface of the timepiece.

In the present invention, since the ordinary time motor is disposed at the position of the approximate 6 o'clock, the ordinary time train wheel and the ordinary time display unit also can be disposed at the position of the approximate 6 o'clock.

In the arrangement of the timepiece of the present invention, the chronograph drive unit is a chronograph motor which is disposed to a portion corresponding to the position of an approximate 9 o'clock to the approximate 12 o'clock on the display surface of the timepiece.

In the present invention, since the chronograph motor is disposed to the portion corresponding to the position of the approximate 9 o'clock, the chronograph train wheels and the chronograph display units can be disposed at the position of the approximate 10 o'clock to the approximate 2 o'clock on the display surface of the timepiece.

In the arrangement of the timepiece of the present invention, the chronograph drive unit is a single chronograph motor which drives the chronograph display units, which are separately disposed on the display surface of the timepiece, through the chronograph train wheels.

Since the single chronograph motor drives the chronograph display units which are separately disposed on the display surface of the timepiece, the number of motors is reduced as compared with the case in which each chronograph display unit is driven by a motor provided therewith. Further, the displays of the chronograph display units which are disposed separately can be driven in synchronism with each other.

A power supply unit as a power supply for the ordinary time measuring section and the time information measuring section is disposed to a portion corresponding to the position of an approximate 1 o'clock to the approximate 2 o'clock on the display surface of the timepiece.

Since the power supply unit is disposed to the portion corresponding to the position of the approximate 1 o'clock to the approximate 2 o'clock on the display surface of the timepiece, the power supply unit is not located near to the ordinary time motor, the ordinary time train wheel, the chronograph motor, the chronograph train wheels, and the like.

According to the present invention, the electric signal output unit of the ordinary time measuring section and the time information measuring section is disposed to a portion corresponding to the position of an approximate 8 o'clock on the display surface of the timepiece.

Since the electric signal output unit is disposed to the portion corresponding to the position of the approximate 8 o'clock on the display surface of the timepiece, it does not overlap the ordinary time train wheel, the chronograph train wheels, and the like in a thickness direction.

According to the present invention, the time correcting unit of the ordinary time measuring section is disposed to a portion corresponding to the position of an approximate 4 o'clock on the display surface of the timepiece.

Since the time correcting unit of the ordinary time measuring section is disposed to the portion corresponding to the position of the approximate 4 o'clock on the display surface of the timepiece, the ordinary time measuring section is located in the vicinity of the time correcting unit thereof.

According to yet another aspect of the present invention, an external manipulating member as the time correcting means of the ordinary time measuring section is disposed to a portion corresponding to the position of the approximate 4 o'clock on the display surface of the timepiece.

Since the external manipulating member is disposed to the portion corresponding to the position of the approximate 4 o'clock on the display surface of the timepiece, the manipulating member is located in the vicinity of the time correcting unit of the ordinary time measuring section.

According to another aspect of the present invention is a timepiece having an ordinary time measuring section for measuring an ordinary time, a time information measuring section for measuring time information other than the ordinary time and a reset to zero mechanism for mechanically resetting the measurement of time information other than the ordinary time to zero, the timepiece being characterized in that a timepiece main body is composed of a plurality of layers and the reset to zero mechanism is disposed on a layer whose height in a sectional direction is different from that of a layer on which the ordinary time measuring section and the time information measuring section are disposed.

In the arrangement of the present invention, the ordinary time measuring section has an ordinary time train wheel, an ordinary time drive unit and an ordinary time display unit and the time information measuring section has time information train wheels, time information drive units and time information display units.

When the interior of the timepiece main body is partitioned in the layers in a side (thickness) direction and the ordinary time measuring section and the chronograph time measuring section are disposed on a layer, the reset to zero mechanism is disposed on a layer other than the above layer, so that the ordinary time measuring section, the chronograph time measuring section and the reset to zero mechanism, which include mechanical structural units having a large occupying area, are disposed in lamination, whereby the size of the main body in a plane (lateral) direction can be reduced.

The invention according to another aspect is a timepiece having an ordinary time measuring section for measuring an ordinary time, a time information measuring section for measuring time information other than the ordinary time, and a power generating unit for converting mechanical energy into electric energy and generating a drive voltage for driving the ordinary time measuring section and the time information measuring section, the timepiece being characterized in that a timepiece main body is composed of a plurality of layers and the power generating unit is disposed on a layer whose height in a sectional direction is different from that of a layer on which the ordinary time measuring section and the time information measuring section are disposed. When the interior of the timepiece main body is partitioned in the layers in a side (thickness) direction and the ordinary time measuring section and the chronograph time measuring section are disposed on a layer, the power generating unit is disposed on a layer other than the above layer, so that the ordinary time measuring section, the chronograph time measuring section and the power generating unit, which include mechanical structural units having a large occupying area, are disposed in lamination, whereby the size of the main body in the plane (lateral) direction can be reduced.

Additionally, the present invention is a timepiece having an ordinary time measuring section for measuring an ordinary time, a time information measuring section for measuring time information other than the ordinary time, a reset to zero mechanism for mechanically resetting the measurement of time information other than the ordinary time to zero, and a power generating unit for converting mechanical energy into electric energy and generating a drive voltage for driving the ordinary time measuring section and the time information measuring section, the timepiece being characterized in that a timepiece main body is composed of a plurality of layers and the reset to zero mechanism and the power generating unit are disposed on a layer whose height in a sectional direction is different from that of a layer on which the ordinary time measuring section and the time information measuring section are disposed.

When the interior of the timepiece main body is partitioned in the layers in a side (thickness) direction and the ordinary time measuring section and the chronograph time measuring section are disposed on a layer, the reset to zero mechanism and the power generating unit are disposed on a layer other than the above layer, so that the ordinary time measuring section, the chronograph time measuring section and the reset to zero mechanism, which include mechanical structural units having a large occupying area, are disposed in lamination, whereby the size of.the main body in the plane (lateral) direction can be reduced.

According to another aspect of the present invention the reset to zero mechanism overlaps the time information measuring section on a plane in the disposition thereof.

Since the reset to zero mechanism and the time information measuring section are disposed by overlapping each other on the plane, the size of the main body in the plane (lateral) direction can be reduced. As a result, an associating mechanism for associating the reset to zero mechanism with the information measuring section, which is disposed in the vicinity of the reset to zero mechanism, occupies a small space and the association of them can be reliably carried out and reliability can be enhanced.

According to a feature of the present invention the power generating unit overlaps the ordinary time measuring section on a plane in the disposition thereof.

Since the reset to zero mechanism and the ordinary time measuring section are disposed by overlapping each other on the plane, the size of the main body in the plane (lateral) direction can be reduced.

According to one embodiment of the present invention the reset to zero mechanism and the power generating unit are disposed on the same layer. Since the reset to zero mechanism and the power generating unit are disposed on the same layer which is different from the layer on which the ordinary time measuring section and the time information measuring section are disposed, not only the size of the main body in a plane (lateral) direction but also the size thereof in a side (thickness) direction can be reduced.

According to another embodiment of the present invention the reset to zero mechanism and the power generating unit are disposed on different layers. Since the reset to zero mechanism and the time information measuring section are individually disposed on the different layers which also are different from the layer on which ordinary time measuring section and the time information measuring section are disposed, the size of the main body in the plane (lateral) direction can be more reduced.

According to another embodiment of the present invention the power generating unit, the ordinary time measuring section and the time information measuring section are conducted each other through elastic members.

The elastic members are disposed in an elastically deformed state so that the power generating unit, the ordinary time measuring section and the time information measuring section, which are disposed in lamination, come into intimate contact with each other. Thus, when the voltage generated by the power generating unit is conducted to the control circuit of the ordinary time measuring section and the time information measuring section through the elastic members, the reliability of conduction can be enhanced.

According to another embodiment of the present invention a magnetic resistant member is disposed on at least one of the upper layer side and the lower layer side of the power generating unit.

Since the power generating unit is covered with the magnetic resistant member so that the magnetic field generated by the power generating unit does not leaks outside, the influence of the magnetic field on the ordinary time measuring section and the time information measuring section can be prevented.

According to yet another embodiment of the present invention, the power generating unit comprises a power generating rotor and a power generating coil.

The power generating rotor is rotated and a drive voltage is generated to the power generating coil by electromagnetic induction.

Additionally, the power generating rotor is rotated by an oscillating weight.

Since the power generating rotor is rotated by the oscillating weight, the drive voltage of the motors can be automatically stored.

According to one aspect of the present invention, time information other than the ordinary time is a chronograph.

Since the display units of time information other than an ordinary time are used for the chronograph, an arbitrary time can be measured while displaying the ordinary time.

Additionally, the time information other than the ordinary time has a display means for at least two kinds of times units.

For example, 1/10 second and 12 hours can be displayed in addition to the ordinary time.

In the arrangement of the timepiece of the present invention, the display means for at least two kinds of the times units have train wheels.

Since the display means for at least two kinds of the times units are operated by the train wheels, they can be smoothly operated.

According to one embodiment of the present invention the timepiece is a wrist watch.

The timepiece can be arranged as, for example, a chronograph of small size or, for example, a chronograph of small size in which a cell and the like need not be replaced.

According to another embodiment of the present invention, the timepiece is a quartz type watch.

The timepiece can be arranged as, for example, a quartz type small chronograph which has a mechanical reset to zero mechanism and in which a cell and the like need not be replaced.

According to another embodiment of the present invention is a timepiece having an ordinary time measuring section for measuring an ordinary time, a time information measuring section for measuring time information other than the ordinary time, and a reset to zero mechanism including a reset to zero lever for mechanically resetting the time information display unit to zero and an actuation cam for actuating the reset to zero lever, the timepiece being characterized in that the actuation cam is disposed at an approximate center of a timepiece main body.

Since the actuation cam is disposed at the approximate center of the timepiece main body, the reset to zero mechanism can be arranged compact in its entirety and the position of a button and layout can be optionally set by reducing the size of the timepiece main body.

According to one aspect of the present invention is such that, the position of the center of rotation of an indicator wheel, to which the indicator hands of the ordinary time display unit are attached, is disposed to the peripheral portion of the approximate center of the timepiece main body. The position of the center of rotation of an indicator wheel, to which the indicator hands of the time information display units are attached, is disposed to the peripheral portion of the approximate center of the timepiece main body. The position of the center of rotation of an indicator wheel, to which the indicator hands of the ordinary time display unit are attached, and the position of the center of rotation of an indicator wheel, to which the indicator hands of the time information display units are attached, are disposed to the peripheral portion of the approximate center of the timepiece main body.

Since the indicator wheels, to which the indicator hands of the ordinary time display unit and the time information display units are attached, are disposed to the peripheral portion of the approximate center of the timepiece main body, the reset to zero mechanism can be arranged compact in its entirety by disposing the actuation cam at the approximate center of the timepiece main body, whereby the position of a button and layout can be optionally set by reducing the size of the timepiece main body.

Additionally, the actuation cam actuates a plurality of the reset to zero levers.

Since the plurality of reset to zero levers can be operated by the single actuation can by providing the levers with the same length, the respective reset to zero levers can be designed so that they have the same torque and the same timing, whereby an accuracy can be more increased.

According to yet another aspect of the present invention, a timepiece comprises a power generating unit for converting mechanical energy into electric energy and generating a drive voltage for driving the ordinary time display unit and the time information display unit.

Since the drive voltage is supplied from the power generating unit, a power supply cell can be made unnecessary.

Additionally, the power generating unit comprises a power generating rotor and a power generating coil.

The power generating rotor is rotated and a drive voltage is generated to the power generating coil by electromagnetic induction.

Specifically, the power generating rotor is rotated by an oscillating weight.

Since the power generating rotor is rotated by the oscillating weight, the drive voltage of the motors can be automatically stored.

According to a feature of the present invention time information other than the ordinary time is a chronograph.

Since the display units of time information other than an ordinary time are used for the chronograph, an arbitrary time can be measured while displaying the ordinary time.

Additionally, time information other than the ordinary time has a display means for at least two kinds of times units.

For example, time units, 1/10 second and 12 hours can be displayed in addition to the ordinary time.

According to one aspect of the present invention the display means for at least two kinds of the times units has train wheels.

Since the display means for at least two kinds of the times units are operated by the train wheels, they can be smoothly operated.

According to one embodiment of the present invention the timepiece can be arranged as, for example, a chronograph of small size in which a cell and the like need not be replaced.

Additionally, the timepiece can be arranged as, for example, a quartz type small chronograph which has a mechanical reset to zero mechanism and in which a cell and the like need not be replaced.

BRIEF DESCRIPTION OF THE DRAWINGS

In the drawings, wherein like reference symbols refer to like parts:

FIG. 2 is a view showing a movement mainly illustrating the train wheels of respective display units shown in FIG. 1, drive units and the like.

DESCRIPTION OF THE PREFERRED EMBODIMENTS

Preferable embodiments of the present invention will be described below in detail based on drawings.

Figure 1:
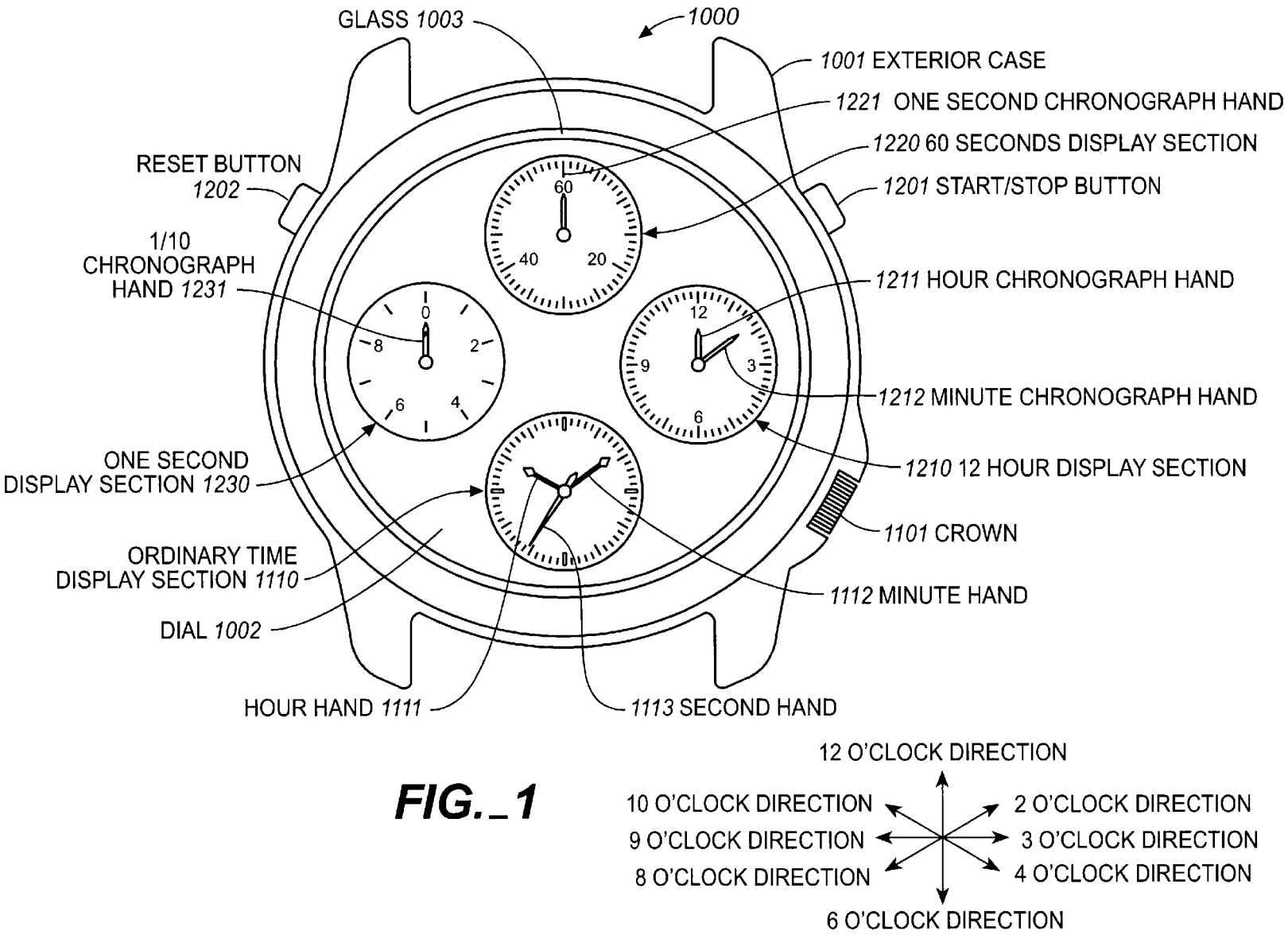
FIG. 1 is a view showing a display surface of a multifunction electronic watch according to an embodiment of the present invention.

FIG. 1 is a view showing the display surface of a timepiece according to an embodiment of the present invention, for example, the display surface of a multi-function electronic watch 1000.

In FIG. 1, a dial 1002 and a transparent glass 1003 are fitted in the outer case 1001 of the multi-function electronic watch 1000.

A crown 1101 as the external actuating member of a watch correcting unit is disposed to a portion corresponding to the position of an approximate 4 o'clock of the outer case 1001, and a chronograph start/stop button 1201 and a chronograph reset button 1202 are disposed at the position of an approximate 2 o'clock and at the position of an approximate 10 o'clock position, respectively.

Further, the ordinary time display unit 1110 of an ordinary time measuring section is disposed to a portion corresponding to the position of an approximate 6 o'clock which is located on an outer peripheral portion spaced apart from the approximate center of the dial 1002 by an arbitrary distance. The ordinary time display unit 1110 includes an hour hand 1111, a minute hand 1112, and a second hand 1113 which are ordinary time indicating hands.

Further, display units including auxiliary hands as chronograph display units are disposed to portions corresponding to the position of an approximate 3 o'clock, the position of an approximate 12 o'clock, and the position of an approximate 9 o'clock which are located on an outer peripheral portion spaced apart from the approximate center of the dial 1002 by an arbitrary distance. That is, a 12 hours display unit 1210 is located at the position of the approximate 3 o'clock of the dial 1002, and an hour chronograph hand 1211 and a minute chronograph hand 1212 are separately disposed on the 12 hours display unit 1210.

Further, a 60 seconds display unit 1220 is located at the position of the approximate 12 o'clock of the dial 1002 and includes a one second chronograph hand 1221. Further, a one second display unit 1230 is located at the position of the approximate 9 o'clock of the dial 1002 and includes a 1/10 second chronograph hand 1231.

Figure 2:
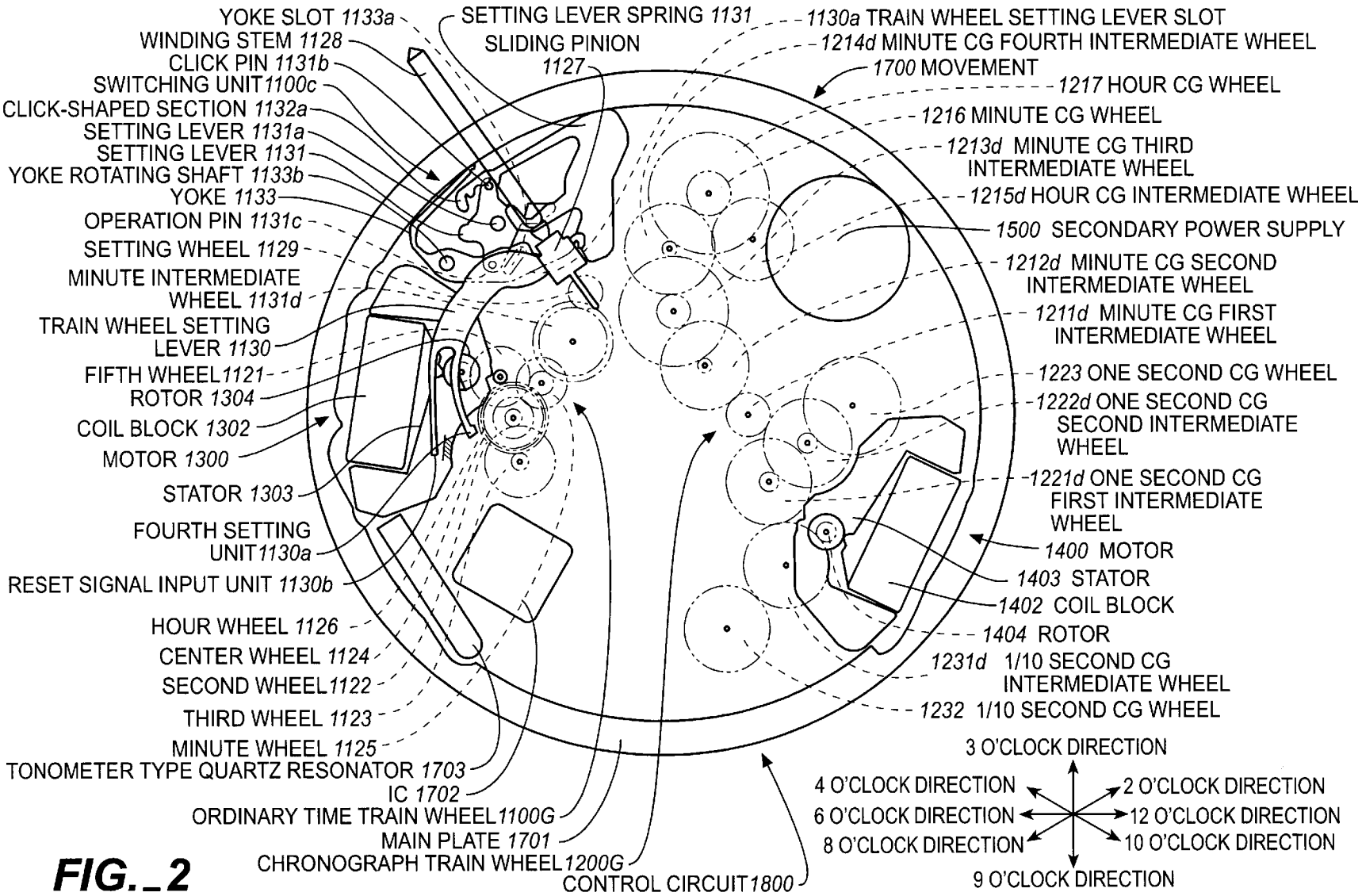

FIG. 2 is a view showing a movement in which mainly shown are the train wheels, the drive units and the like of the ordinary time display unit 1110, the 12 hours display unit 1210, the 60 seconds display unit 1220 and the one second display unit 1230 as the respective display units shown in FIG. 1. As shown in FIG. 2, an ordinary time train wheel 1100G and an ordinary time motor 1300 as a ordinary time drive unit are disposed to portions corresponding to the positions in the approximate 6 o'clock direction of the dial 1002 on the main plate 1701 of the movement 1700.

A switching unit 1100C is disposed to a portion corresponding to the position of an approximate 4 o'clock of the dial 1002 in the vicinity of the ordinary time train wheel 1100G and the ordinary time motor 1300.

An IC 1702 as an electric signal output unit having a control circuit 1800 is disposed to a portion corresponding to the position of an approximate 8 o'clock of the dial 1002 in the vicinity of the ordinary time train wheel 1100G and the ordinary time motor 1300. A tonometer type quartz resonator 1703 and the like are disposed in the vicinity of the IC 1702.

On the other hand, a chronograph train wheel 1200G and a chronograph motor 1400 as a chronograph drive unit are disposed to portions corresponding to the position of the approximate 12 o'clock of the dial 1002 and in the direction in the vicinity of the position. Further, a power supply 1500 is disposed in the vicinity of the chronograph train wheel 1200G.

As shown in FIG. 2, the ordinary time train wheel 1100G includes a fifth wheel 1121, a second wheel 1122, a third wheel 1123, a center wheel 1124, a minute wheel 1125, an hour wheel 1126 and the like, and an ordinary time second, minute and hour are displayed by the train wheels of them.

The ordinary time motor 1300 and the chronograph motor 1400 are step motors and composed of coil blocks 1302 and 1402 having magnetic cores composed of a highly permeable material, rotors 1304 and 1404 composed of rotor magnets and rotor pinions, and the like.

Figure 3:
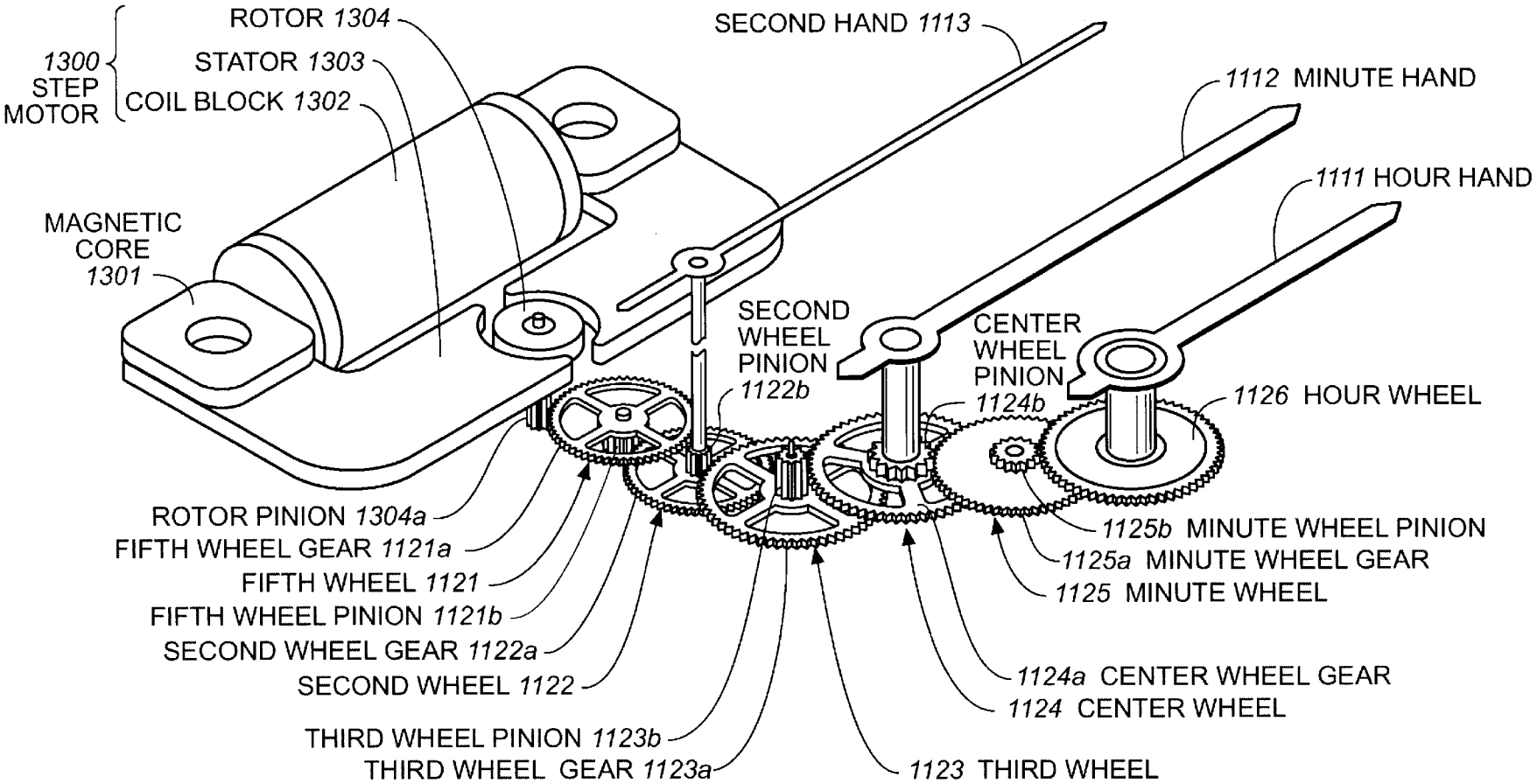
FIG. 3 is a perspective view schematically showing how an ordinary time train wheel is engaged with an ordinary time motor.

FIG. 3 is a perspective view schematically showing how the train wheel of the ordinary time train wheel 1100G is engaged with the ordinary time motor 1300.

In the figure, a rotor pinion 1304 which constitutes the rotor 1304 is meshed with a fifth wheel gear 1121*a* and a fifth wheel pinion 1121*b* is meshed with a second wheel gear 1122*a*. Since a speed reduction ratio from the rotor pinion 1304*a* to the second wheel gear 1122*a* is set to 1/30, an electric signal is output from the IC 1702 so that the rotor 1304 is rotated one-half turn in a second. With this operation, the second wheel 1122 is rotated one turn in 60 seconds, whereby an ordinary time second can be displayed by the second hand 1113 fitted to the extreme end of the second wheel 1122. Next, a second wheel pinion 1122*b* is meshed with a third wheel gear 1123*a* and a third wheel pinion 1123*b* is meshed with a center wheel gear 1124*a*. Since a speed reduction ratio from the second wheel pinion 1122*b* to the center wheel gear 1124*a* is set to 1/60, the center wheel 1124 is rotated one turn in 60 minutes, whereby an ordinary time minute can be displayed by the minute hand 1112 fitted to the extreme end of the center wheel 1124.

Further, a center wheel pinion 1124*b* is meshed with a minute wheel gear 1125*a* and a minute wheel pinion 1125*b* is meshed with the hour wheel 1126. Since a speed reduction ratio from the center wheel pinion 1124*b* to the hour wheel 1126 is set to 1/12, the hour wheel 1126 is rotated one turn in 12 hours, whereby an ordinary time hour can be displayed by the hour hand 1111 fitted to the extreme end of the hour wheel 1126.

How the multi-function electronic watch 1000 arranged as described above is used will be described. First, when a user desires to visually confirm an ordinary time, he or she confirms it by looking at the hour hand 1111, the minute hand 1112, and the second hand 1113 of the ordinary time display unit 1110 on the dial 1002. At the time, since the ordinary time display unit 1110 is disposed separately from the respective chronograph display units 1210, 1220, and 1230 as shown in FIG. 1, the user can visually confirm the ordinary time in a state in which his or her field of view is not disturbed by the chronograph indicating hands, and the like.

Further, when the user intends to use the chronograph function of the multi-function electronic watch 1000, he or she uses it by pressing the chronograph start/stop button 1201 and the chronograph reset button 1202. The user can obtain the result of the operation by visually confirming the respective hands of the chronograph 12 hours display unit 1210, 60 seconds display unit 1220 and one second display unit 1230.

The user can confirm the result in the state that his or her field of view is not disturbed by the hands of the ordinary time display unit.

As described above, in the embodiment, the ordinary time display unit 1110, the ordinary time train wheel 1100G and the ordinary time motor 1300 can be collectively disposed to the portion corresponding to the approximate 6 o'clock position of the dial 1002 and in the vicinity of it.

Therefore, the ordinary time motor 1300 can be located near to the ordinary time display unit 1110. Whereas, when the ordinary time motor 1300 is not located near to the ordinary time display unit 1110 and the distance therebetween is increased, the number of intermediate wheels from the rotor 1304 to the second wheel 1122 must be increased or the diameters of the gear wheels of the rotor 1304, the fifth wheel 1121, and the second wheel 1122 must be increased. A large space is required by this arrangement in any case.

Thus, the disposition of these components in the embodiment can make the ordinary time train wheel 1100G most effectively operative, and the space of the multi-function electronic watch 1000 can be saved as the most remarkable effect of the disposition.

Note that since the IC 1702 having the control circuit 1800 is disposed to the portion corresponding to the position of the approximate 8 o'clock of the dial 1002 as described above, the IC 1702 is prevented from overlapping the ordinary time train wheel 1100G and the other components of the multi-function electronic watch 1000 such as the chronograph train wheel 1200G to be described later, and the like, whereby the thickness of the movement 1700 can be reduced.

Since the IC 1702 is prevented from overlapping the ordinary time train wheel 1100G and the chronograph train wheel 1200G as described above, it is not abutted against other parts even if an external disturbance such as a shock is applied thereto. As a result, the IC 1702 itself can be structurally protected.

Incidentally, as described above, the switching unit 1100C as the time correcting unit is disposed to the portion corresponding to the position of the approximate 4 o'clock of the dial 1002 in the vicinity of the ordinary time display unit 1110, the ordinary time train wheel 1100G and the ordinary time motor 1300.

The switching unit 1100C includes the crown 1101, which is shown in FIG. 1, at an end thereof, and includes a winding stem 1128 having a sliding pinion 1127 fitted thereto, a setting wheel 1129, a setting lever 1131, a setting lever spring 1132, a yoke 1133, and a train wheel setting lever 1130, which are shown in FIG. 2, at the other end thereof.

The winding stem 1128 is a member for correcting a time and the like externally and set to three states by being pulled out through the crown 1101, that is, a state in which it is pushed most inwardly (zeroth stage), a state in which it is pulled out one stage (first stage), and a state in which it is pulled out two stages (second stage).

The zeroth stage is in such a state that the ordinary hands are driven on the ordinary time display unit 1110, the first stage is in such a state that the ordinary hands are driven on the ordinary time display unit 1110 similarly to the zeroth state and a calendar can be corrected, and the second stage is in such a state that the hands are not driven on the ordinary time display unit 1110 and a time can be corrected.

The winding stem 1128 is a long cylindrical rod having a cut-out formed at a portion thereof, and the extreme end of the setting lever 1131 is engaged with the cut-out. When the winding stem 1128 is pulled out, the setting lever 1131 is rotated counterclockwise about a setting lever rotating shaft 1131*a*. A click pin 1131*b* is disposed to a portion of the setting lever 1131, and the click-shaped portion 1132*a* of the setting lever spring 1132 is engaged with the click pin 1131*b*. When the setting lever 1131 is rotated, click force is generated by the click-shaped portion 1132*a* as well as positioning of the zeroth, first and second stages is carried out.

The setting lever 1131 is provided with another operation pin 1131*c* in confrontation with the click pin 1131*b* and the setting lever rotating shaft 1131*a*. A yoke 1133 and yoke slot 1133*a*, which is disposed in the shape of a train wheel setting lever 1130, and a train wheel setting lever slot 1130*a* are engaged with the operation pin 1131*c*. Further, the sliding pinion 1127 is guided by the winding stem 1128 through the center hole thereof and can be rotated together with the rotation of the winding stem 1128.

The yoke 1133 can be rotated about a yoke rotating shaft 1133*b*. Further, the extreme end of the yoke 1133 is engaged with a cut-out formed on the sliding pinion 1127. The yoke 1133 moves the sliding pinion 1127 forward and backward, thereby creating a calendar correcting state and a time correcting state.

The yoke 1133 has a spring portion and always applies force in the direction of the setting lever rotating shaft 1131*a* of the setting lever 1131. When the setting lever 1131 is rotated, the operation pin 1131c of the setting lever 1131 is also rotated thereby. Thus, the extreme end of the yoke 1133 moves the sliding pinion 1127 toward the outside in the first stage and toward the center in the second stage through the yoke slot 1133*a* which is engaged with the operation pin 1131*c*.

In the first stage, a wheel gear provided with the sliding pinion 1127 is meshed with a backside calendar part to thereby permit a calendar to be corrected. In the second stage, the wheel gear disposed at the extreme end of the sliding pinion 1127 is meshed with the setting wheel 1129 to thereby permit a time to be corrected.

Further, the train wheel setting lever 1130 sets the second wheel 1122 when the time is corrected as well as stops hand operating pulses by inputting a reset signal. Likewise the yoke 1133, the train wheel setting lever 1130 is rotated by the rotation of the operation pin 1131*c* of the setting lever 1131 about the setting lever rotating shaft 1131*a* along the train wheel setting lever slot 1130*a* with which it is engaged, thereby setting the second wheel 1122 as well as coming into contact with a reset pattern.

Since it is sufficient that the action of the train wheel setting lever 1130 is applied only in the second stage, the shape of the train wheel setting lever slot 1130*a* escapes the rotational locus of the operation pin 1131*c* of the setting lever 1131 from the zeroth stage to the first stage as it is.

Since the switching unit 1100C is collectively disposed to the portion corresponding to the position of the approximate 4 o'clock of the dial 1002, it does not overlap the ordinary time display unit 1110, the ordinary time train wheel 1100G, the ordinary time motor 1300 and the like.

Further, the portion corresponding to position of the approximate 4 o'clock of the dial 1002 is very near to the portion corresponding to the position of the approximate 6 o'clock of the dial 1002 where the ordinary time display section 1110, the ordinary time train wheel 1100G, the ordinary time motor 1300 and the like are disposed, the number of the parts of the switching unit 1100 such as a train wheel and the like can be reduced.

Further, the collective disposition of the crown 1101 of the switching unit 1100C to the portion corresponding to the position of the approximate 4 o'clock of the dial 1002 is effective from the view point of the manipulation performed by the user.

An operation for correcting a time and the like which is carried out using the switching unit 1100C arranged as described above will be described below.

First, the winding stem 1128 is pulled out to the second stage by pulling the crown 1101, a reset signal input unit 1130*b* disposed to the train wheel setting lever 1130 comes into contact with the pattern of a circuit board 1704 on which the IC 1702 is mounted, thereby stopping the output of motor pulses so as to stop driving the hands. At the time, the rotation of the second wheel gear 1122*a* is set by the second setting unit 1130*a* disposed to the train wheel setting lever 1130. When the winding stem 1128 is rotated together with the crown 1101 in this state, rotational force is transmitted from the sliding pinion 1127 to the minute wheel 1125 through the setting wheel 1129 and a minute intermediate wheel 1131*d*. Since the center wheel gear 1124*a* is coupled with the center wheel pinion 1124*b* with predetermined sliding torque, the setting wheel 1129, the minute intermediate wheel 1131*d*, the minute wheel 1125, the center wheel pinion 1124*b*, and the hour wheel 1126 are rotated even if the second wheel 1122 is set. Therefore, an arbitrary time can be set because the minute hand 1112 and the hour hand 1111 are rotated.

Next, the train wheels and the like of the 12 hours display unit 1210, the 60 seconds display unit 1220, and the one second display unit 1230 as the chronograph display units shown in FIG. 1 will be described.

In FIG. 2, the chronograph train wheel 1200G includes the train wheels of a 1/10 second CG (chronograph) intermediate wheel 1231*d*, a 1/10 second CG wheel 1232 which is disposed at the center position of the one second display unit 1230.

With the arrangement of the train wheels, chronograph 1/10 second is displayed at the portion corresponding to the position of the approximate 9 o'clock of the dial 10002.

Further, in FIG. 2, the chronograph train wheel 1200G includes the train wheels of a one second CG first intermediate wheel 1221*d*, a one second CG second intermediate wheel 1222*d*, and a one second CG wheel 1223 which is disposed at the center position of the 60 seconds display unit 1220. With the arrangement of the train wheels, a chronograph second is displayed at the portion corresponding to the position of the approximate 12 o'clock of the dial 10002.

Figure 4:
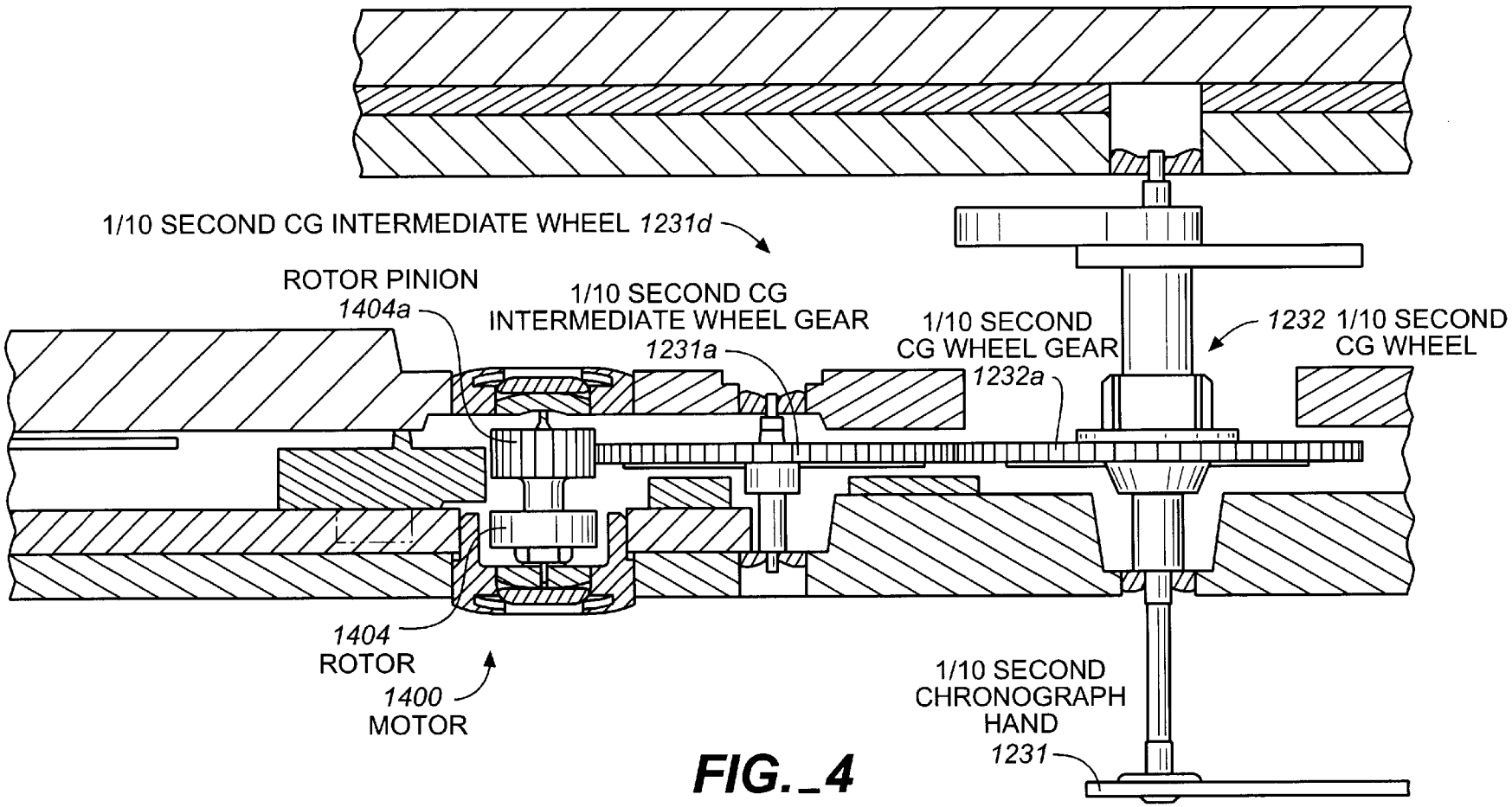
FIG. 4 is a side sectional view showing how a 1/10 second display train wheel of a chronograph train wheel is engaged.

Further, in FIG. 2, the chronograph train wheel 1200G includes the train wheels of a minute CG first intermediate wheel 1211*d*, a minute CG second intermediate wheel 1212*d*, a minute CG third intermediate wheel 1213*d*, a minute CG fourth intermediate wheel 1214*d*, an hour CG intermediate wheel 1215*d*, a minute CG wheel 1216, and an hour CG wheel 1217. The minute CG wheel 1216 and the hour CG wheel 1217 are concentrically disposed at the center position of the 12 hours display unit 1210. With the arrangement of the train wheels, a chronograph hour and minute are displayed at a portion corresponding to the position of the approximate 3 o'clock of the dial 1002. FIG. 4 is a side sectional view showing how a 1/10 second display train wheel of the chronograph train wheel 1200G is engaged.

A rotor pinion 1404*a* is meshed with a 1/10 second CG intermediate wheel gear 1231*a* which is meshed with a 1/10 second CG wheel gear 1232*a*. Since a speed reduction ratio from the rotor pinion 1404*a* to the 1/10 second CG wheel gear 1232*a* is set to 1/5, the IC 1702 outputs an electric signal so that the rotor 1404 is rotated one-half turn in 1/10 second. Thus, the 1/10 second CG wheel 1232 is rotated one turn in a second, and chronograph 1/10 second can be displayed by the 1/10 second chronograph hand 1231 fitted to the extreme end of the 1/10 second CG wheel 1232.

Figure 5:
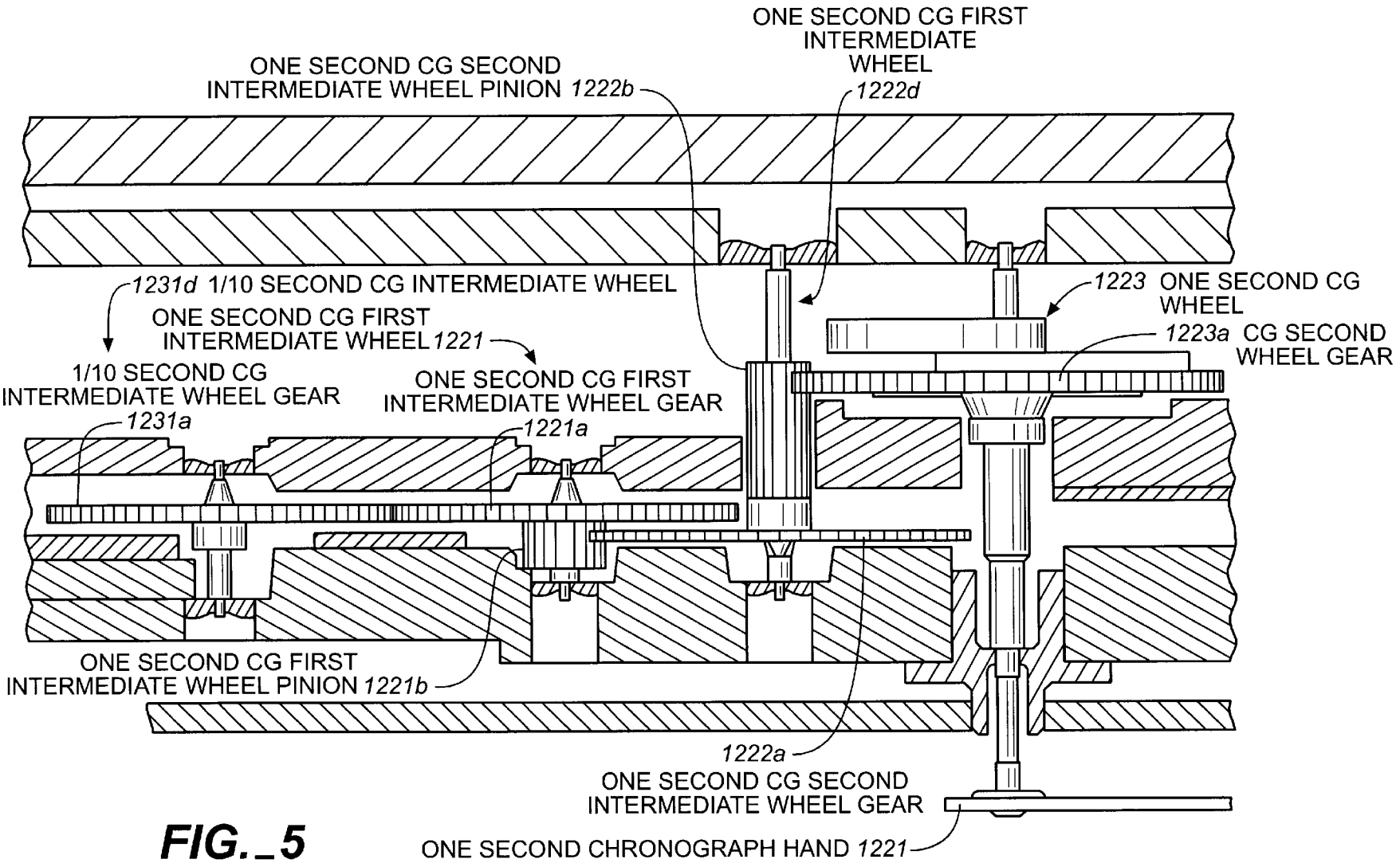
FIG. 5 is a side sectional view showing how a second display train wheel of the chronograph train wheel is engaged.

FIG. 5 is a side sectional view showing how a one second display train wheel of the chronograph train wheel 1200G is engaged.

The 1/10 second CG intermediate wheel gear 1231*a* is meshed with a one second CG first intermediate wheel gear 1221*a*, and a one second CG first intermediate wheel pinion 1221*b* is meshed with a one second CG second intermediate wheel gear 1222*a*. Further, a one second CG second intermediate wheel pinion 1222*b* is meshed with a one second CG gear wheel 1223*a*. The 1/10 second CG intermediate wheel gear 1231*a* is meshed with the rotor pinion 1404*a* as described above, and a speed reduction ratio from the rotor pinion 1404*a* to the one second CG gear wheel 1223*a* is set to 1/300. Therefore, the one second CG wheel 1223 is rotated one turn in 60 seconds, and a chronograph one second can be displayed by the one second chronograph hand 1221 fitted to the extreme end of the one second CG wheel 1223.

Figure 6:
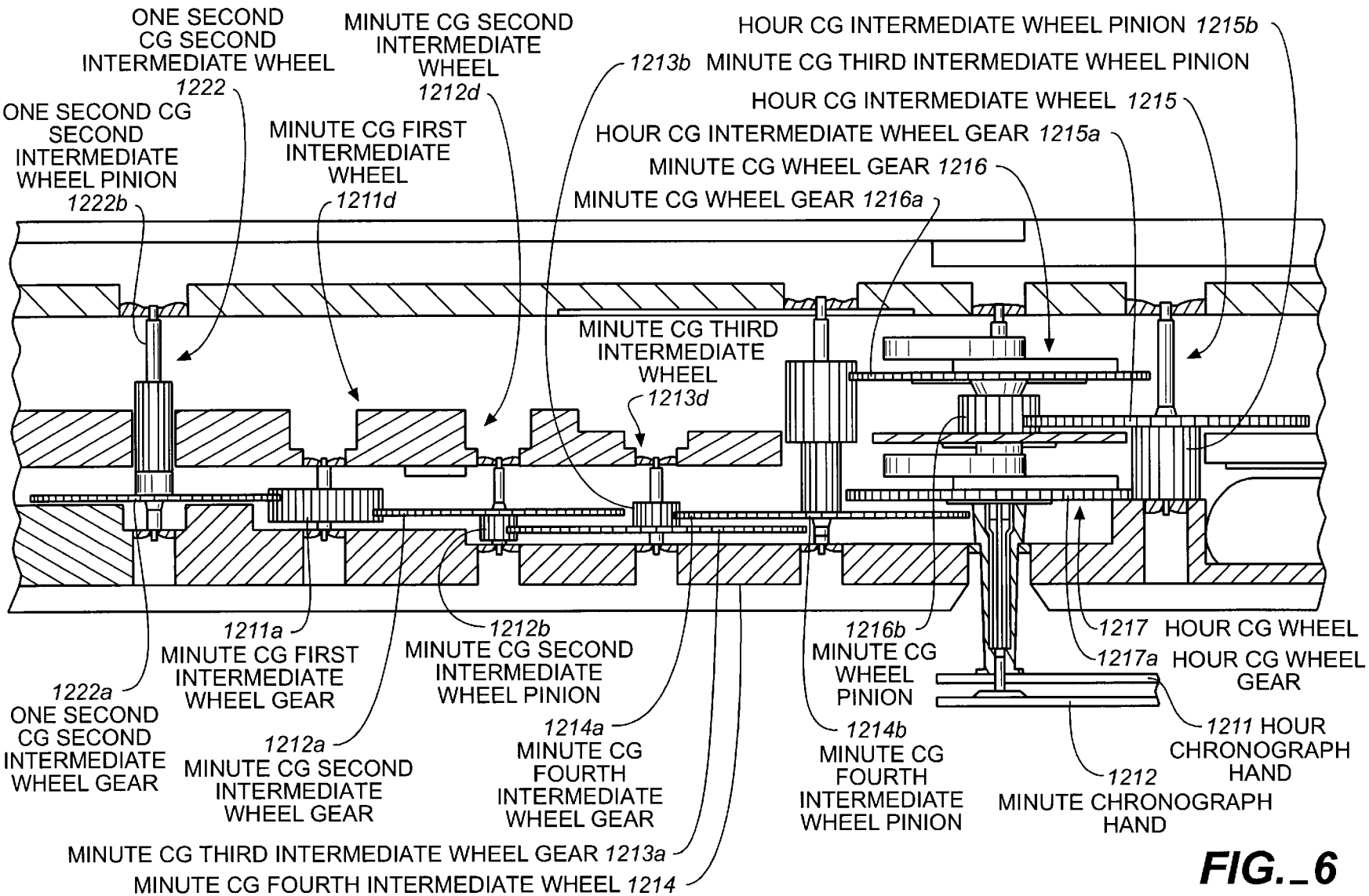
FIG. 6 is a side sectional view showing how an hour and minute display train wheel of the chronograph train wheel is engaged.

FIG. 6 is a side sectional view showing how an hour and minute display train wheel of the chronograph train wheel 1200G is engaged.

The one second CG second intermediate wheel gear 1222*a* is meshed with a minute CG first intermediate wheel gear 1211*a* which is meshed with a minute CG second intermediate wheel gear 1212*a*. Further, a minute CG second intermediate wheel pinion 1212*b* is meshed with a minute CG third intermediate wheel gear 1213*a*, and a minute CG third intermediate wheel pinion 1213*b* is meshed with a minute CG fourth intermediate wheel gear 1214*a*. Further, a minute CG fourth intermediate wheel pinion 1214*b* is meshed with a minute CG wheel 1216*a*.

In addition, a minute CG wheel pinion 1216*b* is meshed with an hour CG intermediate wheel gear 1215*a*, and an hour CG intermediate wheel pinion 1215*b* is meshed with an hour CG wheel gear 1217*a*. Note that, in FIG. 3 to FIG. 5, since a speed reduction ratio from the rotor 1404 to the minute CG wheel gear 1216*a* is set to 1/18000, the minute CG wheel 1216 is rotated one turn in 60 minutes and a chronograph minute can be displayed by the minute chronograph hand 1212 fitted to the extreme end of the minute CG wheel 1216.

Further, since a speed reduction ratio from the minute CG wheel pinion 1216*b* to the hour CG wheel gear 1217*a* is set to 1/12, the hour CG wheel 1217 is rotated one turn in 12 hours, and a chronograph hour can be displayed by the hour chronograph hand 1211 fitted to the extreme end of the hour CG wheel 1217.

As described above, the one second display unit 1230, the 60 seconds display unit 1220, the hour chronograph 1211 and the minute chronograph 1212 are disposed to the portions corresponding to the positions of the approximate 10 o'clock, the approximate 12 o'clock and the approximate 2 o'clock of the dial 1002, respectively. Then, the train wheels and the like are disposed in the vicinity of them in correspondence to them. Further, as described above, the chronograph motor 1400 as the chronograph drive unit is disposed to the portion corresponding to the position of the approximate 9 o'clock to the position of the approximate 12 o'clock of the dial 1002 which are located in the vicinity of the train wheels and the like. Since the chronograph motor 1400 operates the one second display unit 1230, the 60 seconds display unit 1220, and the train wheels of the hour chronograph 1211 and the minute chronograph 1212, when the chronograph motor 1400 is disposed to the portion corresponding to the position of the approximate 9 to the position of the approximate 12 o'clock, the drive force of the motor can be transmitted in the following sequence.

That is, the drive force is transmitted from the one second display unit 1230 to the 60 seconds display unit 1220, and then transmitted to the hour chronograph hand 1211 through the minute chronograph hand 1212. At the time, if the chronograph motor 1400 is disposed to other position, the distance from the one second display unit 1230 to the hour chronograph 1211 is increased, whereby the number of train wheels arranged in the intermediate portion therebetween is increased or the diameters of the wheel gears are increased.

Accordingly, the embodiment can minimize the number of the train wheels as well as optimize gear diameters, whereby a remarkable effect of saving the space of the multi-function electronic watch 1000 can be achieved.

Next, the circuit board 1704 of the multi-function electronic watch 1000 will be described.

Figure 7:
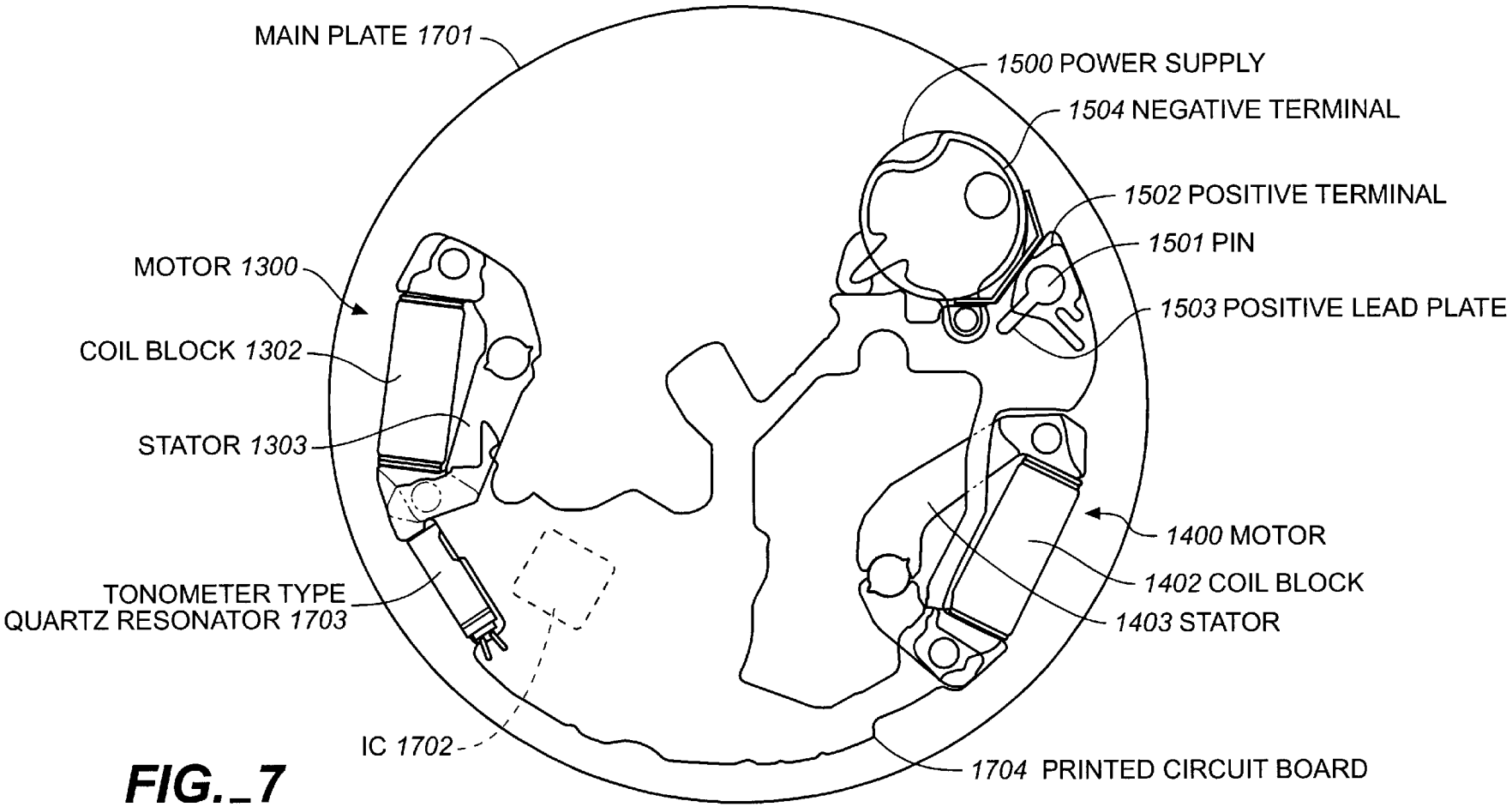
FIG. 7 is a view showing a state of the circuit board and the like of the multi-function electronic watch.
Figure 8:
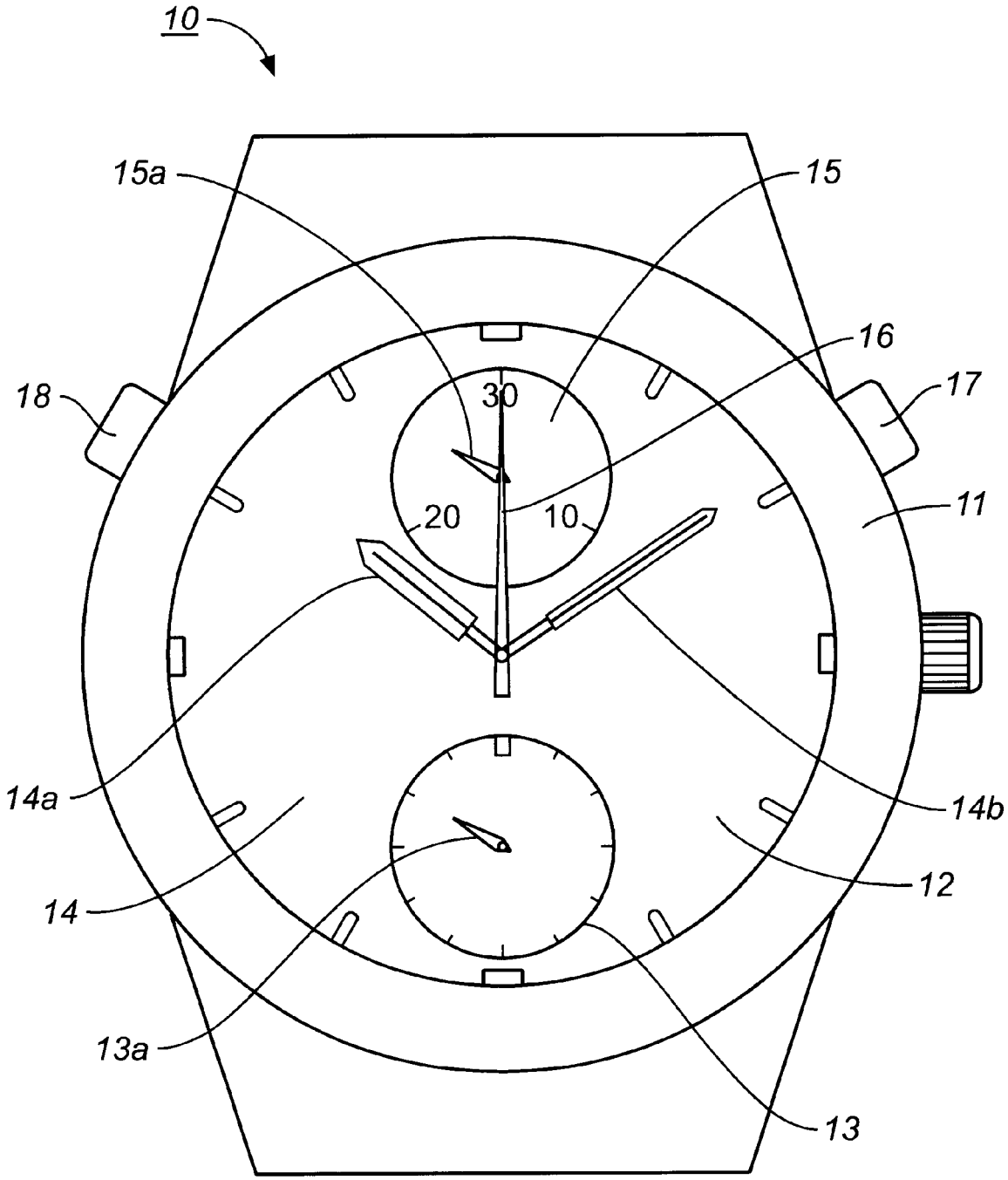
FIG. 8 (PRIOR ART)
FIG. 8 shows the display surface of an electronic watch as a conventional multi-function timepiece.
Figure 9:
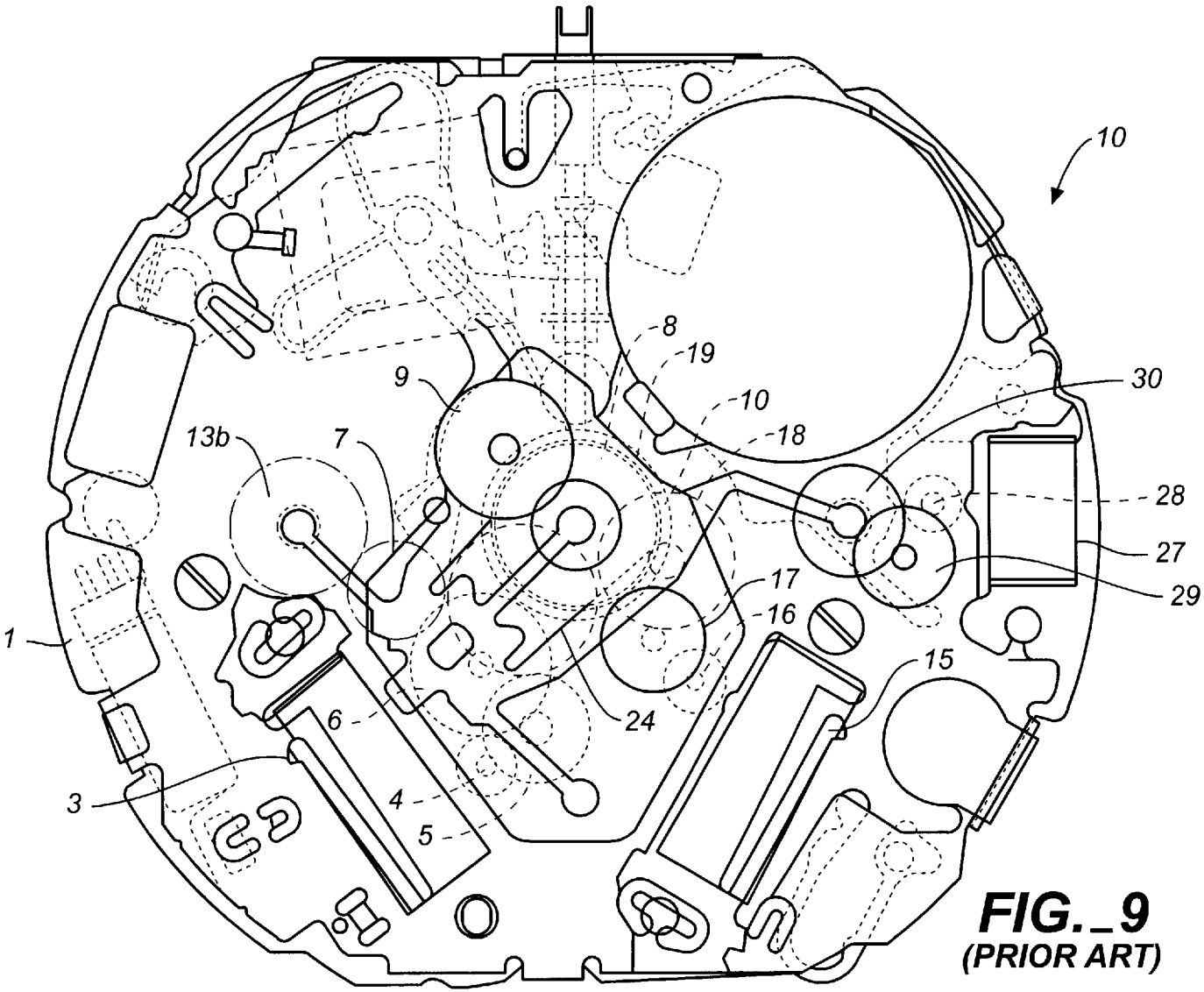
FIG. 9 (PRIOR ART)
FIG. 9 is a view showing the train wheels and the like of an ordinary second time small second hand, an ordinary time hour hand, an ordinary minute time minute hand, a chronograph 1/5 second CG hand, and a chronograph minute CG hand.
Figure 10:
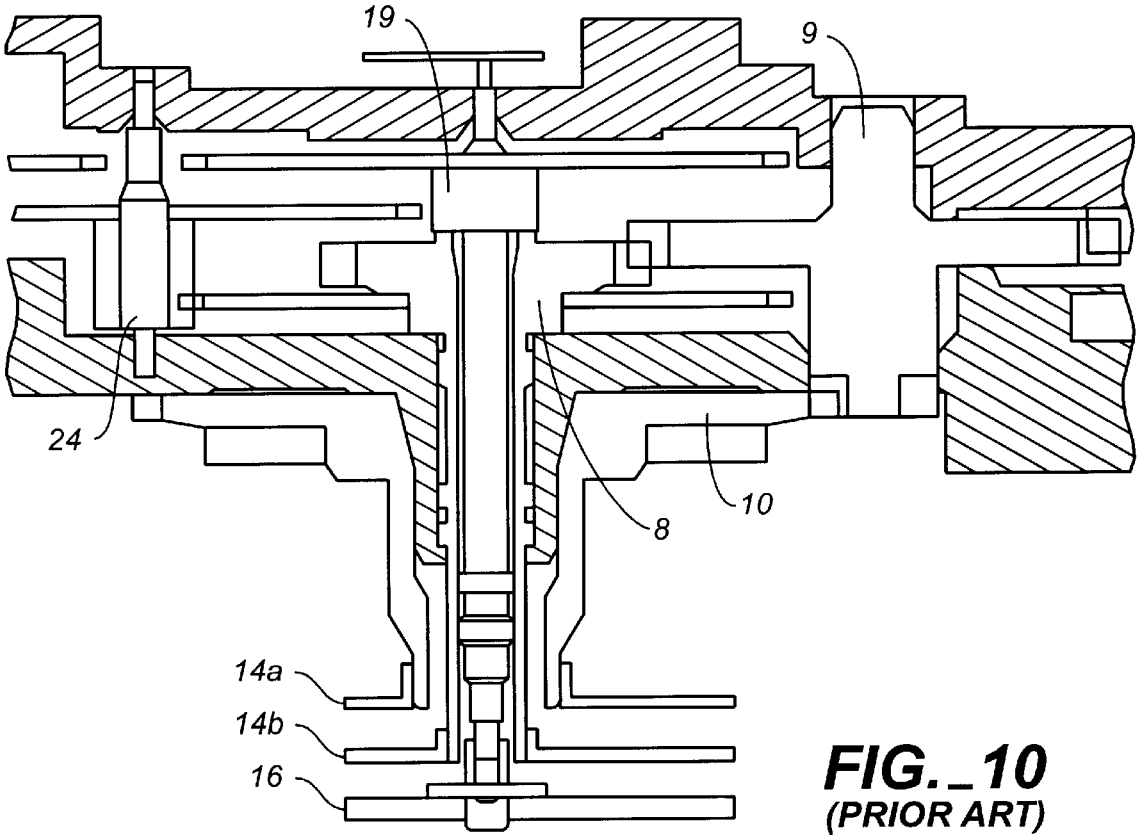
FIG. 10 (PRIOR ART)
FIG. 10 is a side sectional view showing how the train wheels of the ordinary time hour hand, the ordinary minute time minute hand, and the chronograph 1/5 second CG hand of FIG. 9 are engaged.

The circuit board 1704 shown in FIG. 7 is, for example, a flexible print board and disposed on the movement 1700 shown in FIG. 2. The IC 1702, the tonometer type quartz resonator 1703 and the like are mounted on the circuit board 1704. Then, drive pulses of an ordinary time and a chronograph are generated by the IC 1702 and transmitted to the coil blocks 1302 and 1402 of the respective motors 1300 and 1400 connected to a not shown copper foil pattern.

As shown in FIG. 2, the power supply 1500 is disposed to a portion corresponding to the position of the approximate 1 hour to the position of the approximate 12 o'clock of the dial 1002. The positive terminal of the power supply 1500 is connected to the circuit board 1704 in such a manner that the extreme end spring portion of a positive terminal 1502, which is guided by a pin 1501 fitted into the main plate 1701 composed of a metal, comes into contact with the side of the button type secondary power supply 1500 with predetermined spring force, a positive lead plate 1503 comes into contact with the extreme end of the pin 1501, and further extreme end spring portion of the positive lead plate 1503 comes into contact with the positive pattern of the circuit board 1704 with predetermined spring force.

Therefore, the positive voltage is supplied through the power supply 1500→the positive terminal 1502→the main plate 1701→the pin 1501→the positive lead plate 1503→the positive pattern of the circuit board 1704→the IC 1702. Further, the negative voltage of the power supply 1500 is connected to the circuit board 1704 in such a manner that a spring portion, which is disposed to the outer periphery of a negative terminal 1504 welded and conducted to the end surface of the power supply 1500, comes into contact with the negative pattern of the circuit board 1704 with predetermined spring force.

Therefore, the negative voltage is supplied through the power supply 1500→the negative terminal 1504→the negative pattern of the circuit board 1704→the IC 1702.

As described above, the power supply 1500 is disposed to the portion corresponding to the position of the approximate 1 o'clock to the position of the approximate 12 o'clock of the dial 1002. In contrast, the ordinary time motor 1300 is mounted to the portion corresponding to the position of the approximate 6 of the dial 1002, and the chronograph motor 1400 is mounted to the portion corresponding to the position of the approximate 9 to the position of the 12 o'clock of the dial 1002. Further, the IC 1702 is disposed to the portion corresponding to the position of the approximate 8 o'clock of the dial 1002.

Therefore, the power supply 1500, which is a relatively heavy part in the parts of the multi-function electronic watch 1000, is disposed at a position spaced apart from the ordinary time motor 1300, the chronograph motor 1400 and the IC 1702 so that it does not adversely affect them. Therefore, even if the multi-function electronic watch 1000 is dropped, the other parts are prevented from being directly affected by the weight of the power supply 1500, whereby the reliability of the electronic watch 1000 can be enhanced. Further, the ordinary time motor 1300 is mounted to the portion corresponding to the position of the approximate 6 position of the dial 1002, and the chronograph motor 1400 is mounted to the portion corresponding to the position of the approximate 9 to the position of the approximate 12 o'clock of the dial 1002. Therefore, the wiring distance from the IC 1702 mounted on the circuit board 1704 to the ordinary time motor 1300 and the chronograph motor 1400 cab be shortened, whereby the area of the circuit board 1704 and the like can be reduced.

As described above, according to the embodiment, the thickness and size of the multi-function electronic watch 1000 can be reduced as well as the user can visually confirms the ordinary time display 1110 and the chronograph displays 1210, 1220, and 1230 in the state that they do not overlap each other. As a result, there can be provided the multi-function electronic watch 1000 having the dial 1002 which the user can visually confirm easily.

Note that while the power supply 1500 is shown as an ordinary cell in the embodiment, a power generating unit may be mounted on the multi-function electronic watch 1000. In this case, it is contemplated that the arrangement of the above multi-function electronic watch 1000 is disposed on a first layer and the power generating unit and the like are disposed as a second layer.

Further, while the multi-function electronic watch 1000 having the analog display type chronograph function has been described as the embodiment, the present invention is not particularly limited thereto and analog display type multi-function time measurement may be applied to a timepiece.

As described above, according to the present invention, there can be provided the timepiece whose thickness and size are reduced and which can be visually confirmed by the user easily. Further, according to the present invention, the user of the timepiece can visually confirm the ordinary time display unit and the chronograph display unit easily. Additionally, the thickness and the size of the timepiece having the chronograph function can be reduced.

According to the present invention, since the plane size of the portion of the parts, which constitute the ordinary time measuring section and the time information measuring section, respectively, can be reduced, the overall thickness and size of the timepiece can be reduced as well.

According to the present invention, since the ordinary time display unit and the chronograph display units are separately disposed to the outer peripheral portion of the timepiece at arbitrary distances from the approximate center of the timepiece, the parts constituting the display units are not overlapped and the thickness may be minimized.

According to the present invention, the user of the timepiece can visually confirm the ordinary time display unit easily.

According to the present invention, the user of the timepiece can instantly read the entire chronograph display unit.

According to the present invention, since the ordinary time motor is disposed near the ordinary time display unit, the number of components constituting the ordinary time train wheel can be minimized and the diameters of the wheel gears thereof can be reduced, such that the size of the timepiece can be reduced.

According to the present invention, since the chronograph motor is disposed near the chronograph display unit, the number of components constituting the chronograph train wheels can be minimized and the diameters of the wheel gears thereof can be reduced, such that the size of the timepiece can be reduced.

According to the overall present invention, since the chronograph display unit can be driven by only one motor, the space in the timepiece can be reduced, thereby reducing the overall cost of the timepiece. Further, it is possible to accurately display the chronograph.

According to the present invention, it is difficult for the power supply to adversely affect the ordinary time motor, the ordinary time train wheel, the chronograph motor, the chronograph train wheels, and the like. Further, even if the timepiece is dropped, the adverse affect of the weight of the power supply on the other parts can be avoided, whereby the reliability of the timepiece is enhanced. Even if the timepiece is subjected to an external disturbance, parts such as the ordinary time motor and the like are not adversely affected by the relatively heavy power supply unit, that is, they are not subjected to breakage and the like.

Further, according to the present invention, the electric signal output unit can be prevented from being broken by the external disturbance such as a shock and the like, thereby enhancing the reliability of the timepiece According to the present invention, since the number of the parts of the train wheel of the time correcting unit can be reduced, the number of components can be minimized. Further, the time correcting unit can be disposed at a portion where it is easy for the user to manipulate.

Furthermore, according to the present invention, the timepiece can be designed so that the space thereof can be effectively while the number of the components of the time correcting unit can be minimized.

A preferable embodiment of the present invention will be described below .

Figure 11:
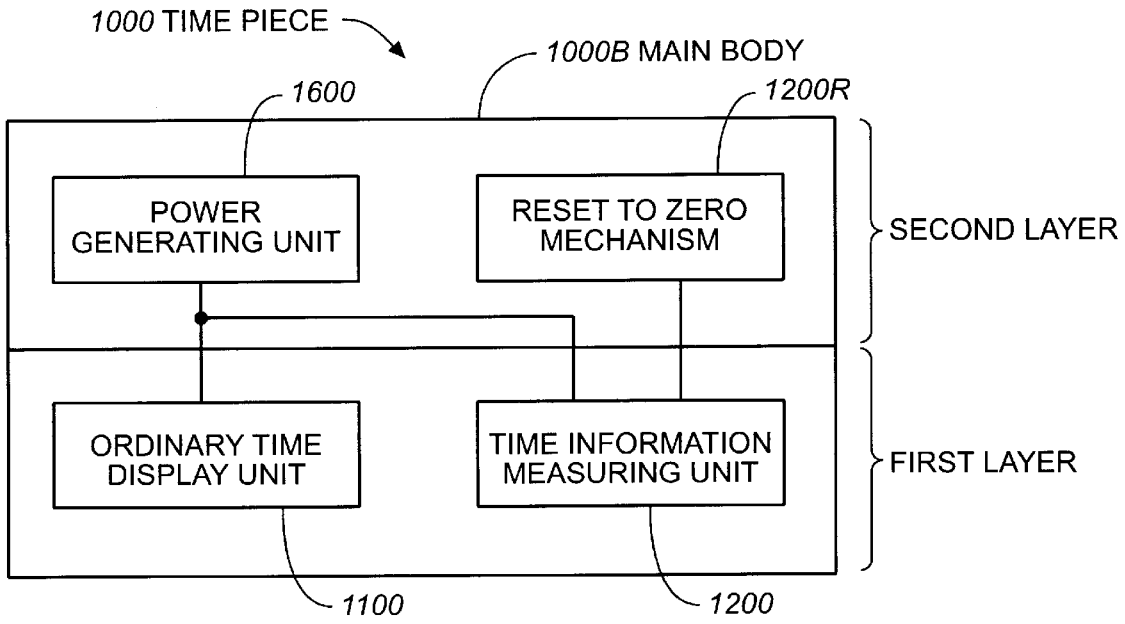
FIG. 11 is a schematic block diagram showing the arrangement of an embodiment of a timepiece of the present invention.

FIG. 11 is a schematic block view showing the arrangement of an embodiment of a timepiece of the present invention.

A timepiece 1000 shown in FIG. 11 is an analog electronic watch having a chronograph function. As a characteristic portion of the timepiece 1000, a timepiece main body 1000B is divided into a plurality of layers (two layers in the figure) in a side (thickness) direction. An ordinary time measuring section 1100 for measuring an ordinary time and a time information measuring section 1200 for measuring time information other than the ordinary time are disposed on a first layer. A reset to zero mechanism 1200R for resetting the measurement of the time information other than the ordinary time to zero and a power generating unit 1600 for converting mechanical energy into electric energy and generating a drive voltage for driving the ordinary time measuring section 1100 and the time information measuring section 1200 are disposed on a second layer.

The division of the timepiece main body 1000B into the two layers and the separate disposition of the respective components 1100, 1200, 1200R, and 1600 to the respective layers permit the size of the timepiece 1000 to be reduced in the plane (lateral) direction thereof.

Figure 21:
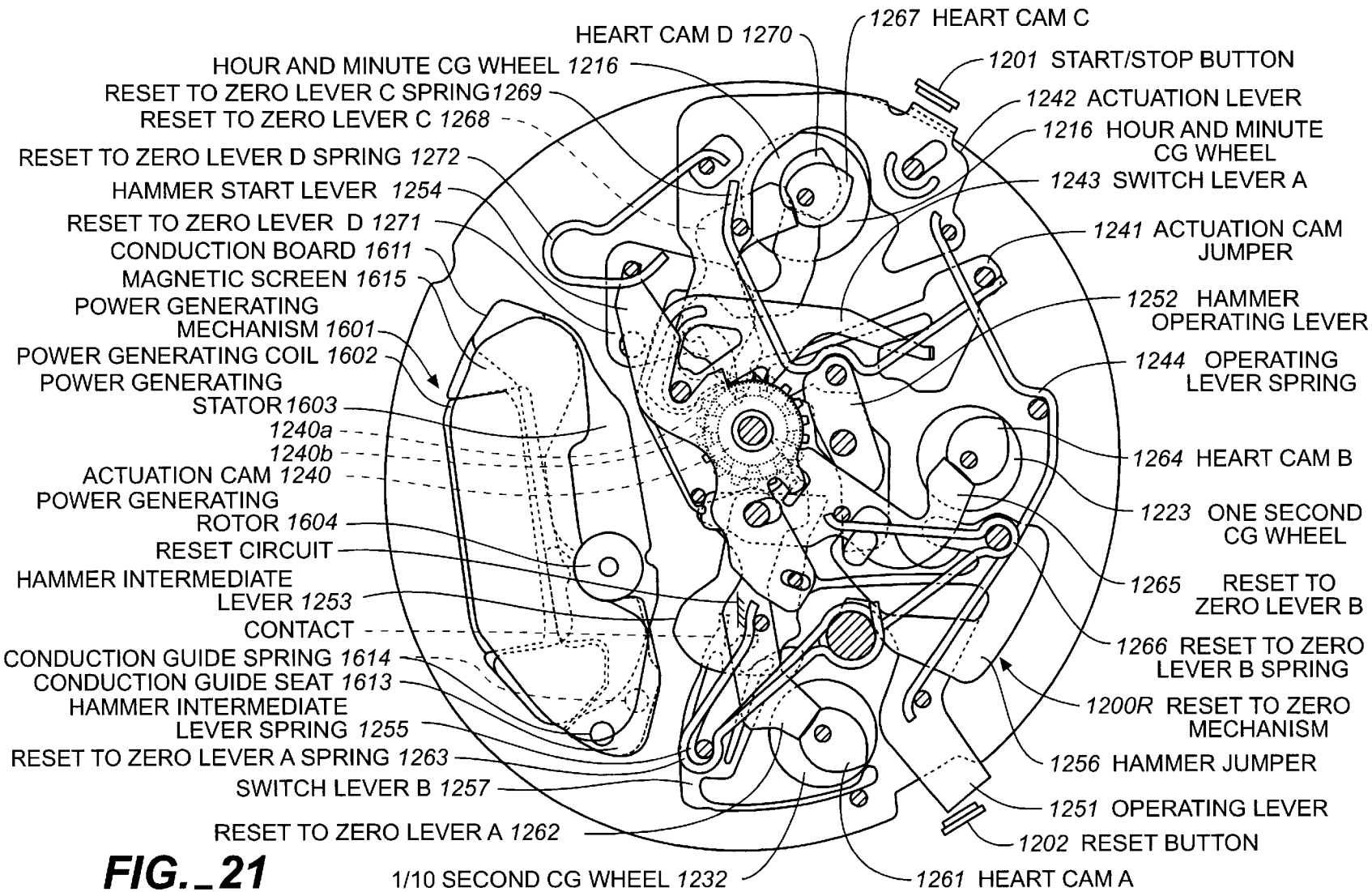
FIG. 21 is a plan view showing a power generating unit (power generating mechanism) and a reset to zero mechanism which constitute the second layer of the timepiece shown in FIGS. 11 and 12 excluding an oscillating weight when they are viewed from the backside of the timepiece.
Figure 24:
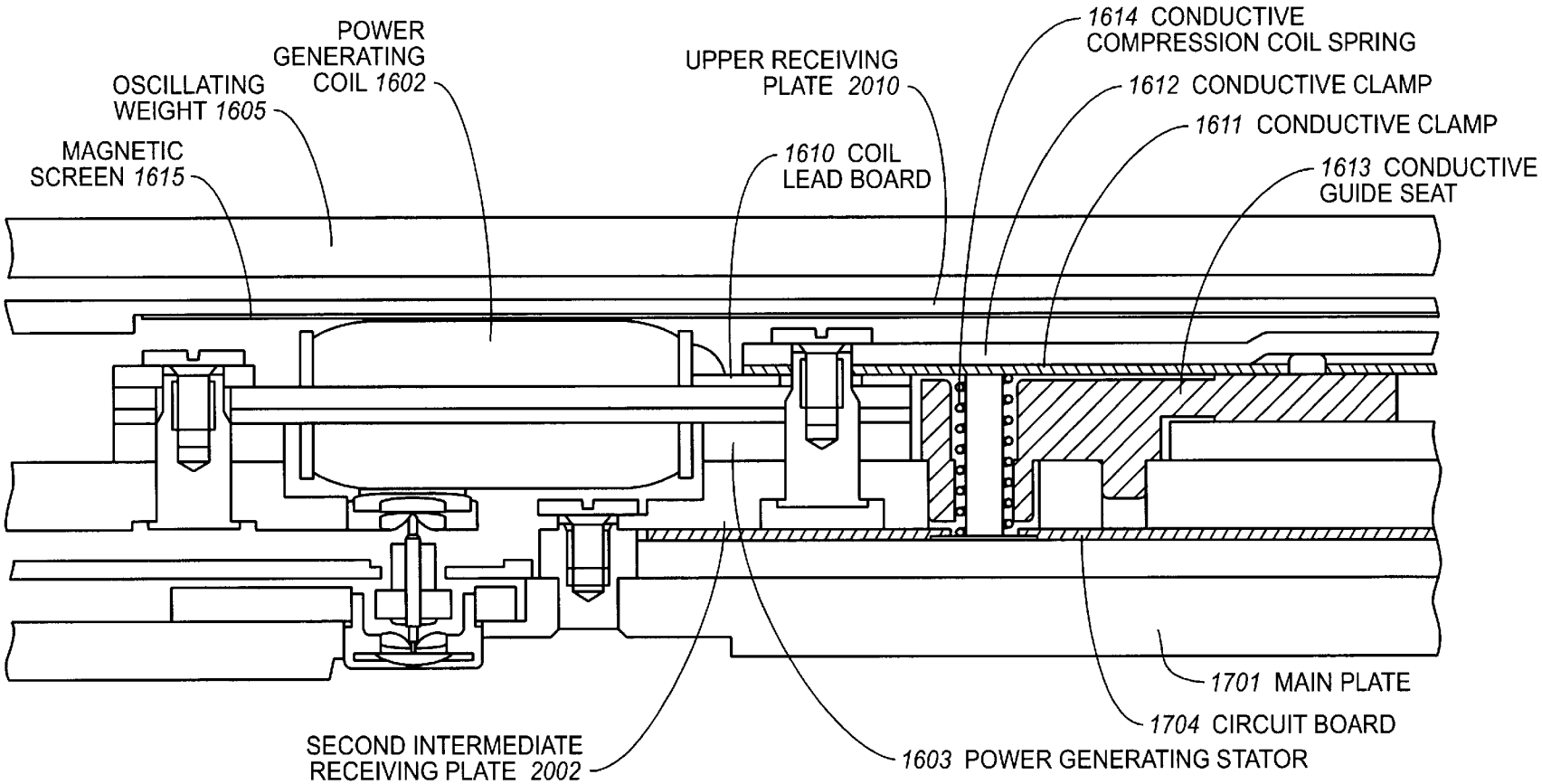
FIG. 24 is a side sectional view of the periphery of the power generating unit shown in FIG. 21.

Further, another characteristic portion of the timepiece 1000 resides in the structure of the periphery of the power generating unit 1600, which will be described later (FIGS. 21 and 24).

Figure 12:
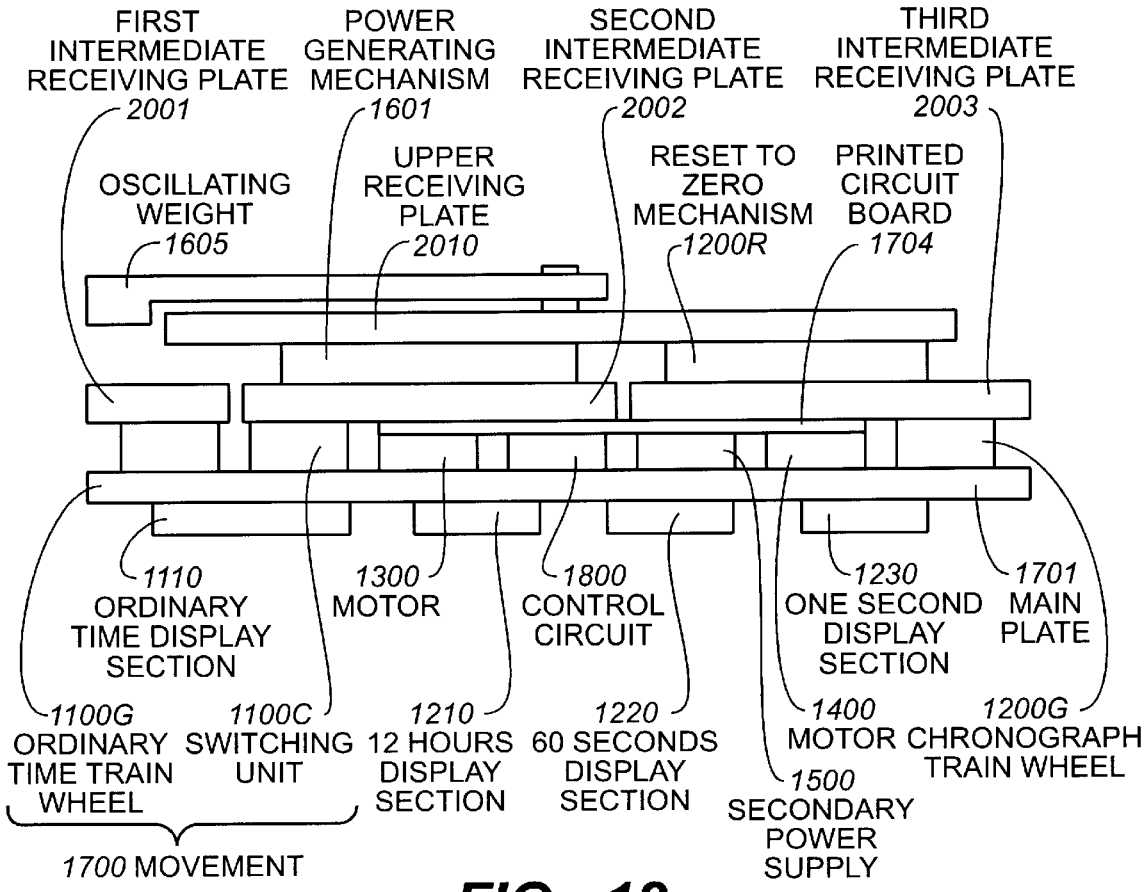
FIG. 12 is a view showing the arrangement of a detailed example of the interior of the main body of the timepiece shown in FIG. 11.

FIG. 12 is a view showing the arrangement of a detailed example of the interior of the timepiece main body 1000B of the timepiece 1000 shown in FIG. 11.

The ordinary time measuring section 1100 includes, as the components thereof, an ordinary time display unit 1110 for displaying an ordinary time by hands, a motor 1300 for driving the hands of the ordinary time display unit 1110, an ordinary time train wheel 1100G for transmitting the drive force of the motor 1300 to the hands of the ordinary time display unit 1110, and a switching unit 1100C for switching the time and the calendar of the ordinary time display unit 1110 to a correcting state. The time information measuring section 1200 includes, as the components thereof, a 12 hours display unit 1210 for displaying 12 hours with a hand, a 60 seconds display unit 1220 for displaying 60 seconds with a hand, a one second display unit 1230 for displaying one second with a hand, a motor 1400 for driving the hands of the respective display units 1210, 1220, and 1230, and a chronograph train wheel 1200G for transmitting the drive force of the motor 1400 to the hands of the respective display units 1210, 1220, and 1230. The ordinary time measuring section 1100 and the time information measuring section 1200 include a secondary power supply 1500 for supplying electric power for driving the respective motors 1300 and 1400 and a control circuit 1800 for controlling them in their entirety as components common to them. The power generating unit 1600 includes, an oscillating weight 1605 for obtaining mechanical energy and a power generating mechanism 1601 for converting the mechanical energy into electric energy and storing it in the secondary power supply 1500.

In the timepiece 1000, the motors 1300 and 1400 are individually driven using the electric power generated by the power generating unit 1600 so as to drive the hands of the ordinary time measuring section 1100 and the time information measuring section 1200. Note that the hands of the respective display units 1210, 1220 and 1230 are mechanically reset to zero by the reset to zero mechanism 1200R without being driven by a motor as described later.

How the above components are disposed will be described with reference to FIG. 12.

In FIG. 12, the first layer is partitioned from the second layer by a first intermediate receiving plate 2001, a second intermediate receiving plate 2002 and a third intermediate receiving plate 2003 which are disposed in a plane (lateral) direction. A main plate 1701 is disposed on the first layer by being spaced apart from the respective receiving plates 2001, 2002, and 2003, and an upper receiving plate 2010 is disposed on the second layer by being spaced apart from the respective intermediate receiving plates 2001, 2002, and 2003.

First, the first layer side will be described. A so-called movement 1700 is interposed between the respective intermediate receiving plate 2001, 2002, and 2003 and the main plate 1701. That is, the ordinary time train wheel 1100G is interposed between the first intermediate receiving plate 2001 and the main plate 1701, the switching unit 1100C, the motor 1300 and the control circuit 1800 are interposed between the second intermediate receiving plate 2002 and the main plate 1701, and the secondary power supply 1500, the motor 1400 and the chronograph train wheel 1200G are interposed between the third intermediate receiving plate 2003 and the main plate 1701. Then, a circuit board 1704 is disposed on the motor 1300, the control circuit 1800, the secondary power supply 1500 and the motor 1400. Further, the ordinary time display unit 1110 is disposed on the main plate 1701 and the respective display units 1210, 1220 and 1230 are disposed on a dial 1002 shown in FIG. 13.

Next, the second layer side will be described. The power generating mechanism 1601 is interposed between the second intermediate receiving plate 2002 and the upper receiving plate 2010, and the reset to zero mechanism 1200R is interposed between the third intermediate receiving plate 2003 and the upper receiving plate 2010. Then, an oscillating weight 1605 is disposed on the upper receiving plate 2010.

A specific example of the respective components of the first layer and the second layer of the timepiece 1000 arranged as described above will be described below.

First, the first layer will be described with reference to FIG. 13 to FIG. 20.

Figure 13:
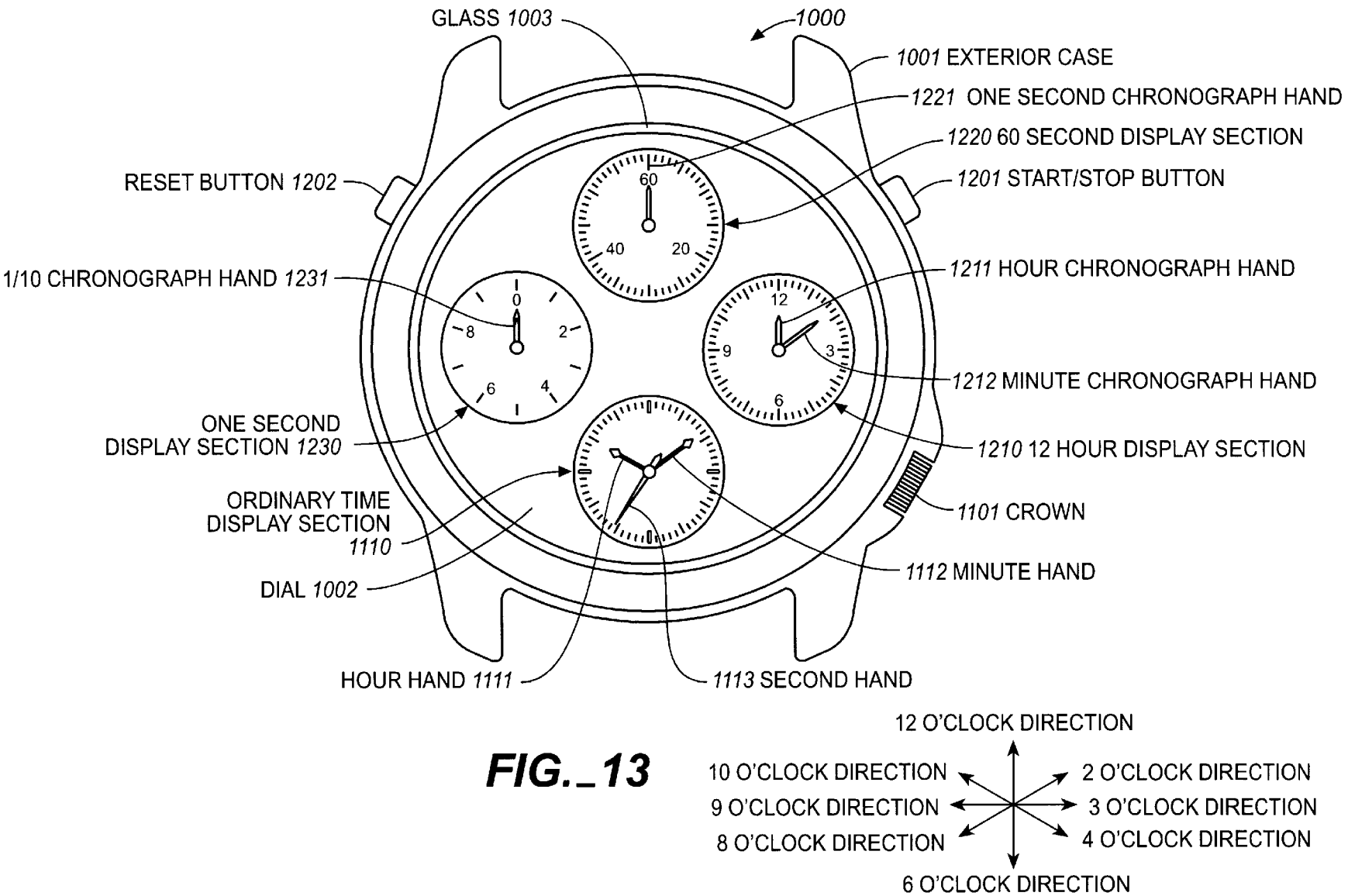
FIG. 13 is a plan view showing the respective display units constituting the first layer of the timepiece shown in FIGS. 11 and 12 when they are viewed from the surface side of the timepiece.

FIG. 13 is a plan view showing the respective display units 1110, 1210, 1220, and 1230 constituting the first layer of the timepiece 1000 shown in FIGS. 11 and 12 when they are viewed from the surface side of the timepiece 1000.

In FIG. 13, the timepiece 1000 is arranged such that the dial 1002 is assembled to the movement 1700 and a transparent glass 1003 is fitted in the interior of an outer case 1001. A crown 1101 as an external manipulating member is disposed at the 4 o'clock position of the outside case 1001, and a chronograph start/stop button 1201 and a chronograph reset button 1202 are disposed at the positions of approximately 2 o'clock and approximately 10 o'clock. Further, the ordinary time display unit 1110 including hour hand 1111, a minute hand 1112, and a second hand 1113 which are ordinary time hands is disposed at the position of approximately 6 o'clock of the dial 1002, and the display units 1210, 1220, and 1230 having chronograph auxiliary hands are disposed at the positions of approximately 3 o'clock, 12 o'clock and 9 o'clock respectively. That is, the 12 hours display unit 1210 having hour and minute chronograph hands 1211 and 1212 are disposed at the position of approximately 3 o'clock, the 60 seconds display unit 1220 having a one second chronograph hand 1221 is disposed at the position of approximately 12 o'clock, and the one second display unit 1230 having a 1/10 chronograph hand 1231 is disposed at the position of approximately 9 o'clock.

Figure 14:
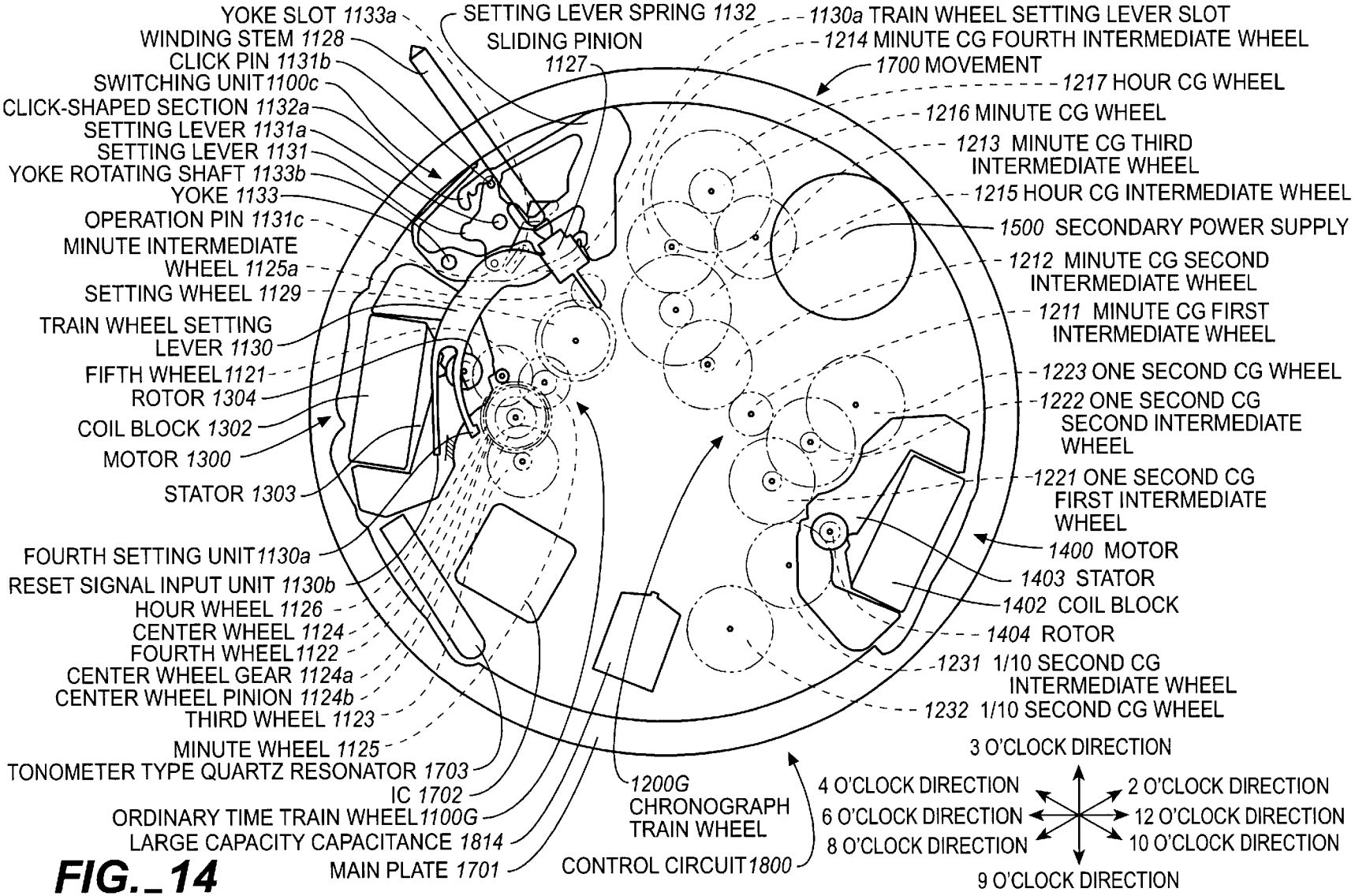
FIG. 14 is a plan view showing the movement constituting the first layer of the timepiece shown in FIGS. 11 and 12 excluding a circuit board when it is viewed from the backside of the timepiece.

FIG. 14 is a plan view showing the movement 1700 constituting the first layer of the timepiece 1000 shown in FIGS. 11 and 12 excluding the circuit board 1704 constituting the first layer when it is viewed from the backside of the timepiece.

In the movement 1700 shown in FIG. 14, the ordinary time train wheel 1100G, the motor 1300, the switching unit 1100C and an IC 1702 constituting the control circuit 1800, a tonometer type quartz resonator 1703, a large capacity capacitor 1814 and the like are disposed on the main plate 1701 about the 6 o'clock position and the chronograph train wheel 1200G, the motor 1400 and the secondary power supply 1500 such as a lithium ion power supply and the like are disposed on the main plate 1701 about the 12 o'clock position.

In FIG. 14, the ordinary time train wheel 1100G includes the train wheel of a fifth wheel 1121, a second wheel 1122, a third wheel 1123, a center wheel 1124, a minute wheel 1125, and an hour wheel 1126. A second display, a minute display and an hour display of an ordinary time are carried out by the train wheel.

Figure 15:
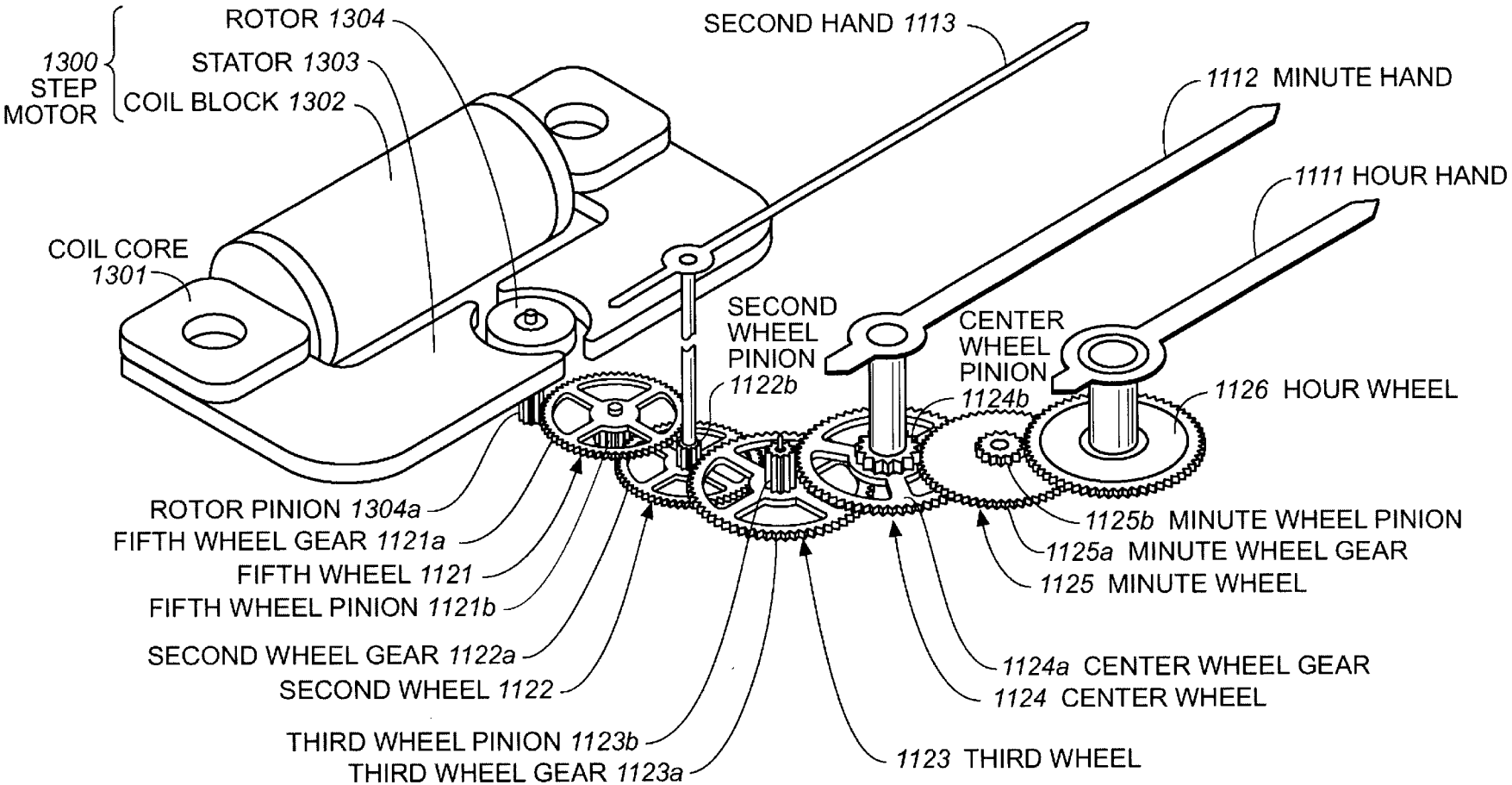
FIG. 15 is a perspective view showing how an ordinary time train wheel in the movement shown in FIG. 14 is engaged.
Figure 16:
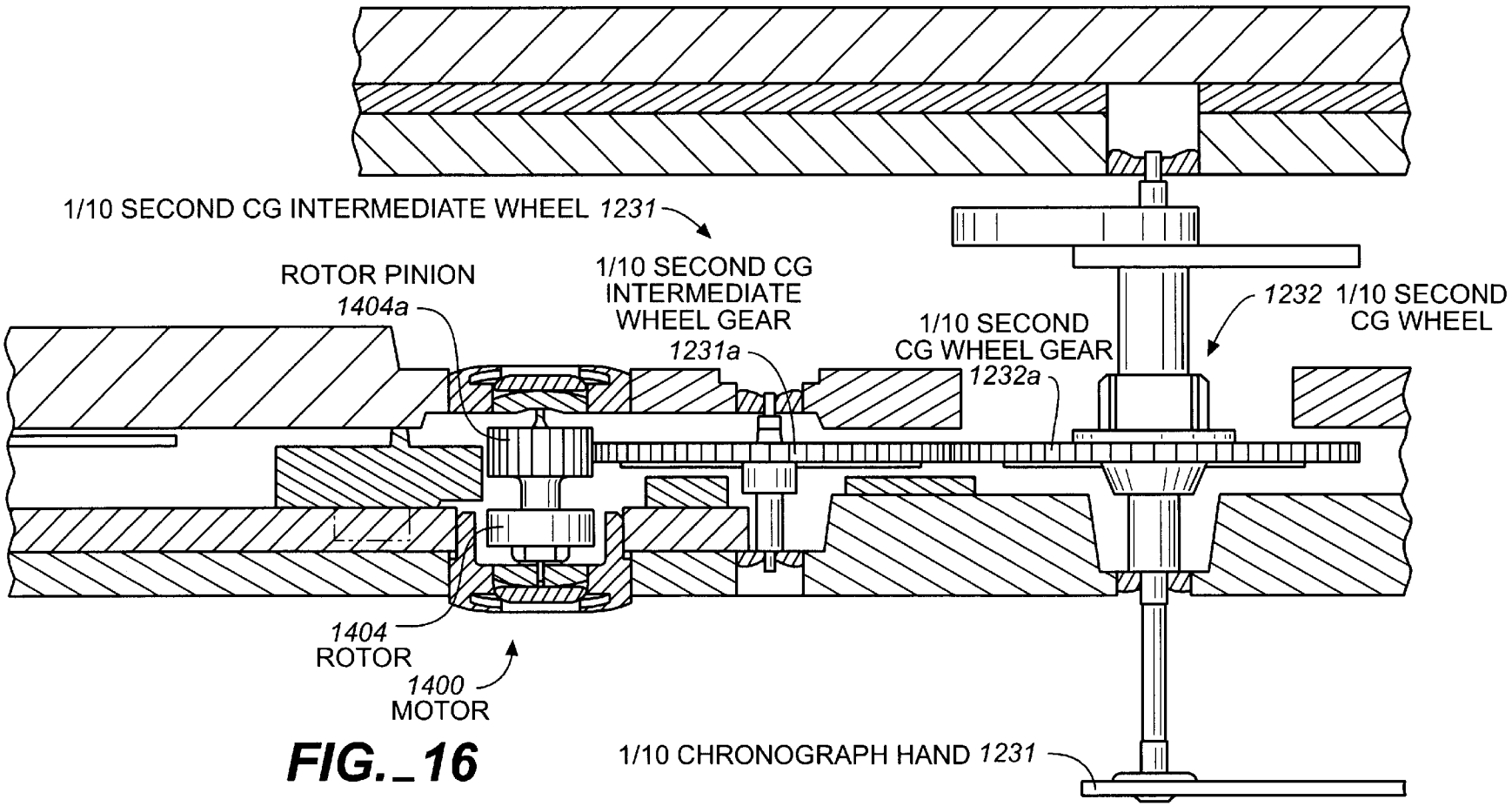
FIG. 16 is a side sectional view showing how a chronograph 1/10 second display train wheel in the movement shown in FIG. 14 is engaged.

In FIG. 14, the motors 1300 and 1400 are step motors and composed of coil blocks 1302 and 1402 having magnetic cores composed of a highly permeable material. Stators 1303 and 1403 are composed of a highly permeable material. Rotors 1304 and 1404 are composed of rotor magnets and rotor pinions, and the like. FIG. 15 is a perspective view schematically showing how the train wheel of the ordinary time train wheel 1100G is engaged with the motor 1300.

A rotor pinion 1304*a* which constitutes the rotor 1304 is meshed with a fifth wheel gear 1121*a* and a fifth wheel pinion 1121*b* is meshed with a second wheel gear 1122*a*. Since a speed reduction ratio from the rotor pinion 1304*a* to the second wheel gear 1122*a* is set to 1/30, an electric signal is output from the IC 1702 so that the rotor 1304 to be rotated one-half turn in one second. With this operation, the second wheel 1122 is rotated one turn in 60 seconds, whereby an ordinary time second can be displayed by the second hand 1113 fitted to the extreme end of the second wheel 1122.

Further, a second wheel pinion 1122*b* is meshed with a third wheel gear 1123*a* and a third wheel pinion 1123*b* is meshed with a center wheel gear 1124*a*. Since a speed reduction ratio from the second wheel pinion 1122*b* to the center wheel gear 1124*a* is set to 1/60, the center wheel 1124 is rotated one turn in 60 minutes, whereby an ordinary time minute can be displayed by the minute hand 1112 fitted to the extreme end of the center wheel 1124.

Further, a center wheel pinion 1124*b* is meshed with a minute wheel gear 1125*a* which is meshed with the hour wheel 1126. Since a speed reduction ratio from the center wheel pinion 1124*b* to the hour wheel 1126 is set to 1/12, the hour wheel 1126 is rotated one turn in 12 hours, whereby an ordinary time hour can be displayed by the hour hand 1111 fitted to the extreme end of the hour wheel 1126.

In FIG. 14, the switching unit 1100C includes the crown 1101, which is shown in FIG. 13 at an end thereof, and includes a winding stem 1128 to which a sliding pinion 1127 is fitted, a setting wheel 1129, a setting lever 1131, a setting lever spring 1132, a yoke 1133, and a train wheel setting lever 1130 at the other end thereof.

The winding stem 1128 is a member for correcting a time and the like externally and may be set to three states by pulling out the crown 1101. A state in which it is pushed most inwardly (zeroth stage), a state in which it is pulled out one stage (first stage), and a state in which it is pulled out two stages (second stage). In the zeroth stage the ordinary hands are driven on the ordinary time display unit 1110. In the first stage the ordinary hands are driven on the ordinary time display unit 1110 similarly to the zeroth state and a calendar can be corrected. In the second stage the hands are not driven on the ordinary time display unit 1110 and a time can be corrected.

The winding stem 1128 is a long columnar rod having a cut-out formed at a portion thereof, and the extreme end of the setting lever 1131 is engaged with the cut-out. When the winding stem 1128 is pulled out, the setting lever 1131 is rotated counterclockwise about a setting lever rotating shaft 1131*a*. A click pin 1131*b* is disposed to a portion of the setting lever 1131, and the click-shaped portion 1132*a* of the setting lever spring 1132 is engaged with the click pin 1131*b*. When the setting lever 1131 is rotated, click force is generated by the click-shaped portion 1132*a* as well as positioning of the zeroth, first and second stages is carried out.

The setting lever 1131 is provided with another operation pin 1131*c* in confrontation with the click pin 1131*b* and the setting lever rotating shaft 1131*a*. A yoke slot 1133*a* and a yoke slot 1130*a*, which is disposed in the shape of the yoke 1133, and the train wheel setting lever 1130, are engaged with the operation pin 1131*c*. Further, the sliding pinion 1127 is guided by the winding stem 1128 through the center hole thereof and can be rotated together with the rotation of the winding stem 1128.

The yoke 1133 can be rotated about a yoke rotating shaft 1133*b*. Further, the extreme end of the yoke 1133 is engaged with a cut-out formed on the sliding pinion 1127. The yoke 1133 moves the sliding pinion 1127 forward and backward, thereby creating a calendar correcting state and a time correcting state. The yoke 1133 has a spring portion and always applies force in the direction of the setting lever rotating shaft 1131*a* of the setting lever 1131. When the setting lever 1131 is rotated, the operation pin 1131*c* of the setting lever 1131 is also rotated thereby. Thus, the extreme end of the yoke 1133 moves the sliding pinion 1127 toward the outside in the first stage and toward the center in the second stage through the yoke slot 1133*a* which is engaged with the operation pin 1131*c*. In the first stage, a wheel gear provided with the sliding pinion 1127 is meshed with a backside calendar part to thereby permit a calendar to be corrected. In the second stage, the wheel gear disposed at the extreme end of the sliding pinion 1127 is meshed with the setting wheel 1129 to thereby permit a time to be corrected.

The train wheel setting lever 1130 sets the second wheel 1122 when a time is corrected as well as stops hand operating pulses by inputting a reset signal. Likewise the yoke 1133, the train wheel setting lever 1130 is rotated by the rotation of the operation pin 1131*c* of the setting lever 1131 about a train wheel setting lever rotating shaft 1130*b* along the train wheel setting lever slot 1130*a* with which it is engaged, thereby setting the second wheel 1122 as well as coming into contact with a reset pattern. Since it is sufficient that the action of the train wheel setting lever 1130 is applied only in the second stage, the shape of the train wheel setting lever slot 1130*a* escapes the rotational locus of the operation pin 1131*c* of the setting lever 1131 from the zeroth stage to the first stage as it is.

With the above arrangement, the winding stem 1128 is pulled to the second stage by pulling the crown 1101, a reset signal input section 1130*b* disposed to the train wheel setting lever 1130 comes into contact with the pattern of a circuit substrate 1704 on which the IC 1702 is mounted, thereby stopping the output of motor pulses so as to stop the operation of the hands. At the time, the rotation of the fourth wheel gear 1122*a* is set by the train wheel setting lever slot 1130*a* disposed to the train wheel setting lever 1130. When the winding stem 1128 is rotated together with the crown 1101 in this state, rotational force is transmitted from the sliding pinion 1127 to the minute wheel 1125 through the setting wheel 1129 and the minute wheel gear 1125*a*. Since the center wheel gear 1124*a* is coupled with the center wheel pinion 1124*b* with predetermined sliding torque, the setting wheel 1129, the minute wheel 1125, the center wheel pinion 1124*b*, and the hour wheel 1126 are rotated even if the second wheel 1122 is set. Therefore, an arbitrary time can be set because the minute hand 1112 and the hour hand 1111 are rotated.

In FIG. 14, the chronograph train wheel 1200G includes the train wheels of a 1/10 second CG (chronograph) intermediate wheel 1231 and a 1/10 second CG wheel 1232 which is disposed at the center position of the one second display unit 1230. With the above arrangement of the train wheels, chronograph 1/10 second is displayed at the 9 o'clock position of the watch.

Further, in FIG. 14, the chronograph train wheel 1200G includes the train wheels of a one second CG first intermediate wheel 1221, a one second CG second intermediate wheel 1222, and a one second CG wheel 1223 which is disposed at the center position of the 60 seconds display unit 1220: With the above arrangement of the train wheels, a chronograph second is displayed at the 12 o'clock position of the watch.

Further, in FIG. 14, the chronograph train wheel 1200G includes the train wheels of a minute CG first intermediate wheel 1211, a minute CG second intermediate wheel 1212, a minute CG third intermediate wheel 1213, a minute CG fourth intermediate wheel 1214, an hour CG intermediate wheel 1215, a minute CG wheel 1216, and an hour CG wheel 1217. The minute CG wheel 1216 and the hour CG wheel 1217 are concentrically disposed at the center position of the 12 hours display unit 1210. With the above arrangement of the train wheels, a chronograph minute and hour are displayed at the 3 o'clock position of the watch.

FIG. 6 is a side sectional view showing how a 1/10 second display train wheel of the chronograph train wheel 1200G is engaged.

A rotor pinion 1404*a* is meshed with a 1/10 second CG intermediate wheel gear 1231*a* which meshed with a 1/10 second CG wheel gear 1232*a*. Since a speed reduction ratio from the rotor pinion 1404*a* to the 1/10 second CG wheel gear 1232*a* is set to 1/5, the IC 1702 outputs an electric signal so that the rotor 1404 is rotated one-half turn in 1/10 second. Thus, the 1/10 second CG wheel 1232 is rotated one turn in a second, and chronograph 1/10 second can be displayed by the 1/10 second chronograph hand 1231 fitted to the extreme end of the 1/10 second CG wheel 1232.

Figure 17:
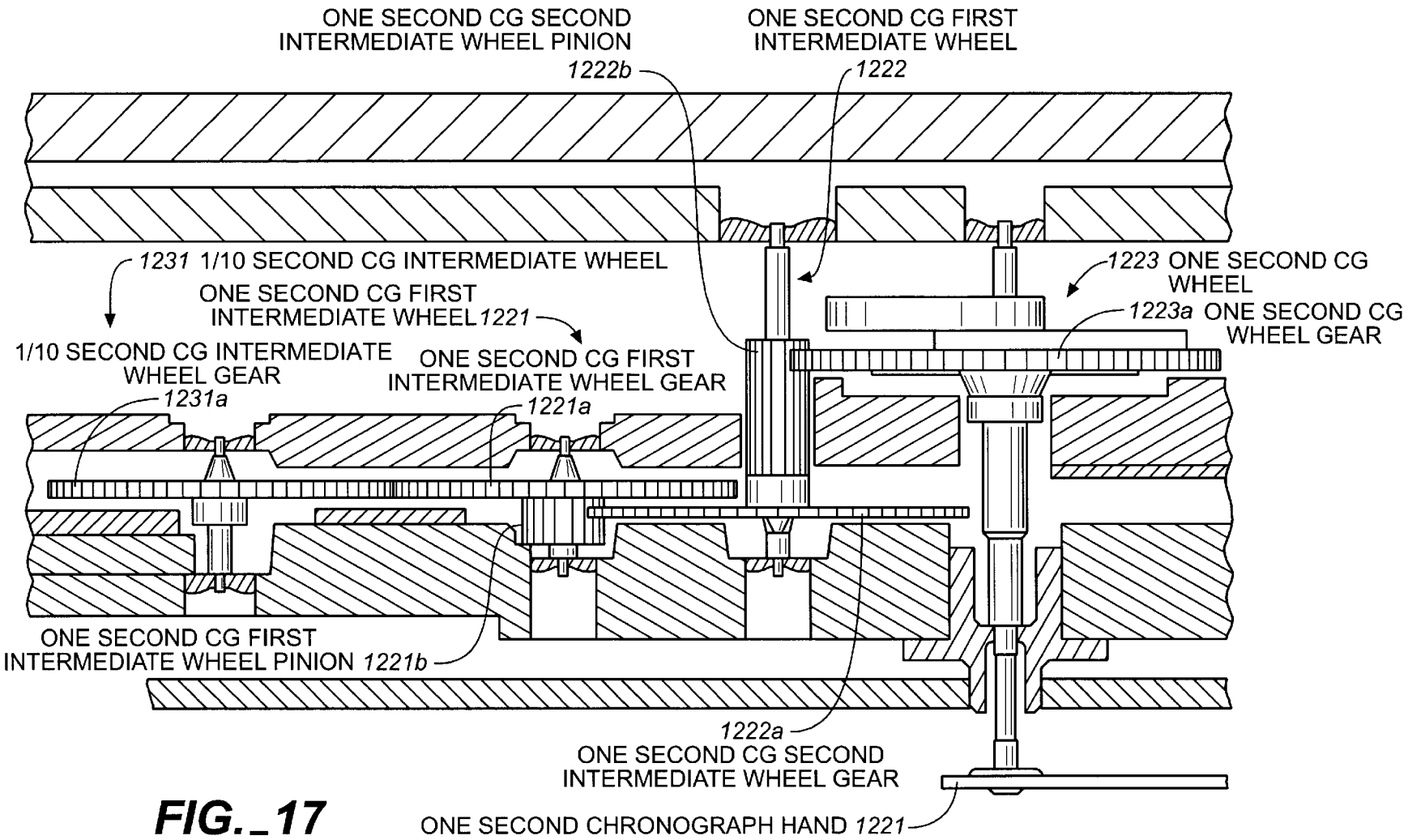
FIG. 17 is a side sectional view showing how a chronograph 1 second display train wheel in the movement shown in FIG. 14 is engaged.

FIG. 17 is a side sectional view showing how a one second display train wheel of the chronograph train wheel 1200G is engaged.

The 1/10 second CG intermediate wheel gear 1231*a* is meshed with a one second CG first intermediate wheel gear 1221*a*, and a one second CG first intermediate wheel pinion 1221*b* is meshed with a one second CG second intermediate wheel gear 1222*a*. Further, a one second CG second intermediate wheel pinion 1222*b* is meshed with a one second CG gear wheel 1223*a*. The 1/10 second CG intermediate wheel gear 1231*a* is meshed with the rotor pinion 1404*a* as described above, and a speed reduction ratio from the rotor pinion 1404*a* to the one second CG gear wheel 1223*a* is set to 1/300. Therefore, the one second CG wheel 1223 is rotated one turn in 60 seconds, and a chronograph one second can be displayed by the one second chronograph hand 1221 engaged with the extreme end of the one second CG wheel 1223.

Figure 18:
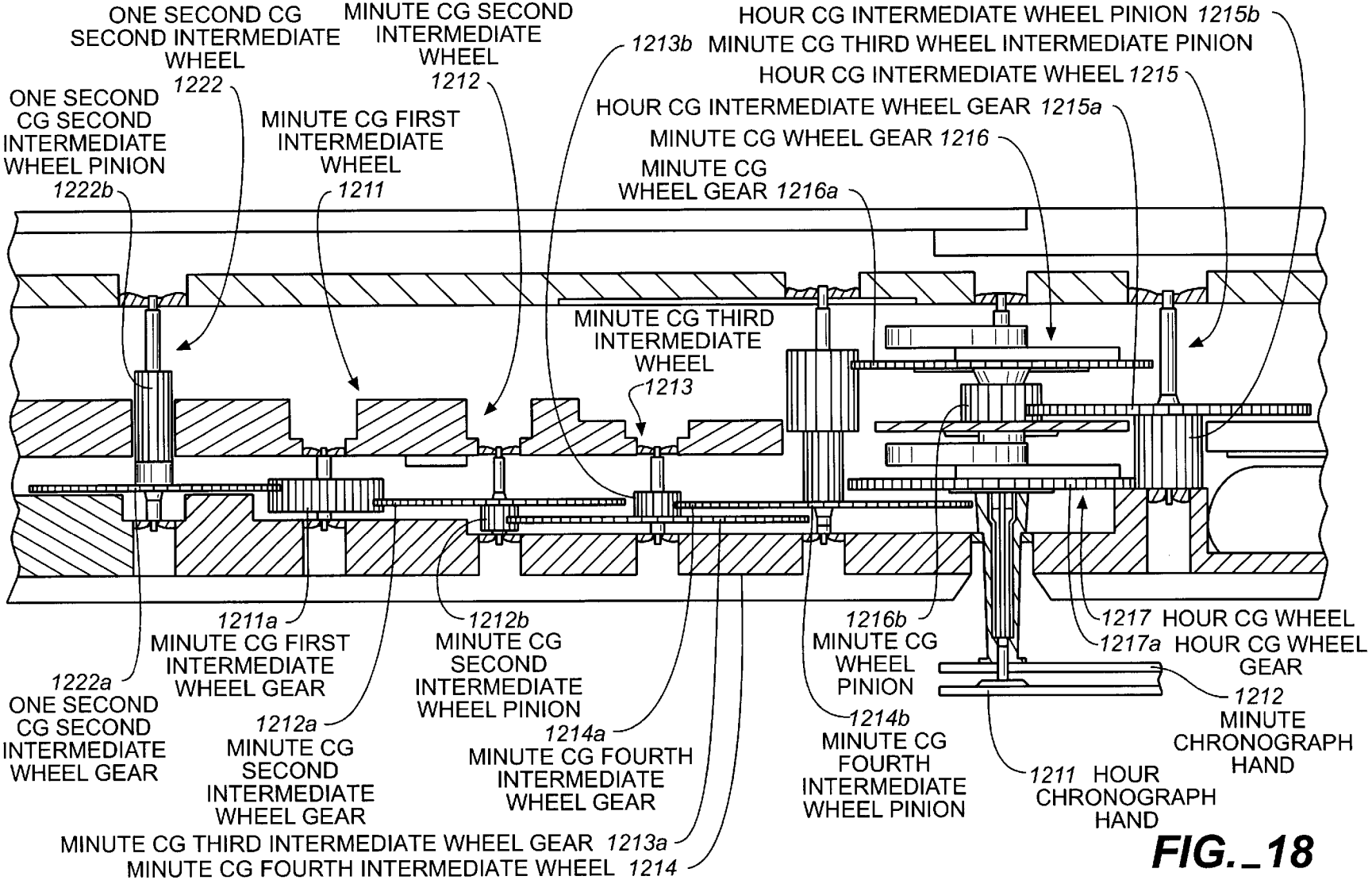
FIG. 18 is a side sectional view showing how a chronograph hour and minute display train wheel in the movement shown in FIG. 14 is engaged.

FIG. 18 is a side sectional view showing how an hour and minute display train wheel of the chronograph train wheel 1200G is engaged.

The one second CG second intermediate wheel gear 1222*a* is meshed with the minute CG first intermediate wheel gear 1211*a* which is meshed with a minute CG second intermediate wheel gear 1212*a*. Further, a minute CG second intermediate wheel pinion 1212*b* is meshed with a minute CG third intermediate wheel gear 1213*a*, and a minute CG third intermediate wheel pinion 1213*b* is meshed with a minute CG fourth intermediate wheel gear 1214*a*. Furthermore, a minute CG fourth intermediate wheel pinion 1214*b* is meshed with the minute CG wheel 1216*a*. In addition, a minute CG wheel pinion 1216*b* is meshed with an hour CG intermediate wheel gear 1215*a*, and an hour CG intermediate wheel pinion 1215*b* is meshed with an hour CG wheel gear 1217*a*. Note that, in FIGS. 15, 16 and 17, since a speed reduction ratio from the rotor 1404 to the minute CG wheel gear 1216*a* is set to 1/18000, the minute CG wheel 1216 is rotated one turn in 60 minutes and a chronograph minute can be displayed by the minute chronograph hand 1212 fitted to the extreme end of the minute CG wheel 1216. Further, since a speed reduction ratio from the minute CG wheel pinion 1216*b* to the hour CG wheel gear 1217*a* is set to 1/12, the hour CG wheel 1217 is rotated one turn in 12 hours, and a chronograph hour can be displayed by the hour chronograph hand 1211 fitted to the extreme end of the hour CG wheel 1217.

Figure 19:
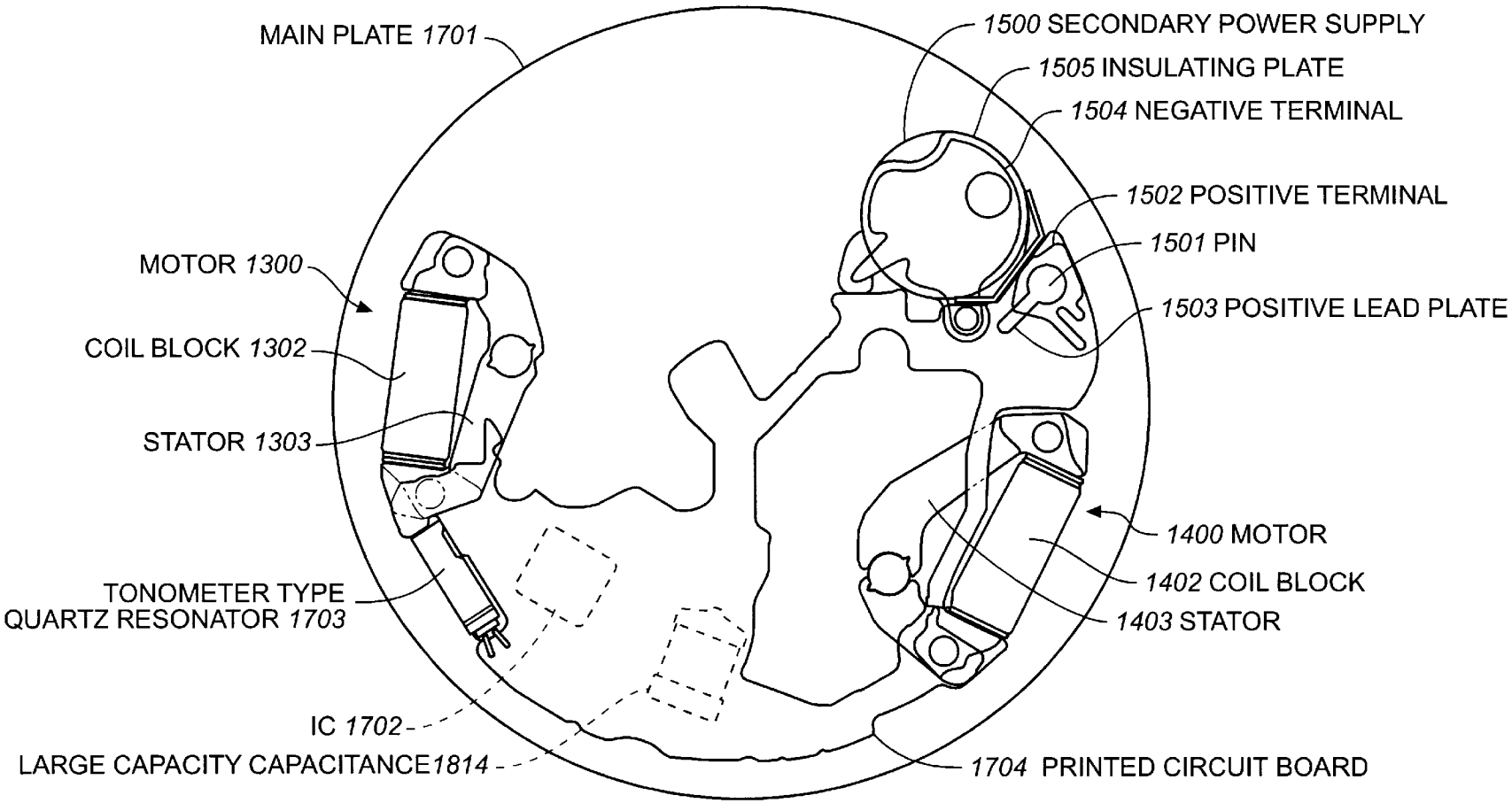
FIG. 19 is a plan view showing the circuit board constituting the first layer of the timepiece shown in FIGS. 11 and 12 when it is viewed from the backside of the timepiece.

FIG. 19 is a plan view showing the circuit board 1704 constituting the first layer of the timepiece 1000 shown in FIGS. 11 and 12 when it is viewed from the backside of the timepiece, wherein only the parts electrically connected to the circuit board 1704 are shown.

The circuit board 1704 shown in FIG. 19 is, for example, a flexible print board and disposed on the movement 1700 shown in FIG. 14. The IC 1702, the tonometer type quartz resonator 1703, the large capacity capacitance 1814 and the like are mounted on the circuit board 1704. Then, drive pulses of an ordinary time and a chronograph are generated by the IC 1702 and transmitted to the coil blocks 1302 and 1402 of the respective motors 1300 and 1400.

The positive terminal of the secondary power supply 1500 is connected to the circuit board 1704 in such a manner that the extreme end spring portion of a positive terminal 1502, which is guided by a pin 1501 fitted into the main plate 1701 composed of a metal, comes into contact with the side of the button type secondary power supply 1500 with predetermined spring force. A positive lead plate 1503 comes into contact with the extreme end of the pin 1501, and further extreme end spring portion of the positive lead plate 1503 comes into contact with the positive pattern of the circuit board 1704 with predetermined spring force. Therefore, the positive voltage is supplied through the secondary power supply 1500→the positive terminal 1502→the pin 1501→the positive lead plate 1503→the positive pattern of the circuit board 1704→the IC 1702. Further, the negative voltage of the secondary power supply 1500 is connected to the circuit board 1704 in such a manner that a spring portion, which is disposed to the outer periphery of a negative terminal 1504 welded and conducted to the end surface of the secondary power supply 1500, comes into contact with the negative pattern of the circuit board 1704 with predetermined spring force. Therefore, the negative voltage is supplied through the secondary power supply 1500→the negative terminal 1504→the negative pattern of the circuit board 1704→he IC 1702. Note that an insulating plate 1505 is mounted on the negative terminal 1504 to prevent the short-circuit of the negative terminal 1504 to the third intermediate receiving plate 2003.

Figure 20:
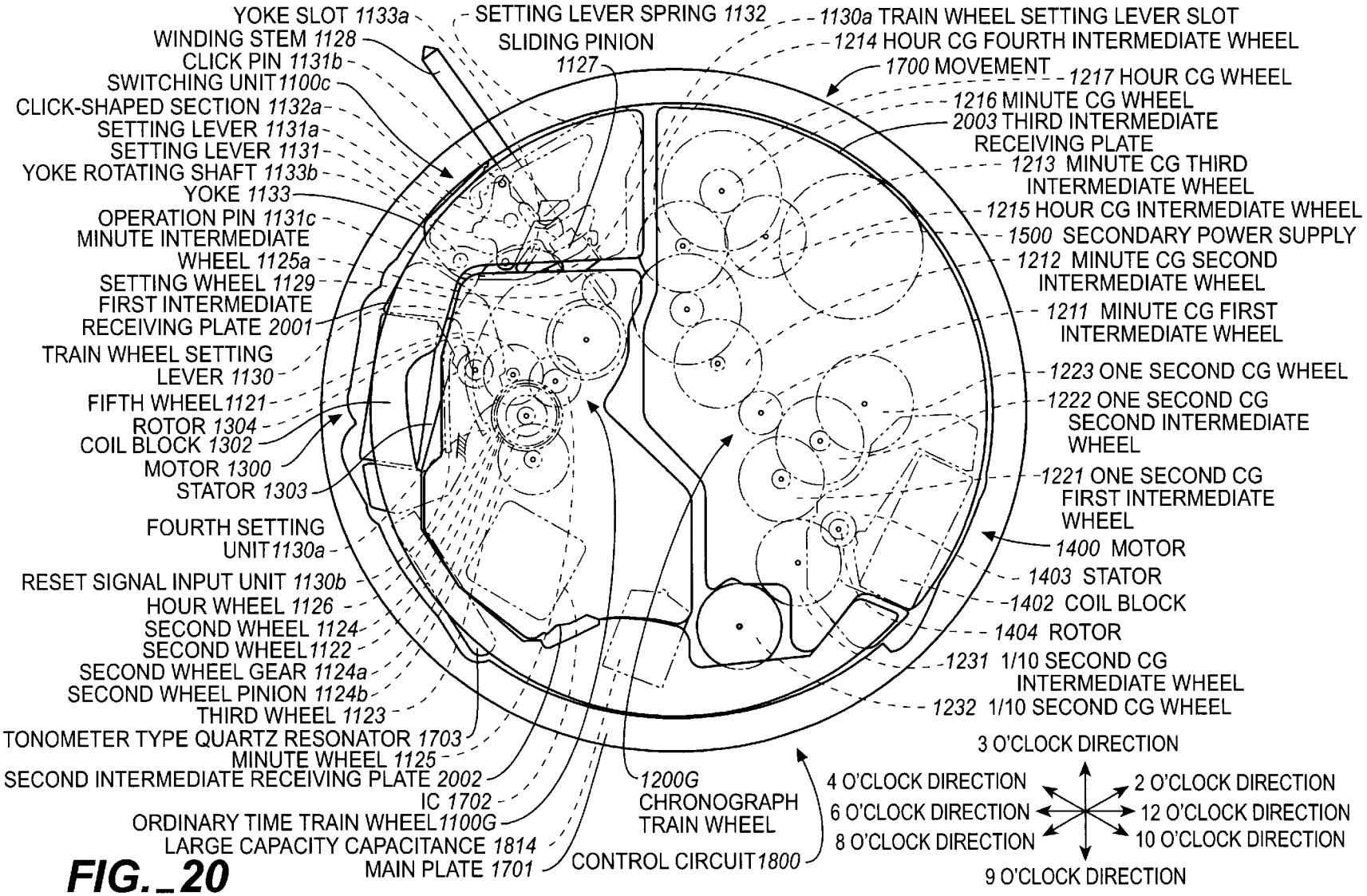
FIG. 20 is a plan view showing a first intermediate receiving plate, a second intermediate receiving plate, and a third intermediate receiving plate which divide the first layer of the timepiece shown in FIGS. 11 and 12 from a second layer.

FIG. 20 is a plan view showing the first intermediate receiving plate 2001, the second intermediate receiving plate 2002, and the third intermediate receiving plate 2003 for dividing the first layer of the timepiece 1000 shown in FIGS. 11 and 12 from the second layer viewed from the backside of the timepiece 1000.

The first intermediate receiving plate 2001, the second intermediate receiving plate 2002, and the third intermediate receiving plate 2003, which are shown in FIG. 20, are disposed on the circuit board 1704 shown in FIG. 19. The first intermediate receiving plate 2001 is disposed to the outermost side in a 6 o'clock direction side so as to cover the motor 1300, the switching unit 1100C, the tonometer type quartz resonator 1703 which constitutes the control circuit 1800, the large capacity capacitance 1814, and the like. The second intermediate receiving plate 2002 is disposed inwardly of the first intermediate receiving plate 2001 so as to cover the ordinary time train wheel 1100G, the IC 1702 which constitutes the control circuit 1800, and the like. The third intermediate receiving plate 2003 is disposed in a 12 o'clock direction side so as to cover the chronograph train wheel 1200G, the motor 1400, the secondary power supply 1500 such as the lithium ion power supply, and the like.

Next, the second layer side will be described with reference to FIG. 21 to FIG. 34. FIG. 21 is a plan view showing the power generating unit 1600 (power generating mechanism 1601), which constitutes the second layer of the timepiece shown in FIGS. 11 and 12 excluding the oscillating weight 1605, and the reset to zero mechanism 1200R when they are viewed from the backside of the timepiece 1000.

The power generating mechanism 1601 shown in FIG. 21 is disposed on the second intermediate receiving plate 2002 shown in FIG. 20, and the reset to zero mechanism 1200R is disposed on the second intermediate receiving plate 2002 and the third intermediate receiving plate 2003 shown in FIG. 20 extending therebetween.

The schematic arrangement of the power generating unit 1600 will be described here with reference to FIGS. 22 and 23.

Figure 22:
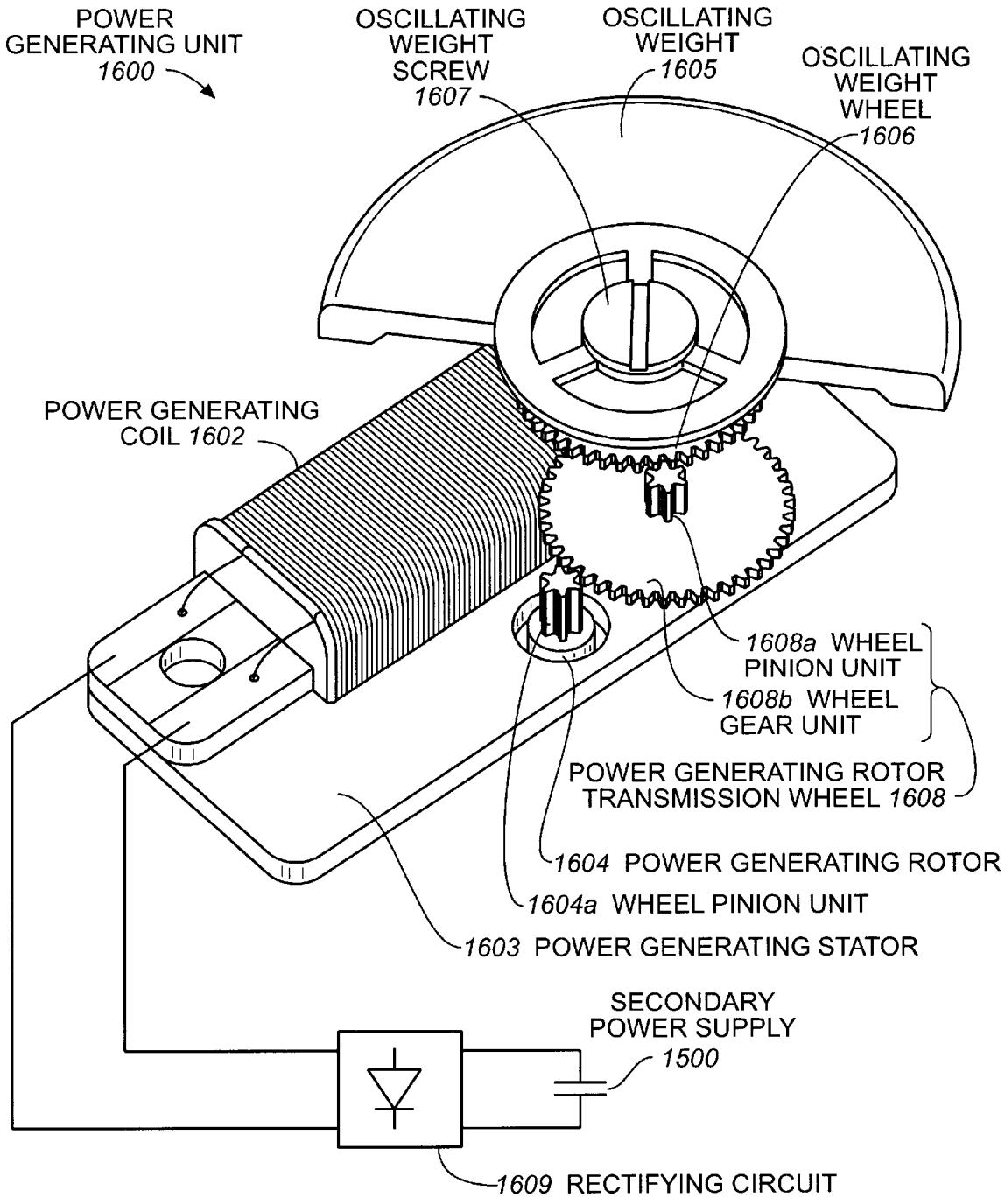
FIG. 22 is a perspective view of an example of the power generating unit shown in FIG. 21.
Figure 23:
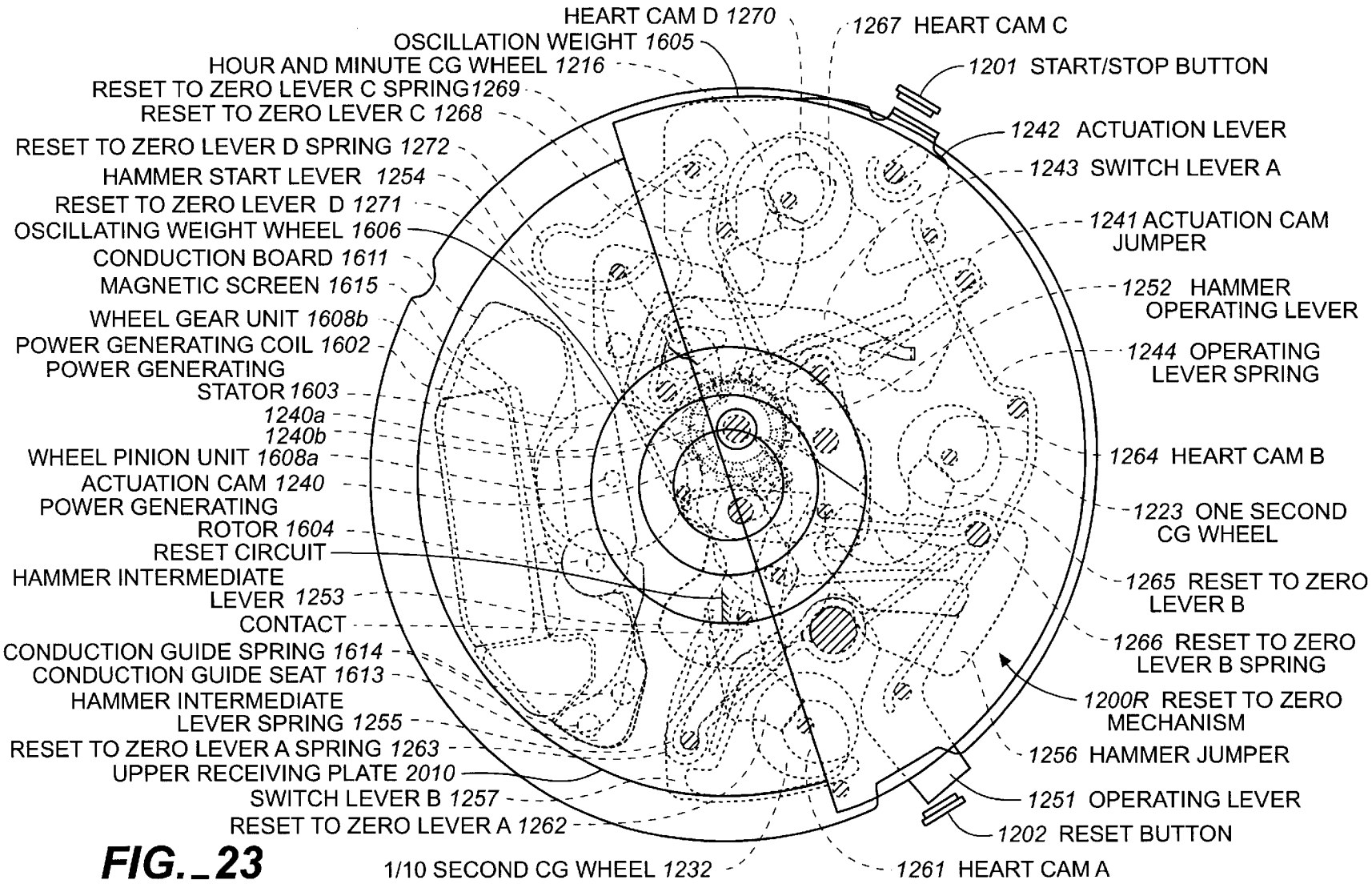
FIG. 23 is a plan view showing the oscillating weight constituting the second layer of the timepiece shown in FIGS. 11 and 12 when it is viewed from the backside of the timepiece.

The power generating unit 1600 shown in FIGS. 22 and 23 is composed of a power generating coil 1602 wound around a highly permeable material, a power generating stator 1603 composed of a highly permeable material, a power generating rotor 1604 composed of a permanent magnet and a wheel pinion unit, and a one-sided oscillating weight 1605 disposed on the upper receiving plate 2010 and the like.

The oscillating weight 1605 and the oscillating weight wheel 1606 disposed below the oscillating weight 1605 are rotatably journaled by a shaft fixed to the upper receiving plate 2010, and the removal of them in an axial direction is prevented by an oscillating weight screw 1607. The oscillating weight wheel 1606 is meshed with the wheel pinion unit 1608a of a power generating rotor transmission wheel 1608, and the gear portion 1608b of the power generating rotor transmission wheel 1608 is meshed with the wheel pinion unit 1604*a* of the power generating rotor 1604. The speed of the train wheel is increased from 30 times to about 200 times. The speed increasing ratio can be optionally set in accordance with the capability of the power generating unit the specification of the watch.

In the above arrangement, when the oscillating weight 1605 is rotated by the motion of the wrist of a user, or the like, the power generating rotor 1604 is rotated at a high speed. Since the permanent magnet is fixed to the power generating rotor 1604, the direction of magnetic flux which is obliquely across the power generating coil 1602 through the power generating stator 1603 is changed each time the power generating rotor 1604 is rotated, whereby an alternating voltage is generated to the power generating coil 1602 by electromagnetic induction. The alternating voltage is rectified by a rectifying circuit 1609 mounted on the circuit board 1704 and charged to the secondary power supply 1500.

Subsequently, the structure of the periphery of the power generating unit 1600 as another characteristic portion of the timepiece 1000 will be described with reference to FIGS. 21 and 24. In FIGS. 21 and 24, the power generating coil 1602 is connected to a conductive pattern formed on a conduction board 1611 through a lead pattern formed on a coil lead board 1610. Both the surfaces of the conduction board 1611 are held between a conductive press plate 1621 disposed on the upper receiving plate 2010 side and a conduction guide seat 1613 disposed on the second intermediate receiving plate 2002. Then, a through hole is formed from the conduction guide seat 1613 to the second intermediate receiving plate 2002, and the conduction pattern formed on the conduction board 1611 is connected to the power supply pattern formed on the circuit board 1704 through a conduction spring (compression coil spring) 1614 inserted into the through hole. Therefore, the alternating voltage is supplied from the power generating unit 1600 to the secondary power supply 1500 through the power generating coil 1602→the lead pattern of the coil lead board 1610→the conduction pattern of the conduction board 1611→the conduction spring 1614→the power supply pattern of the circuit board 1704→the secondary power supply 1500.

Since the conduction spring 1614 is compressed by being held between the conduction board 1611 and the circuit board 1704, both the ends of the conduction spring 1614 come into intimate contact with the conduction pattern of the conduction board 1611 and the power supply pattern of the circuit board 1704, whereby the reliability of conduction can be enhanced.

Further, in FIGS. 21 and 24, the power generating mechanism 1601 is covered with a magnetic screen 1615 disposed to the upper receiving plate 2010 side.

The influence of a magnetic field on the motor 1300, which is caused by power generation, can be reduced by covering the power generating mechanism 1601 with the magnetic screen 1615. Note that the same effect or a higher effect also can be achieved by covering the power generating mechanism 1601 with the magnetic screen 1615 which is disposed on the second intermediate receiving plate 2002 side or on the upper receiving plate 2010 side and the second intermediate receiving plate 2002 side.

Figure 25:
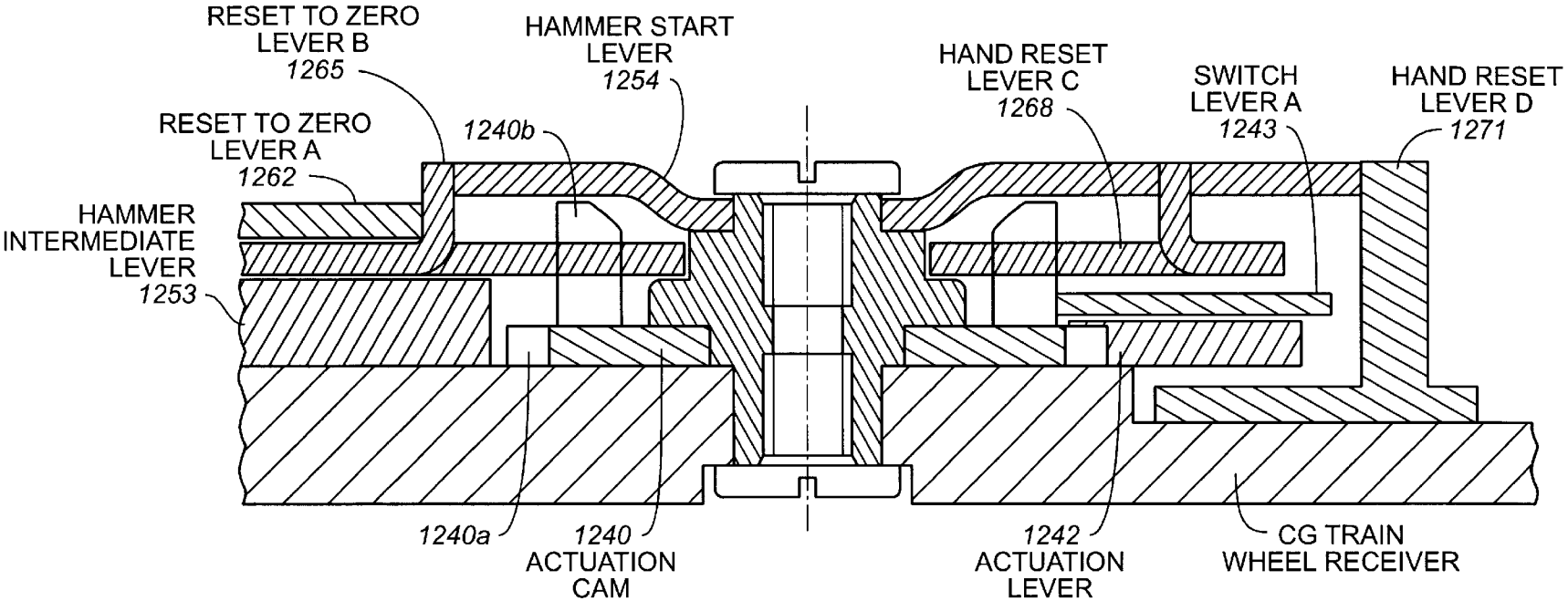
FIG. 25 is a side sectional view showing an example of the schematic arrangement of the main portion of the reset to zero mechanism shown in FIG. 21.

FIG. 25 is a side sectional view showing an example of the schematic arrangement of the main portion of the reset to zero mechanism 1200R. Note that the reset to zero mechanism 1200R shown in FIG. 21 shows a reset state, whereas the reset to zero mechanism 1200R shown in FIG. 25 shows a stop state.

In FIGS. 21 and 25, the reset to zero mechanism 1200R mechanically is started/stopped and reset by the rotation of an actuation cam 1240 which is disposed at an approximate center. The actuation cam 1240 is formed in a cylindrical shape and has teeth 1240*a* formed on the side along the periphery thereof at a predetermined pitch and columns 1240*b* formed along the periphery of an end surface thereof at a predetermined pitch. When the actuation cam 1240 is in a stationary state, the phase thereof is regulated by an actuation cam jumper 1241 which is locked between teeth 1240*a* and rotated counterclockwise by an actuation cam rotating unit 1242*d* disposed at the extreme end of an actuation lever 1242.

Figure 26:
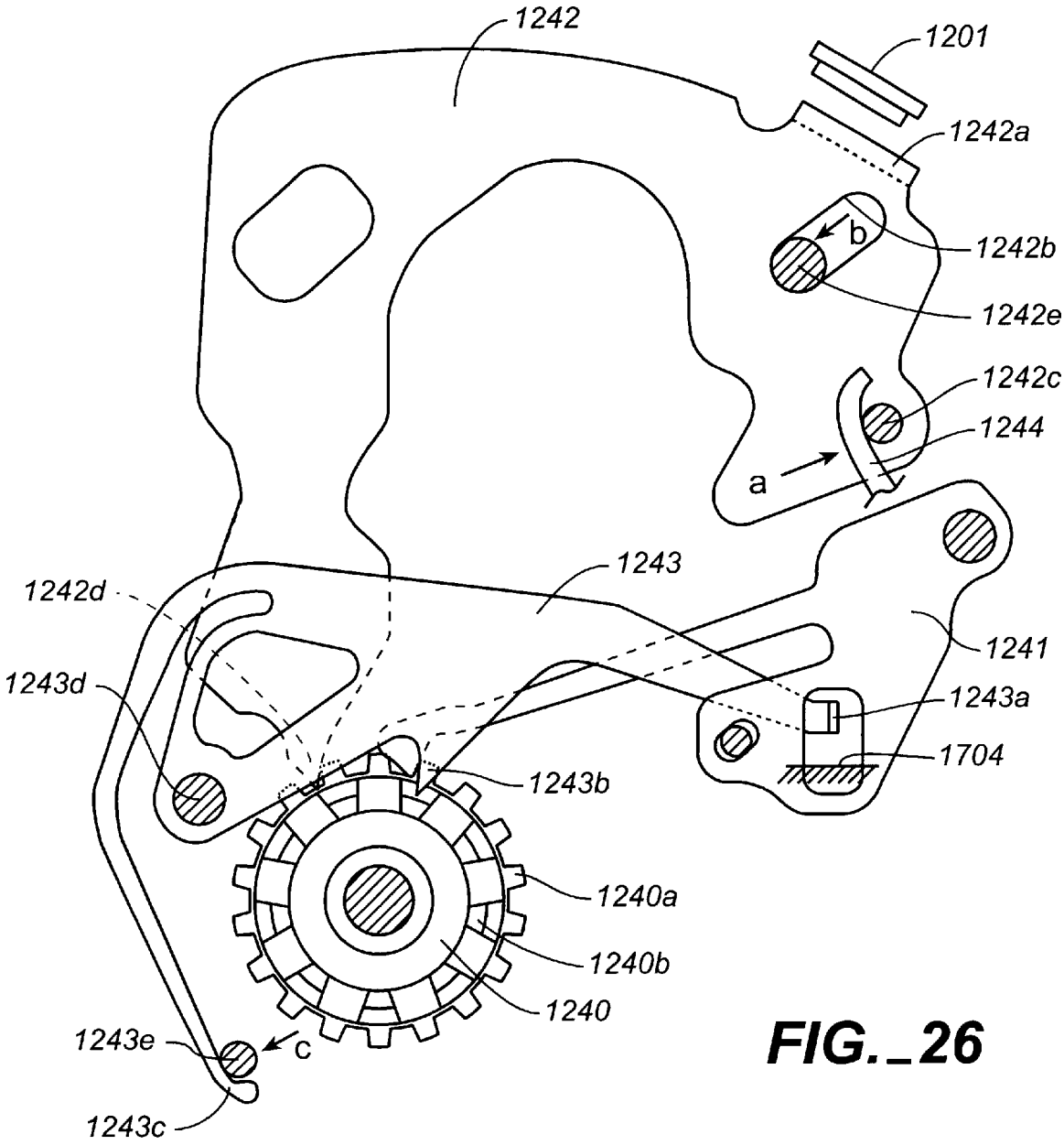
FIG. 26 is a first plan view showing an example of the operation of a start/stop actuating mechanism of the reset to zero mechanism shown in FIG. 21.

As shown in FIG. 26, a start/stop actuation mechanism is composed of an actuation lever 1242, a switch lever A 1243 and an operating lever spring 1244.

The actuation lever 1242 is formed in an approximately flat-L-shape. One end is provided with a bent press section 1242*a*, an oval through hole 1242*b* and a pin 1242*c*. The other end is provided with an acute press section 1242*d* at the extreme end thereof. The actuation lever 1242 is arranged as a start/stop actuation mechanism in such a manner that the press section 1242*a* may contact the start/stop button 1201. A pin 1242*e* fixed to the third intermediate receiving plate 2003 is inserted into the through hole 1242*b*. An end of the operating lever spring 1244 is engaged withpin 1242*c* and the press section 1242*a* is disposed in the vicinity of the actuation cam 1240.

An end of the switch lever A 1243 is arranged as a switch section 1243*a*. An approximate center thereof is provided a flat projection 1243*b* and the other end thereof is formed as a locking section 1243*c*. The switch lever A 1243 is arranged as the start/stop actuation mechanism in such a manner that the approximate center thereof is rotatably journaled by a pin 1243*d* fixed to the third intermediate receiving plate 2003. The switch section 1243*a* is disposed in the vicinity of the start circuit of the circuit board 1704. The projection 1243*b* is disposed to come into contact with columns 1240*b* disposed in the axial direction of the actuation cam 1240 and the locking section 1243*c* is engaged with a pin 1243*e* fixed to the third intermediate receiving plate 2003. That is, the switch section 1243*a* of the switch lever A 1243 is turned on by being caused to come into contact with the start circuit of the circuit board 1704. Note that the switch lever A 1243, which is electrically connected to the secondary power supply 1500 through the main plate 1701 and the like, has the same potential as that of the positive pole of the secondary power supply 1500.

An example of operation of the start/stop actuation mechanism arranged as described above will be described as to a case in which a chronograph is started with reference to FIG. 26 to FIG. 28.

As shown in FIG. 26, when the chronograph is in a stop state, the actuation lever 1242 is positioned in the state in which the press section 1242*a* is separated from the start/stop button 1201, the pin 1242*c* is pressed in the direction of an illustrated arrow a by the elastic force of the operating lever spring 1244, and an end of the through hole 1242*b* is pressed in the direction of an illustrated arrow b. At the time, the extreme end 1242*d* of the actuation lever 1242 is located between teeth 1240*a* of the actuation cam 1240.

The switch lever A 1243 is positioned in the state in which the projection 1243*b* is pushed upward by columns 1240*b* of the actuation cam 1240 so as to be against the spring force of a spring section 1243*c* disposed to the other end of the switch lever A, and the locking section 1243*c* is pressed in the direction of an illustrated arrow C by the pin 1243*e*. At the time, the switch section 1243*a* of the switch lever A 1243 is separated from the start circuit of the circuit board 1704 so that the start circuit is electrically shut off.

Figure 27:
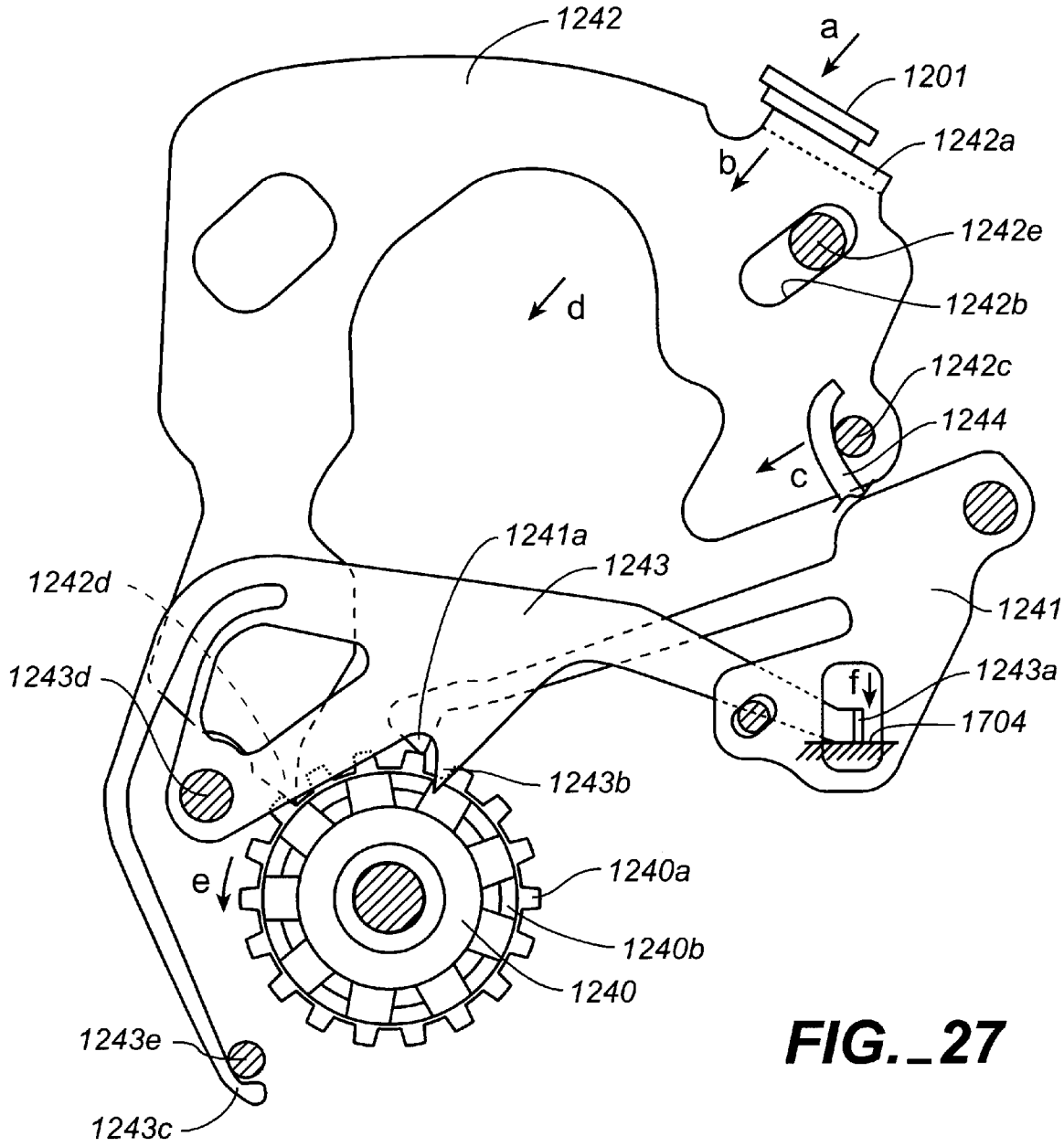
FIG. 27 is a second plan view showing an example of the operation of the start/stop actuating mechanism of the reset to zero mechanism shown in FIG. 21.

When the start/stop button 1201 is pressed in the direction of the illustrated arrow a to shift the chronograph to a start state from the above state as shown in FIG. 27, the press section 1242*a* of the actuation lever 1242 comes into contact with the start/stop button 1201 and is pressed in the direction of the illustrated arrow b, whereby the operating lever spring 1244 is pressed by the pin 1242*c* and elastically deformed in the direction of an illustrated arrow c. Therefore, the actuation lever 1242 moves in the direction of an illustrated arrow d as a whole by being guided by the through hole 1242*b* and the pin 1242*e*. At the same time, the extreme end 1242*d* of the actuation lever 1242 comes into contact with the side of a tooth 1240*a* of the actuation cam 1240 thereby causing the actuation cam 1240 to rotate in the direction of an illustrated arrow e.

At the same time, the phase of the sides of the columns 1240*b* is displaced from that of the projection 1243*b* of the switch lever A 1243 by the rotation of the actuation cam 1240, and when the displacement reaches the gap between columns 1240*b*, the projection 1243*b* is caused to come into the gap by the restoring force of the spring section 1243*c*. Therefore, the switch section 1243*a* of the switch lever A 1243 is rotated in the direction of an arrow f and comes into contact with the start circuit of the circuit board 1704 so that the start circuit is electrically conducted.

At the time, the extreme end 1241*a* of the actuation cam jumper 1241 is pushed upward by a tooth 1240*a* of the actuation cam 1240.

Then, the above operation is continued until the tooth 1240*a* of the actuation lever 1242 is advanced one pitch.

Figure 28:
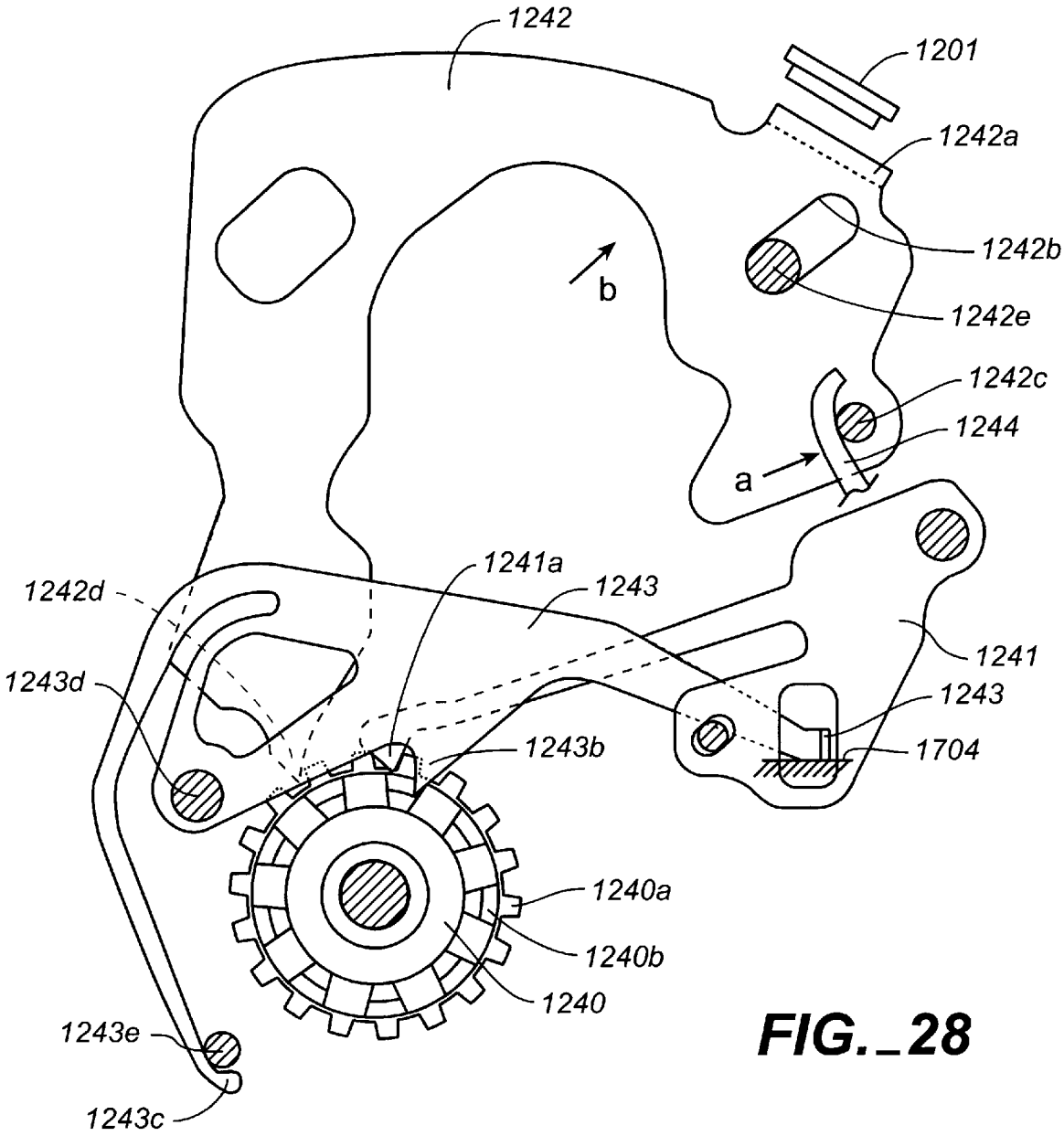
FIG. 28 is a third plan view showing an example of the operation of the start/stop actuating mechanism of the reset to zero mechanism shown in FIG. 21.

Thereafter, when a hand is released from the start/stop button 1201, it is automatically returned to its original state by a spring contained therein as shown in FIG. 28. Then, the pin 1242*c* of the actuation lever 1242 is pressed in the direction of the illustrated arrow a by the restoring force of the operating lever spring 1244. Accordingly, the actuation lever 1242 is moved as a whole in the direction of the illustrated arrow b by being guided by the through hole 1242*b* and the pin 1242*e* until an end of the through hole 1242*b* comes into contact with the pin 1242*e* and is returned to a position similar to that shown in FIG. 26.

Since the projection 1243*b* of the switch lever A 1243 remains between columns 1240*b* of the actuation cam 1240 at the time, the switch section 1243*a* is in contact with the start circuit of the circuit board 1704, and thus the electric conductive state of the start circuit is maintained. Therefore, the chronograph is maintained in the start state.

At the same time, the extreme end 1241*a* of the actuation cam jumper 1241 enters between teeth 1240*a* of the actuation cam 1240 to thereby regulate the reverse rotation of the actuation cam 1240.

On the other hand, when the chronograph is to be stopped, operation similar to the above start operation is carried out so that the state shown in FIG. 26 is finally restored.

As described above, the actuation cam 1240 is rotated by swinging the actuation lever 1242 by pushing the start/stop button 1201, whereby the start/stop of the chronograph can be controlled by swinging the switch lever A 1243.

As shown in FIG. 21, a reset actuation mechanism comprises the actuation cam 1240, an operating lever 1251, a hammer operating lever 1252, a hammer intermediate lever 1253, a hammer start lever 1254, the operating lever spring 1244, a hammer intermediate lever spring 1255, a hammer jumper 1256, and a switch lever B 1257. Further, the reset actuation mechanism comprises a heart cam A 1261, a reset to zero lever A 1262, a reset to zero lever A spring 1263, a heart cam B 1264, a reset to zero lever B 1265, a reset to zero lever B spring 1266, a heart cam C 1267, a reset to zero lever C 1268, a reset to zero lever C spring 1269, a heart cam D 1270, a reset to zero lever D 1271, and a reset to zero lever D spring 1272.

The chronograph reset actuation mechanism is arranged such that it is not actuated when the chronograph is in the start state and actuated when chronograph is set to the stop state. The mechanism is called a safety mechanism. First, the operating lever 1251, the hammer operating lever 1252, the hammer intermediate lever 1253, the operating lever spring 1244, the hammer intermediate lever spring 1255, and the hammer jumper 1256, which constitute the safety mechanism, will be described with reference to FIG. 29. Note that the hammer intermediate lever spring 1255 and the hammer jumper 1256 are omitted in the figure.

The operating lever 1251 is formed in an approximately flat-Y-shape, and has a press section 1251*a* at an end and an oval through hole 1251*b* at an end of a fork, and a pin 1251*c* is interposed between the press section 1251*a* and the through hole 1251*b*. The operating lever 1251 is arranged as the reset actuation mechanism in such a manner that the press section 1251*a* is caused to be in contact with the reset button 1202. The pin 1252*c* of the hammer operating lever 1252 is inserted into the through hole 1215*b*. The other end of the fork is rotatably journaled by a pin 1251*d* fixed to the movement side and the other end of the operating lever spring 1244 is locked to the pin 1251*c*.

The hammer operating lever 1252 is arranged such that a first hammer operating lever 1252*a* of an approximately rectangular flat-plate-shape overlaps a second hammer operating lever 1252 and they are journaled by a rotatable shaft 1252*g* at an approximate center thereof each other so as to rotate each other. The pin 1252*c* is disposed at an end of the first hammer operating lever 1252*a*, and press sections 1252*d* and 1252*e* are formed at both the ends of the second hammer operating lever 1252*b*, respectively. The hammer operating lever 1252 is arranged as the reset actuation mechanism in such a manner that the pin 1252*c* is inserted into the through hole 1251*b* of the operating lever 1251, the other end of the first hammer operating lever 1252*a* is rotatably journaled by a pin 1252*f* fixed to the third intermediate receiving plate 2003. Further, the press section 1252*d* is caused to be in contact with the press section 1253*c* of the hammer intermediate lever 1253, and the press section 1252*e* is disposed in the vicinity of the actuation cam 1240.

The hammer intermediate lever 1253 is formed in an approximately rectangular flat shape, has pins 1253*a* and 1253*b* disposed at an end and an intermediate section, respectively. In addition, one of the corner portions of the other end of the hammer intermediate lever 1253 is formed as the press section 1253*c*. The hammer intermediate lever 1253 is arranged as the reset actuation mechanism in such a manner that an end of the hammer intermediate lever spring 1255 is engaged to the pin 1253*a*, an end of the hammer jumper 1256 is engaged to the pin 1253*b*, the press section 1253*c* is in contact with the press section 1252*d* of the second hammer operating lever 1252*b*, and the other corner portion of the other end is rotatably journaled by a pin 1253*d* fixed to the third intermediate receiving plate 2003.

An example of operation of the safety mechanism arranged as described above will be described with reference to FIG. 29 to FIG. 32.

Figure 29:
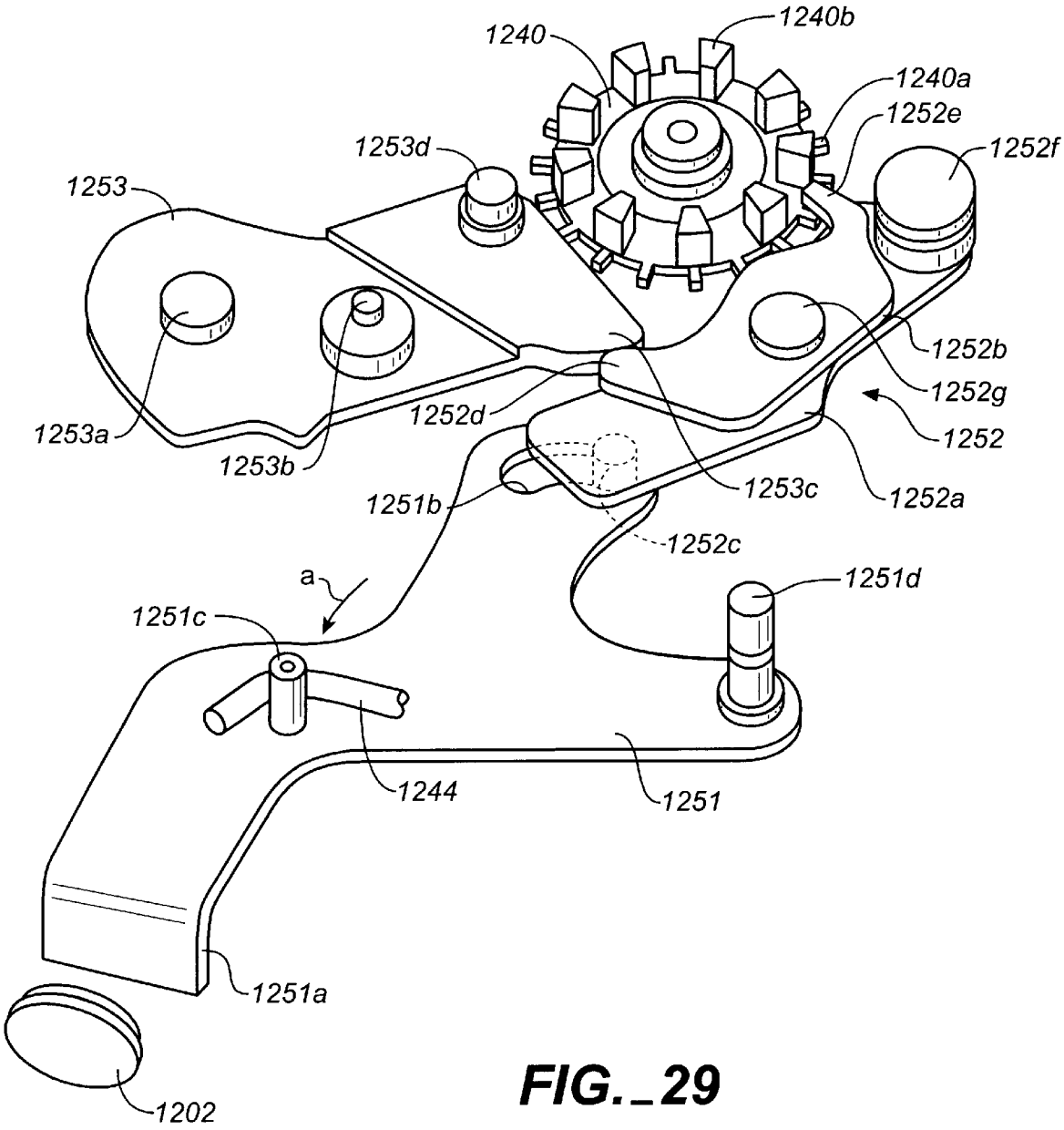
FIG. 29 is a first plan view showing an example of the operation of the safety mechanism of the reset to zero mechanism shown in FIG. 21.

When the chronograph is in the start state, the operating lever 1251 is positioned in the state in which the press section 1251*a* is separated from the reset button 1202 and the pin 1251*c* is pressed in the direction of an illustrated arrow a by the elastic force of the operating lever spring 1244 as shown in FIG. 29. In this position, the press section 1252*e* of the second hammer operating lever 1252*b* is located outwardly of the gap between columns 1240*b* of the actuation cam 1240.

Figure 30:
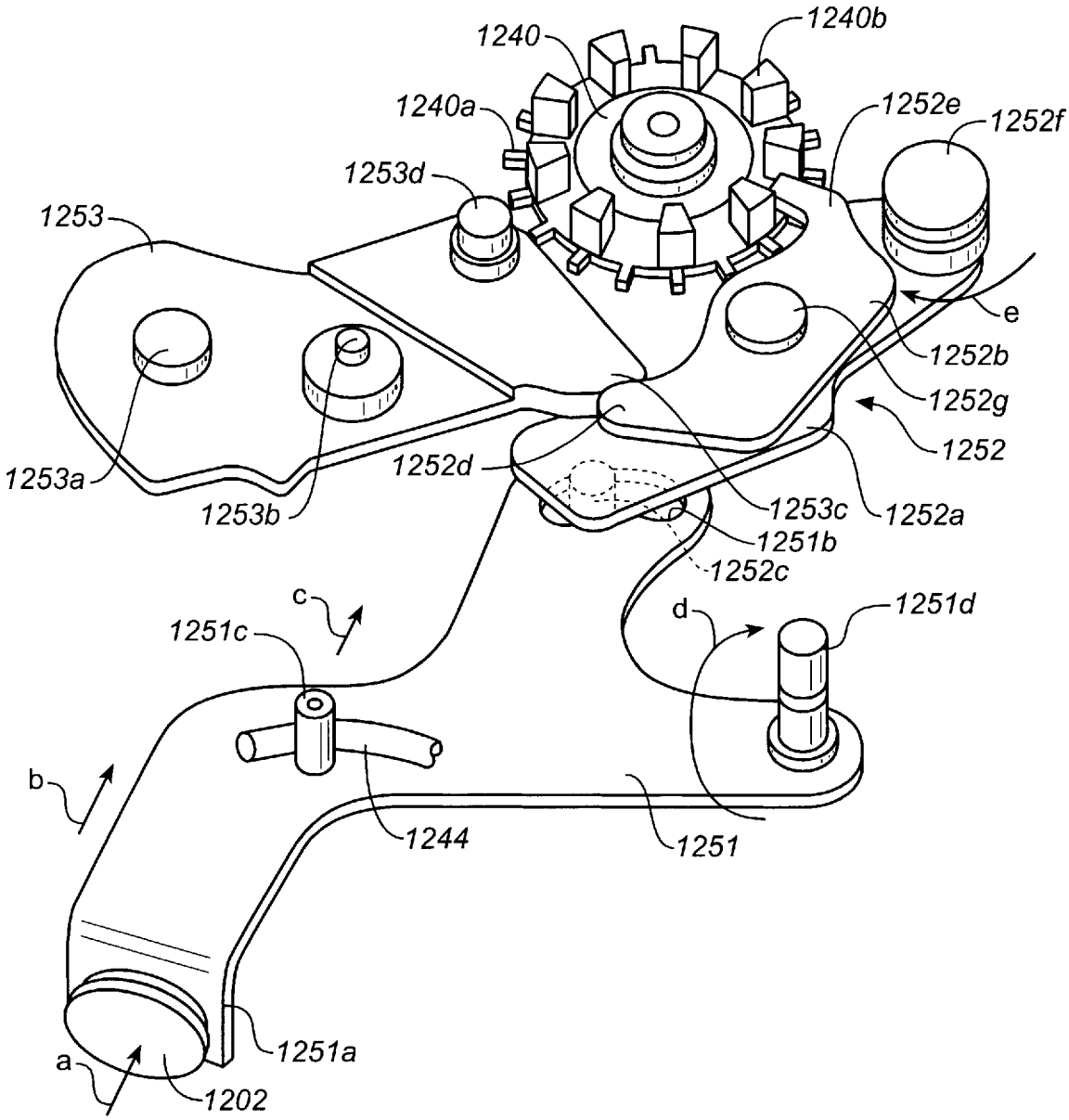
FIG. 30 is a second perspective view showing an example of the operation of the safety mechanism of the reset to zero mechanism shown in FIG. 21.

When the reset button 1202 is pressed in the direction of the illustrated arrow a in this state as shown in FIG. 30, the press section 1251*a* of the operating lever 1251 comes into contact with the reset button 1202 and is pressed in the direction of an arrow b, whereby the pin 1251*c* presses the operating lever spring 1244 thereby elastically deforming it in the direction of an arrow c. Therefore, the actuation lever 1251 is rotated as a whole in the direction of an illustrated arrow d about the pin 1251*d*. Since the pin 1252*c* of the first hammer operating lever 1252*a* is moved along the through hole 1251*b* of the operating lever 1251 by the rotation, the first hammer operating lever 1252*a* is rotated in the direction of an illustrated arrow e about the pin 1252*f*.

In this position, since the press section 1252*e* of the second hammer operating lever 1252*b* enters the gap between the columns 1240*b*, even if the press section 1252*d* comes into contact with the press section 1253*c* of the hammer intermediate lever 1253, the second hammer operating lever 1252*b* is rotated about the shaft 1252*g* so that stroke is absorbed. Thus, the press section 1253*c* is not pressed by the press section 1252*d*. Accordingly, the manipulating force of the reset button 1202 is interrupted by the hammer operating lever 1252 and is not transmitted to the reset actuation mechanism located rearward of the hammer intermediate lever 1253 to be described later. Therefore, even if the reset button 1202 is erroneously pressed when the chronograph is in the start state, the chronograph is prevented from being reset.

Figure 31:
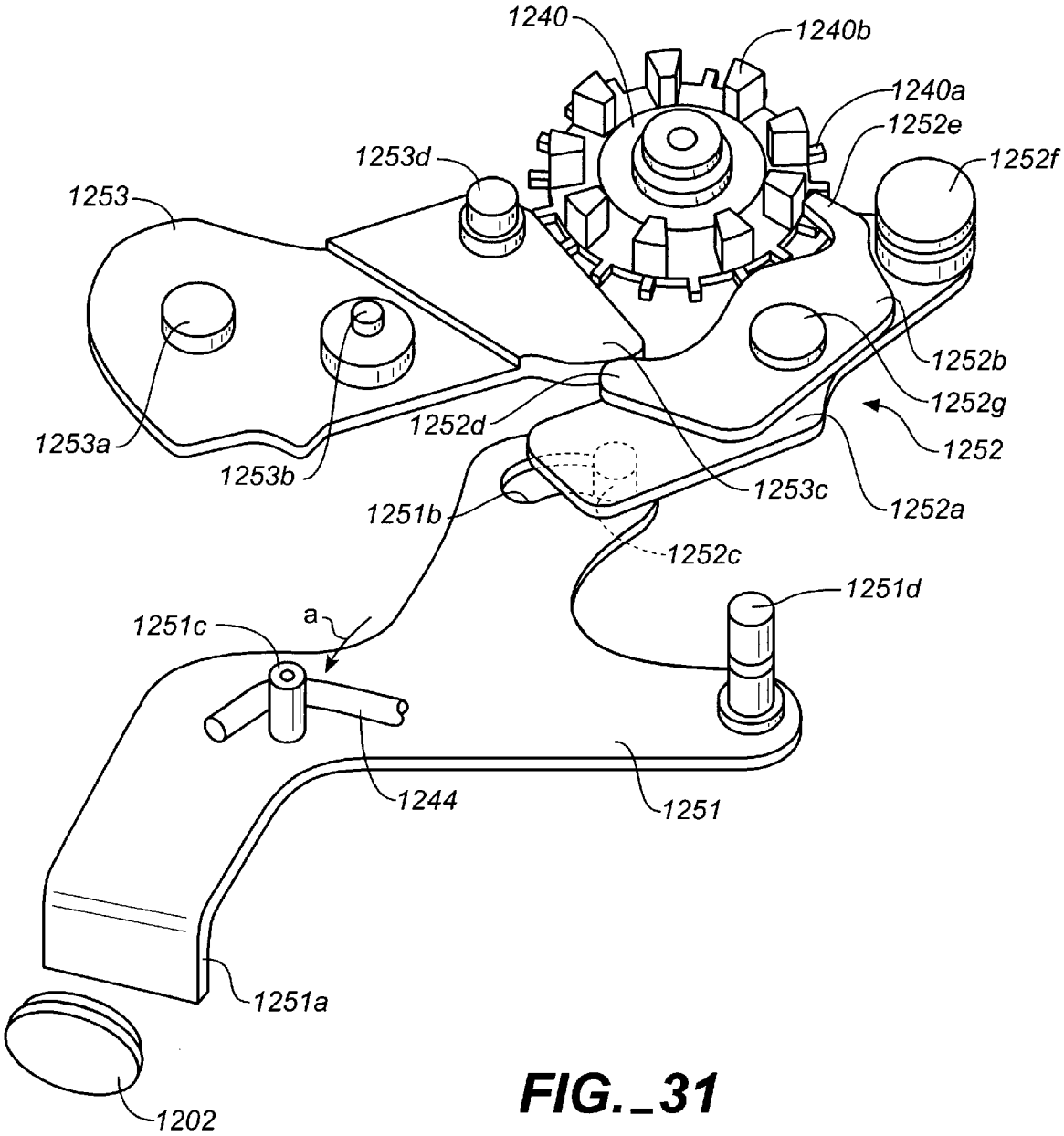
FIG. 31 is a third perspective view showing an example of the operation of the safety mechanism of the reset to zero mechanism shown in FIG. 21.

In contrast, when the chronograph is in the stop state, the operating lever 1251 is positioned in the state in which the press section 1251*a* is separated from the reset button 1202 and the pin 1251*c* is pressed in the direction of an illustrated arrow a by the elastic force of the operating lever spring 1244 as shown in FIG. 31. At the time, the press section 1252*e* of the second hammer operating lever 1252*b* is in contact with the side of a column 1240*b* of the actuation cam 1240.

Figure 32:
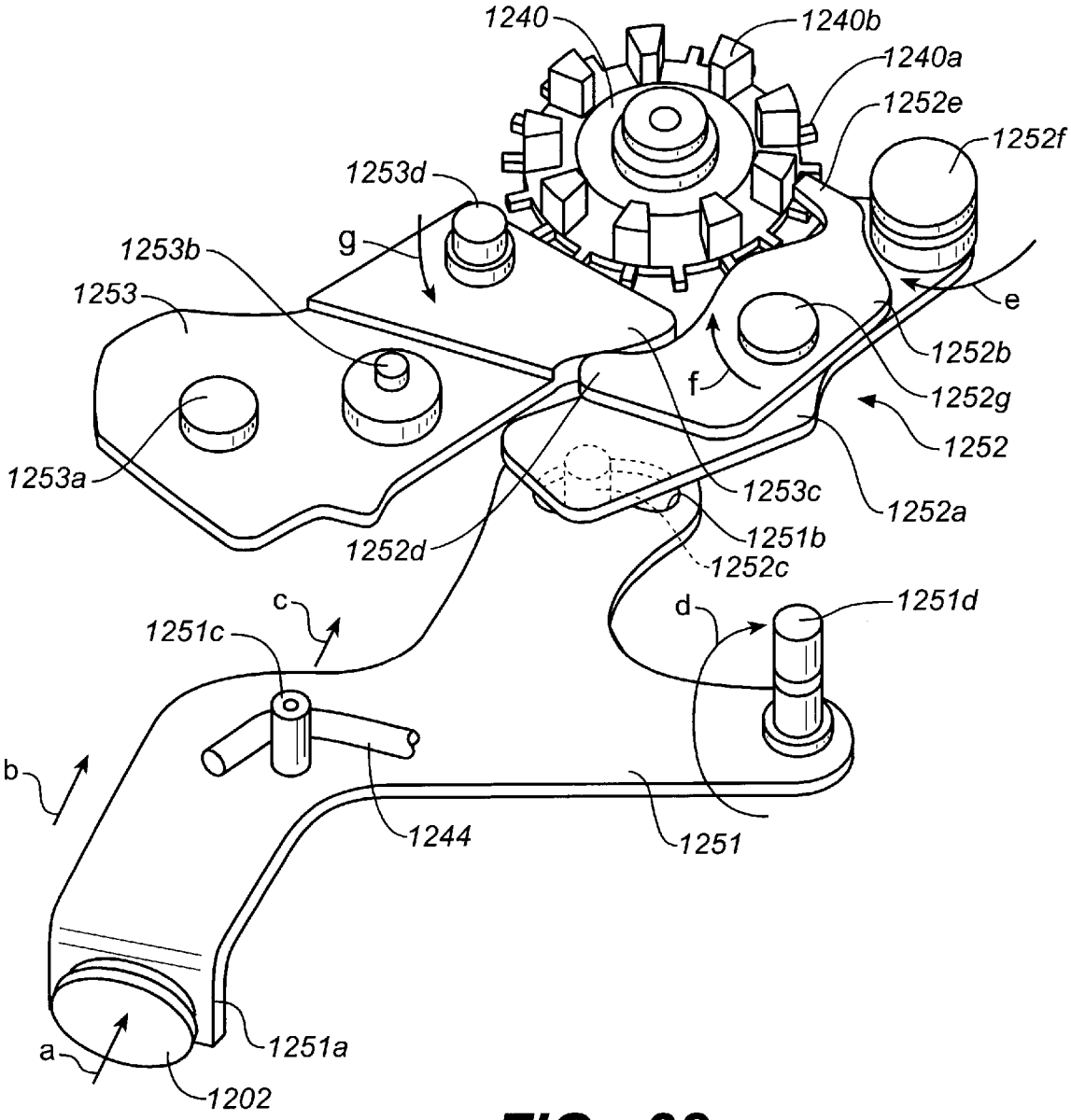
FIG. 32 is a fourth perspective view showing an example of the operation of the safety mechanism of the reset to zero mechanism shown in FIG. 21.

When the reset button 1202 is pressed with a hand in the direction of an illustrated arrow a in this state as shown in FIG. 32, the press section 1251*a* of the operating lever 1251 comes into contact with the reset button 1202 and pressed in the direction of an arrow b, whereby the pin 1251*c* presses the operating lever spring 1244 and elastically deforms it in the direction of an arrow c. Therefore, the actuation lever 1251 is rotated as a whole in the direction of an illustrated arrow d about the pin 1251*d*. Since the pin 1252*c* of the first hammer operating lever 1252*a* is moved along the through hole 1251*b* by the rotation, the first hammer operating lever 1252*a* is rotated in the direction of an illustrated arrow e about the pin 1252*f*.

In this position, since the press section 1252*e* of the second hammer operating lever 1252*b* is stopped by the side of a column 1240*b* of the actuation cam 1240, the second hammer operating lever 1252*b* is rotated in the direction of the illustrated arrow f about the shaft 1252*g*. Since the rotation causes the press section 1252*d* of the second hammer operating lever 1252*b* to come into contact with the press section 1253*c* and pushing against it, the hammer intermediate lever 1253 is rotated in the direction of an illustrated arrow g about the pin 1253*d*. Therefore, since the manipulating force of the reset button 1202 is transmitted to the reset actuation mechanism located rearward of the hammer intermediate lever 1253 to be described later, the chronograph can be reset by pressing the reset button 1202 when it is in the stop state. Note that when the chronograph is reset, switch lever B 1257 comes into contact with the reset circuit of the circuit board 1704, whereby the chronograph is electrically rest.

Figure 33:
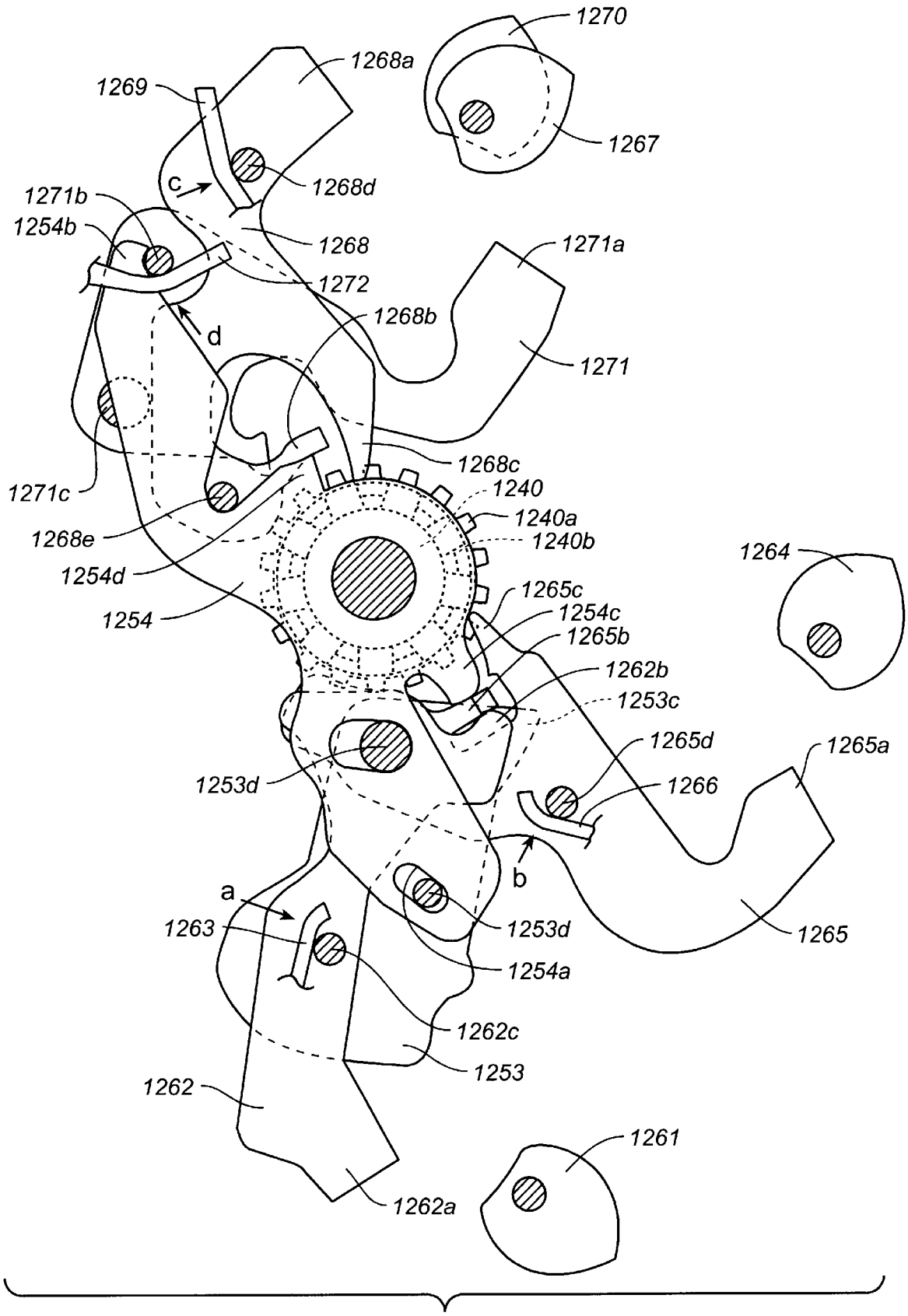
FIG. 33 is a first plan view showing an example of the operation of the main mechanism of the reset actuating mechanism of the reset to zero mechanism shown in FIG. 21.
Figure 34:
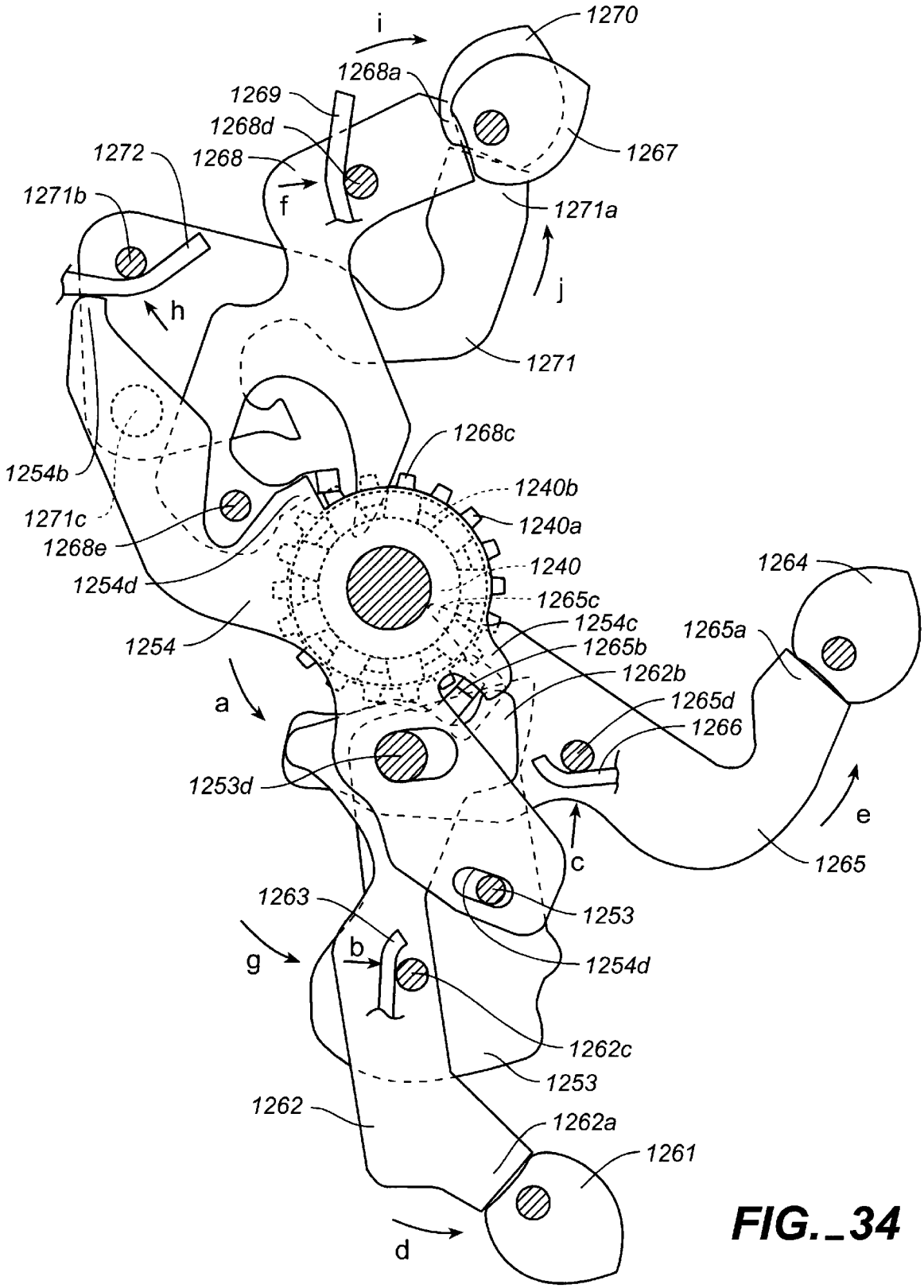
FIG. 34 is a second plan view showing an example of the operation of the main mechanism of the reset actuating mechanism of the reset to zero mechanism shown in FIG. 21.

Next, description will be made with reference to FIG. 33 as to the hammer start lever 1254, the heart cam A 1261, the reset to zero lever A 1262, the reset to zero lever A spring 1263, the heart cam B 1264, the reset to zero lever B 1265, the reset to zero lever B spring 1266, the heart cam C 1267, the reset to zero lever C 1268, the reset to zero lever C spring 1269, the heart cam D 1270, the reset to zero lever D 1271, and the reset to zero lever D spring 1272 which constitute the main mechanisms of the chronograph reset actuation mechanism shown in FIG. 21.

The hammer start lever 1254 is formed in an approximate flat-I-shape and has an end at which an oval through hole 1254*a* is formed and the other end at which a lever D suppressing section 1254*b* is formed. Further, the hammer start lever 1254 has a lever B suppressing section 1254*c* and a lever C suppressing section 1254*d* formed at the center thereof. The hammer start lever 1254 is arranged as the reset actuation mechanism in such a manner that the central portion thereof is rotatably fixed and the pin 1253*b* of the hammer intermediate lever 1253 is inserted into the through hole 1254*a*.

The heart cams A 1261, B 1264, C 1267, and D 1270 are fixed to the respective rotating shafts of the 1/10 second CG wheel 1232, the one second CG wheel 1223, the minute CG wheel 1216, and the hour CG wheel 1217, respectively.

An end of the reset to zero lever A 1262 is formed as a hammer unit 1262*a* for striking the heart cam A 1261. The other end thereof is provided with a rotation regulating section 1262*b* formed thereon, and the central portion is provided with a pin 1262*c*. The reset to zero lever A 1262 is arranged as the reset actuation mechanism in such a manner that the other end thereof is rotatably journaled by the pin 1253*d* fixed to the third intermediate receiving plate 2003 and an end of the reset to zero lever A spring 1263 is engaged against the pin 1262*c*.

An end of the reset to zero lever B 1265 is formed as a hammer unit 1265*a* for striking the heart cam B 1264. The other end thereof is provided with a rotation regulating section 1265*b* and a press section 1265*c* and the central portion thereof is provided with a pin 1265*d*. The reset to zero lever B 1265 is arranged as the reset actuation mechanism in such a manner that the other end thereof is rotatably journaled by the pin 1253*d* fixed to the third intermediate receiving plate 2003 and an end of the reset to zero lever B spring 1266 is engaged against the pin 1265*d*.

An end of the reset to zero lever C 1268 is formed as a hammer unit 1268*a* for striking the heart cam C 1267. The other end thereof is provided with a rotation regulating section 1268*b* and a press section 1268*c*, and the central portion thereof is provided with a pin 1268*d*. The reset to zero lever B C1268 is arranged as the reset actuation mechanism in such a manner that the other end thereof is rotatably journaled by a pin 1268*e* fixed to the third intermediate receiving plate 2003 and an end of the reset to zero lever C spring 1269 is engaged against the pin 1268*d*.

An end of the reset to zero lever D 1271 is formed as a hammer unit 1271*a* for striking the heart cam D 1270, and the other end thereof is provided with a pin 1271*b*. The reset to zero lever D 1271 is arranged as the reset actuation mechanism in such a manner that the other end thereof is rotatably journaled by a pin 1271*c* fixed to the third intermediate receiving plate 2003 and an end of the reset to zero lever D spring 1272 is engaged against the pin 1271*b*.

An example of operation of the reset actuation mechanism arranged as described above will be described with reference to FIGS. 33 and 34.

When the chronograph is in the stop state, the reset to zero lever A 1262 is positioned such that the rotation regulating section 1262*b* is engaged against the rotation regulating section 1265*b* of the reset to zero lever B 1265. The pin 1262*c* is pushed in the direction of an illustrated arrow a by the elastic force of the reset to zero lever A spring 1263 as shown in FIG. 33.

The reset to zero lever B 1265 is positioned such that the rotation regulating section 1265*b* is abutted against the lever B suppressing section 1254*c* of the hammer start lever 1254. The press section 1265*c* is pushed against the side of a column 1240*b* of the actuation cam 1240, and the pin 1265*d* is pushed in the direction of an illustrated arrow b by the elastic force of the reset to zero lever B spring 1266.

The reset to zero lever C 1268 is positioned such that the rotation regulating section 1268*b* is engaged against the lever C suppressing section 1254*d* of the hammer start lever 1254. The press section 1268*c* is pushed against the side of a column 1240*b* of the actuation cam 1240, and the pin 1268*d* is pushed in the direction of an illustrated arrow c by the elastic force of the reset to zero lever B spring 1269.

The reset to zero lever D 1271 is positioned such that the pin 1271*b* is engaged against the lever D suppressing section 1254*b* of the hammer start lever 1254 and pushed in the direction of an illustrated arrow d by the elastic force of the reset to zero lever D spring 1272.

Therefore, the respective hammer units 1262*a*, 1265*a*, 1268*a*, and 1271*a* of the reset to zero levers A 1262, B 1265, C 1268, and D 1271 are positioned by being spaced apart from the respective heart cams A 1261, B 1264, C 1267, and D 1270 a predetermined distance.

When the hammer intermediate lever 1253 is rotated in the direction of the illustrated arrow g about the pin 1253*d* in this state as shown in FIG. 32, since the pin 1253*b* of the hammer intermediate lever 1253 is moved in the through hole 1254*a* of the hammer start lever 1254 while pressing the through hole 1254*a*, the hammer start lever 1254 is rotated in the direction of the illustrated arrow a.

Thus, the rotation regulating section 1265*b* of the reset to zero lever B 1265 is removed from the lever B suppressing section 1254*c* of the hammer start lever 1254, and the press section 1265*c* of the reset to zero lever B 1265 enters the gap between columns 1240*b* of the actuation cam 1240. With this operation, the pin 1265*d* of the reset to zero lever B 1265 is pressed in the direction of the illustrated arrow c by the restoring force of the reset to zero lever B spring 1266. At the same time, the regulation of the rotation regulating section 1262*b* is released and the pin 1262*c* of the reset to zero lever A 1262 is pressed in the direction of the illustrated arrow b by the restoring force of the reset to zero lever A spring 1263. Therefore, the reset to zero lever A 1262 and the reset to zero lever B 1265 are rotated in the directions of illustrated arrows d and e about the pin 1253*d*, and the respective hammer units 1262*a* and 1265*a* strike the respective heart cams A 1261 and B 1264 and rotate them, and reset the 1/10 second chronograph hand 1231 and the one second chronograph hand 1221 to zero, respectively.

At the same time, the rotation regulating section 1268*b* of the reset to zero lever C 1268 is removed from the lever C suppressing section 1254*d* of the hammer start lever 1254, the press section 1268*c* of the reset to zero lever C 1268 enters the gap between columns 1240*b* of the actuation cam 1240, and the pin 1268*d* of the reset to zero lever C 1268 is pressed in the direction of an illustrated arrow f by the restoring force of the reset to zero lever C spring 1269. Further, the pin 1271*b* of the reset to zero lever D 1271 is removed from the lever D suppressing section 1254*b* of the hammer start lever 1254. With this operation, the pin 1271*b* of the reset to zero lever D 1271 is pressed in the direction of an illustrated arrow h by the restoring force of the reset to zero lever D spring 1272. Therefore, the reset to zero lever C 1268 and the reset to zero lever D 1271 are rotated in the directions of illustrated arrows i and j about the pin 1268*e* and the pin 1271*c*, the respective hammer units 1268*a* and 1271*a* strike and rotate the heart cams C 1267 and D 1270 and reset the 1/10 second chronograph hand 1231 and the one second chronograph hand 1221 to zero, respectively.

Figure 35:
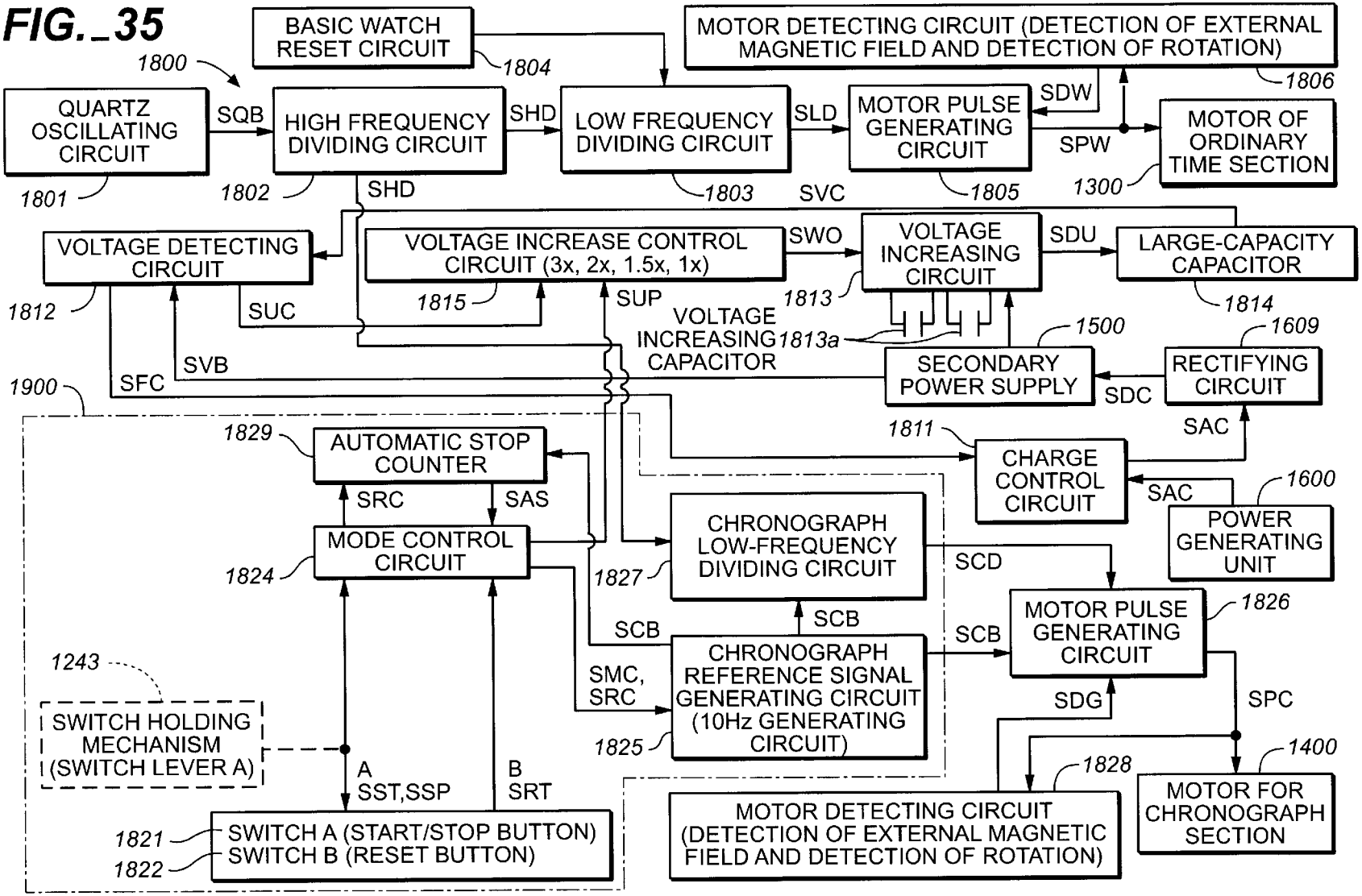
FIG. 35 is a schematic block diagram showing an example of the arrangement of a control circuit used in the timepiece of FIG. 11.

With a series of the above operation, when the chronograph is in the stop state, the chronograph can be reset by pressing the reset button 1202. FIG. 35 is a schematic block diagram showing an example of the arrangement of the system as a whole excluding the mechanical portion of the timepiece 1000 of FIG. 11.

A signal SQB having an oscillating frequency of, for example, 32 kHz, which is output from a quartz oscillating circuit 1801 including the tonometer type quartz resonator 1703, is input to a high frequency dividing circuit 1802 and divided to frequencies from 16 kHz to 128 Hz. A signal SHD divided by the frequency dividing circuit 1802 is input to a low frequency dividing circuit 1803 and divided to frequencies from 64 Hz to 1/80 Hz. Note that the frequency generated by the low frequency dividing circuit 1803 can be reset by a basic watch reset circuit 1804 connected to the low frequency dividing circuit 1803.

A signal SLD divided by the low frequency dividing circuit 1803 is input to a motor pulse generating circuit 1805 as a timing signal, and when the divided signal SLD is made active at, for example, each 1 second or 1/10 second, pulses for driving a motor and pulses SPW for detecting the rotation and the like of the motor are created. The motor drive pulses SPW created by the motor pulse generating circuit 1805 are supplied to the motor 1300 of the ordinary time measuring section 1100 so as to drive the motor. Further, the pulses SPW for detecting the rotation of the motor and the like are supplied to a motor detecting circuit 1806 at a timing different from that of the above pulses so that the external magnetic field of the motor 1300 and the rotation of the rotor of the motor 1300 are detected. Then, the external magnetic field detecting signal and the rotation detecting signal SDW detected by the motor detecting circuit 1806 are fed back to the motor pulse generating circuit 1805.

The alternating voltage SAC generated by the power generating unit 1600 is input to the rectifying circuit 1609 through a charge control circuit 1811, subjected to, for example, half-wave rectification, made to a direct current voltage SDC and charged in the secondary power supply 1500. The voltage SVB across both the ends of the secondary power supply 1500 is detected by the voltage detecting circuit 1812 at all time or when necessary, and a corresponding charge control command SFC is input to the charge control circuit 1811 depending upon the excessive or insufficient state of the charged amount of the secondary power supply 1500. Then, the start/stop of the supply of the alternating voltage SAC generated by the power generating unit 1600 to a rectifying circuit 1609 is controlled in response to the charge control command SFC.

In contrast, the direct current voltage SDC charged in the secondary power supply 1500 is input to a voltage increase circuit 1813 including a voltage increasing capacitor 1813*a* and increased to a predetermined times of a voltage. Then, the increased direct current voltage SDU is charged in a large capacitance capacitor 1814.

The voltage increase is a means for securing the reliable operation even if the voltage of the secondary power supply 1500 is lower than the operating voltage of the motors and circuits. That is, the motors and the circuits are driven by the electric energy stored in the large capacity capacitor 1814. However, when the voltage of the secondary power supply 1500 is increased to an approximate 1.3V, the large capacity capacitor 1814 and the secondary power supply 1500 are used by being connected in parallel with each other.

The voltage SVC across both the ends of the large capacity capacitor 1814 is detected by the voltage detecting circuit 1812 at all times or when necessary, and a corresponding voltage increase command SUC is input to a voltage increase control circuit 1815 depending upon the remaining state of the amount of electricity in the large capacity capacitor 1814. Then, a voltage increasing ratio SWC in the voltage increase circuit 1813 is controlled based on the voltage increase command SUC. The voltage increasing ratio means a multiplying ratio when the voltage of the secondary power supply 1500 is increased and generated by the large capacity capacitor 1814 and controlled at a multiplying ratio of 3 times, 2 times, 1.5 times, 1 time and the like when it is represented by (voltage of the large capacity capacitor 1814)/(voltage of the secondary power supply 1500).

The start signal SST, the stop signal SSP and the reset signal SRT, which are supplied from the switch A 1821 provided with the start/stop button 1201 and the switch B 1822 provided with the reset button 1202, are input to a mode control circuit 1824 for controlling the respective modes in the chronograph through a switch input circuit 1823. The signals also determine whether the start/stop button 1201 is pressed or not, or a switch input circuit/chattering prevention circuit 1823, which determines whether the reset button 1202 is pressed or not. Note that the switch A 1821 includes a switch lever A 1243 as a switch holding mechanism, and the switch B 1822 includes a switch lever B 1257.

Further, the signal SHD divided by the frequency dividing circuit 1802 also is input to the mode control circuit 1824. Then, a start/stop control signal SMC is supplied from the mode control circuit 1824 in response to the start signal SST, and the chronograph reference signal SCB created by a chronograph reference signal generating circuit 1825 is input to a motor pulse generating circuit 1826 in response to the start/stop control signal SMC.

On the other hand, the chronograph reference signal SCB created by the chronograph reference signal generating circuit 1825 also is input to a chronograph low frequency dividing circuit, and the signal SHD divided by the frequency dividing circuit 1802 is divided from a frequency of 64 Hz to a frequency of 16 Hz in synchronism with the chronograph reference signal SCB. Then, the signal SCD divided by the frequency dividing circuit 1827 is input to the motor pulse generating circuit 1826.

Then, the chronograph reference signal SCB and the dividing signal SCD are input to the motor pulse generating circuit 1826 as timing signals. For example, the dividing signal SCD is made active in response to the output timing of the chronograph reference signal SCB which is issued, for example, each 1/10 second or 1 second, and pulses for driving a motor and pulses SPC for detecting the rotation and the like of the motor are created in response to the dividing signal SCD and the like. The motor drive pulses SPC created by the motor pulse generating circuit 1826 are supplied to the chronograph motor 1400 so as to drive it. Further, the pulse SPC for detecting the rotation and the like of the motor is supplied to a motor detecting circuit 1828 at a timing different from that of the above pulse so that the external magnetic field of the motor 1400 and the rotation of the rotor of the motor 1400 are detected. Then, the external magnetic field detecting signal and the rotation detecting signal SDG detected by the motor detecting circuit 1828 are fed back to the motor pulse generating circuit 1826.

Further, the chronograph reference signal SCB created by the chronograph reference signal generating circuit 1825 also is input to an automatic stop counter 1829 of, for example, 16 bits and counted thereby. Then, when the count reaches a predetermined count value, that is, a measurement limit time is reached, an automatic stop signal SAS is input to the mode control circuit 1824. At the same time, the stop signal SSP is input to the chronograph reference signal generating circuit 1825, whereby the chronograph reference signal generating circuit 1825 is stopped and reset.

Further, when the stop signal SSP is input to the mode control circuit 1824, the output of the start/stop control signal SMC is stopped and the creation of the chronograph reference signal SCB also is stopped so that the drive of the chronograph motor 1400 is stopped. After the creation of the chronograph reference signal SCB is stopped, the reset signal SRT, which has been input to the mode control circuit 1824, is supplied to the chronograph reference signal generating circuit 1825 and the automatic stop counter 1829 as a reset control signal SRC, whereby the chronograph reference signal generating circuit 1825 and the automatic stop counter 1829 are reset as well as the respective chronograph hands are reset (to zero).

The present invention is by no means limited to the above embodiment and various modification can be made within the range which does not depart from the claims.

For example, although the two motors, the ordinary time drive motor 1300 and the chronograph drive motor 1400 are independently provided, the present invention also is applicable to a case in which two or more chronograph drive motors are provided, whereby a size can be reduced.

Further, while the electronic watch having the analog display type chronograph function has been described as the timepiece, the present invention is not particularly limited thereto and also is applicable to an analog display type multi-function timepiece.

As described above, according to the present invention, the ordinary time measuring section, the time information measuring section and the reset to zero mechanism are disposed on the laminated layers. The space of the timepiece main body can be effectively used, whereby freedom of design can be enhanced such as the reduction of size in the plane (lateral) direction of the main body, and the like. Further, the reset to zero mechanism is a component which has a complex structure, including many spring parts and the like and requires skill in assembly. Further, it is difficult to maintain the train wheel sections in a stable state when they are assembled. However, since the reset to zero mechanism is disposed on the layer different from the layer on which the ordinary time measuring section and the time information measuring section are disposed, the reset to zero mechanism can be assembled after respective train wheels their receivers are assembled. As a result, the breakage of the train wheel sections whose state is difficult to be stabilized in assembly, the removal of wheels and from tenons, and the like can be prevented so that an assembly job can be effectively carried out. Further, when the reset to zero mechanism composed of a lot of parts and the train wheel sections are disposed on the same layer, re-work requires reassembly of all the parts. In contrast, since the present invention employs the two layers structure, an assembled state can be inspected at the time each layer is assembled, and if rework is required during the inspection, it can be completed without reassembly of both layers.

According to the present invention, since the ordinary time measuring section, the time information measuring section and the power generating unit are disposed on the laminated layers, the space of the timepiece main body can be effectively used, whereby the freedom of design can be enhanced such as the reduction of size in the plane (lateral) direction of the main body, and the like.

According to the present invention, since the ordinary time measuring section, the time information measuring section and the power generating unit are disposed on the laminated layers, the space of the main body can be effectively used, whereby the freedom of design can be enhanced such as the reduction of size in the plane (lateral) direction of the main body, and the like.

According to the present invention, since the reset to zero mechanism is disposed in the vicinity of the time information measuring section, the size of parts can be miniaturized and a space saving effect can be obtained.

According to the present invention, miniaturization can be realized because the vacant space of the reset to zero mechanism can be utilized and the reset to zero mechanism need not overlap other components on a plane.

According to the present invention, since the reset to zero mechanism and the power generating unit are disposed on the same layer, the size of the timepiece main body can be reduced in the plane (lateral) direction, whereby the freedom of design can be more enhanced.

According to the present invention, since the reset to zero mechanism and the power generating unit are disposed on different layers, the size of the timepiece main body can be greatly reduced in the plane (lateral) direction, whereby the freedom in design can be more enhanced.

According to the present invention, the reliability of electric contact can be improved by the elastic force of the elastic members, whereby the reliability of electric conduction and an assembling property can be enhanced.

According to the present invention, since the motors are not influenced by the magnetic field of generated power, an operating accuracy can be greatly enhanced.

According to the present invention, a power storing efficiency can be increased.

According to the present invention, since power can be automatically stored, an operation failure due to the sudden drop of the voltage of the power supply can be prevented in measurement so that the measurement can be carried out in a good state at all times.

According to the present invention, there can be provided the conventionally unavailable chronograph which is small in size and does not require a job for replacing a cell and the like. According to the present invention, since two or more kinds of time units can be displayed, more accurate time information and time information for a long period of time can be obtained.

According to the present invention, the two or more kinds of the time units are displayed by the mechanical operation performed by the train wheels, they can be reliably displayed.

According to the present invention, there can be provided the conventionally unavailable wrist watch which is small in size and does not require a job for replacing a cell.

According to the present invention, there can be realized a quartz type watch of high accuracy with an upscale image, the watch having an accuracy of time, which can be obtained by a quartz watch and cannot be obtained by a conventional mechanical watch, as well as having the reset to zero mechanism of a mechanical watch which permits hands to be instantly returned to a zero position.

A preferable embodiment of the present invention will be described below based on drawings.

A characteristic portion of a timepiece of the present invention resides in the structure of a mechanical reset to zero mechanism by the disposition of an ordinary time display and a time information display other than the ordinary time display.

Figure 36:
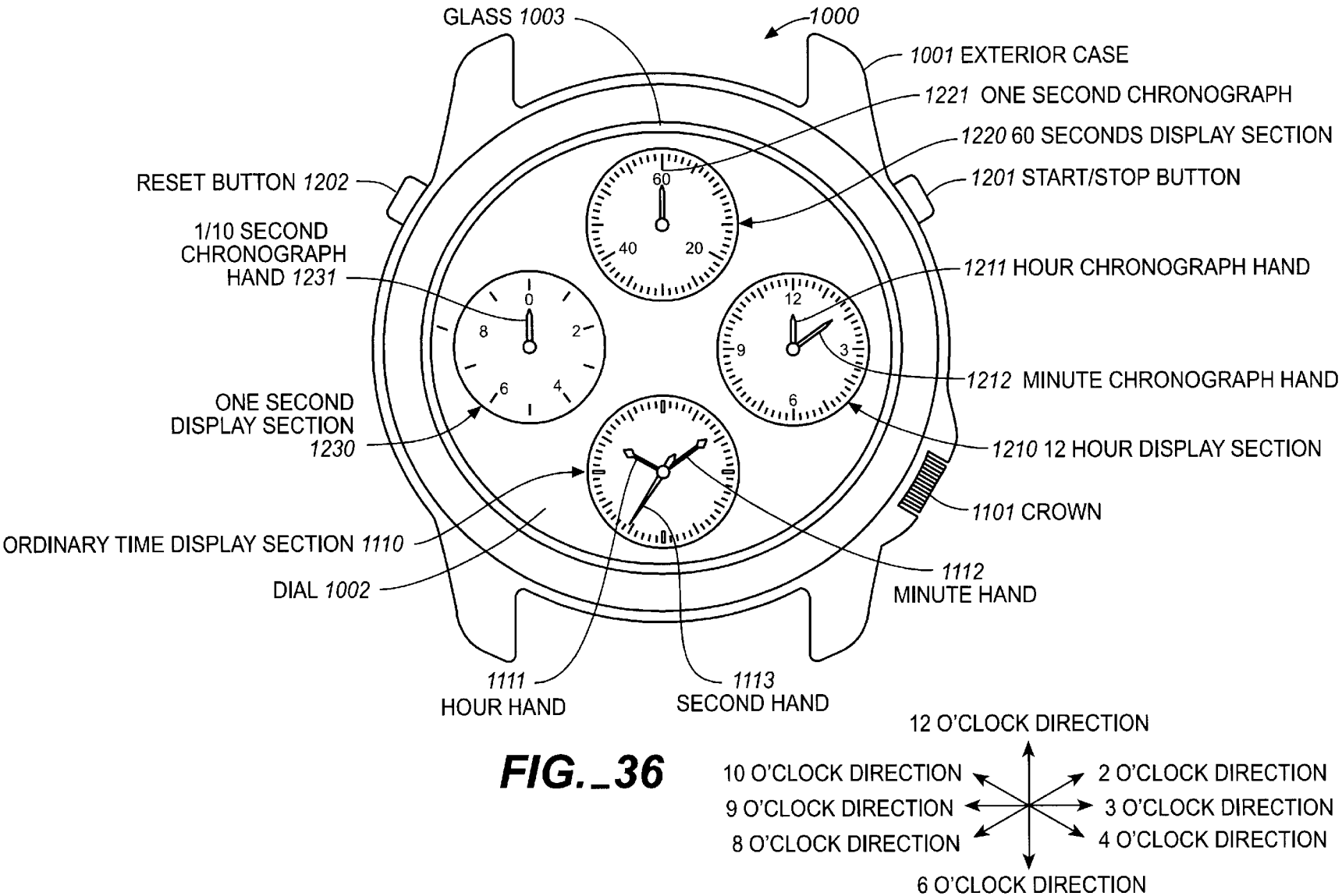
FIG. 36 is a plan view showing an embodiment of the timepiece of the present invention when it is viewed from a front side.

FIG. 36 is a plan view showing an embodiment of the timepiece of the present invention when it is viewed from a front side.

A timepiece 1000 shown in FIG. 36 is an analog electronic watch having a chronograph function and a dial 1002 and a transparent glass 1003 are fitted in the interior of an outside case 1001. A crown 1101 as an external manipulating member is disposed at the 4 o'clock position of the outside casing 1001, and a start/stop button 1201 and a reset button 1202 are disposed at approximately the 2 o'clock and 10 o'clock positions respectively. Further, an ordinary time display section 1110, including an hour hand 1111, a minute hand 1112, and a second hand 1113, which are ordinary time hands, is disposed at an approximate 6 o'clock position of the dial 1002. Display units 1210, 1220, and 1230, having chronograph auxiliary hands, are disposed at an approximate 3 o'clock, 12 o'clock and 9 o'clock positions, respectively. That is, a 12 hours display unit 1210 having hour and minute chronograph hands 1211 and 1212 for displaying 12 hours with hands are disposed at the position of the approximate 3 o'clock, a 60 seconds display unit 1220 having one second chronograph hand 1221 for displaying 60 seconds with a hand is disposed at the position of the approximate 12 o'clock, and a one second display unit 1230 having a 1/10 second chronograph hand 1231 for displaying one second with a hand is disposed at the position of the approximate 9 o'clock.

As described above, since the ordinary time display unit 1110, the 12 hours display unit 1210, the 60 seconds display unit 1220 and the one second display unit 1230 of the timepiece 1000 shown in FIG. 36 are located at the positions other than the center of the main body of the timepiece 1000, the reset to zero mechanism 1200R, which will be described below, can be disposed at the center of the main body of the timepiece 1000.

Figure 37:
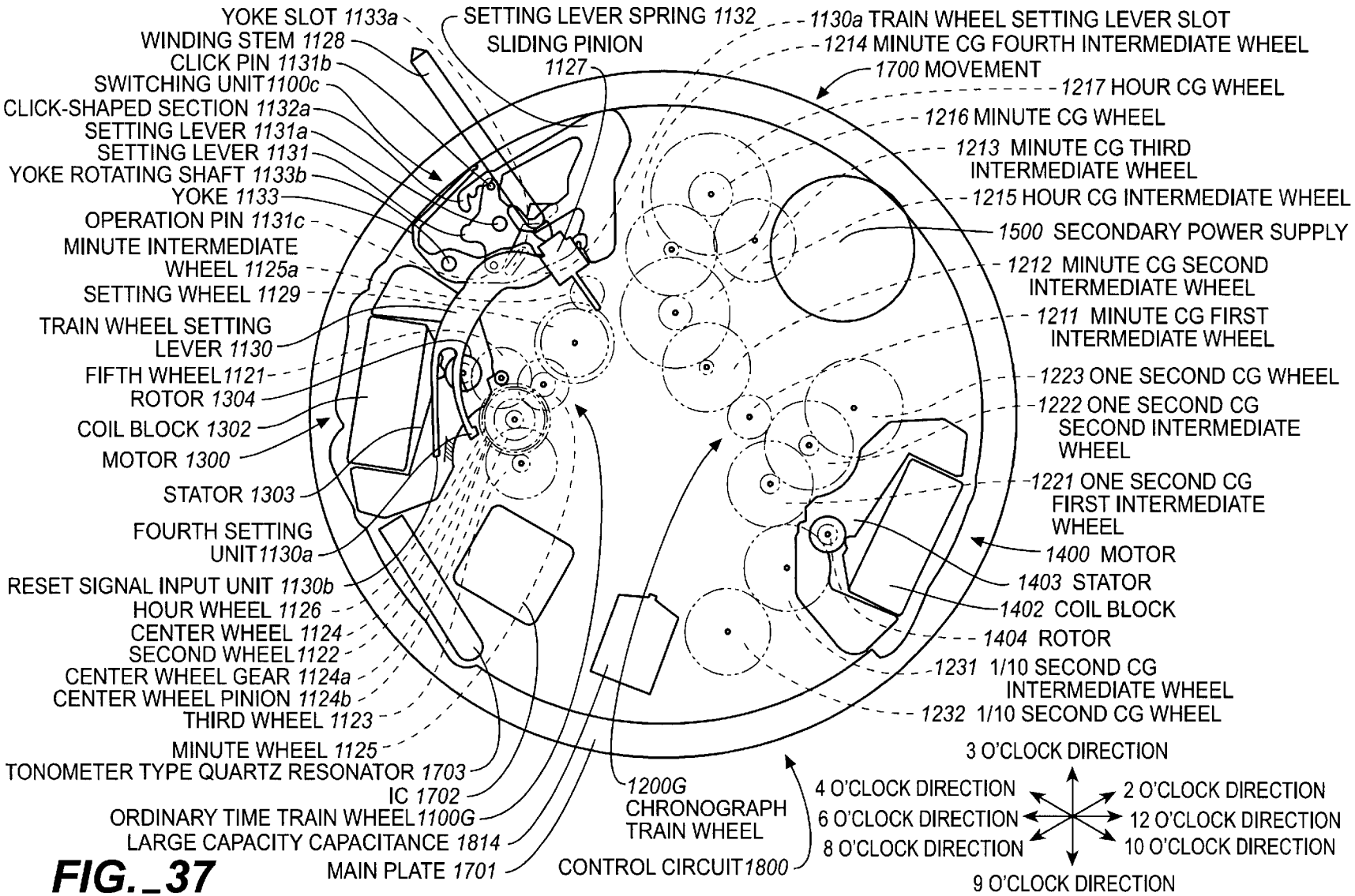
FIG. 37 is a plan view showing the movement of the timepiece shown in FIG. 36 when it is viewed from the backside of the timepiece.

FIG. 37 is a plan view showing a movement 1700 of the timepiece 1000 shown in FIG. 36 when it is viewed from the backside of the timepiece 1000.

The movement 1700 shown in FIG. 37 is arranged such that a motor 1300, an ordinary time train wheel 1100G, an IC 1702, a tonometer type quartz resonator 1703, a large capacity capacitor 1814 and the like are disposed on a main plate 1701 in a 6 o'clock direction. The motor 1300 drives the hands of the ordinary time display unit 1110, the ordinary time train wheel 1100G transmits the drive force of the motor 1300 to the hands of the ordinary time display unit 1110, and the IC 1702 constitutes a switching unit 1100C, which switches the time and the calendar of the ordinary time display unit 1110, and a control circuit 1800. Further, a 12 hours display unit 1210, a 60 seconds display unit 1220, a motor 1400 for driving the hand of a one second display unit 1230, a chronograph train wheel 1200G, which transmits the drive force of the motor 1400 to the hands of the respective display units 1210, 1220, and 1230, and a secondary power supply 1500 such as a lithium ion power supply, and the like are disposed on the main plate 1701 in a 12 o'clock direction.

As shown in FIG. 37, the ordinary time train wheel 1100G includes the train wheels of a fifth wheel 1121, a second wheel, a third wheel 1123, a center wheel 1124, a minute wheel 1125, an hour wheel 1126 and the like, and an ordinary time second, minute and hour are displayed by the train wheels. The center of rotation of the above indicator wheels are disposed to the peripheral portion of the approximate center of the main body. That is, there is a case in which the indicator wheels as a whole including the wheel gear portions thereof are disposed apart from the center of the main body and a case in which the respective indicator wheels are disposed such that although the centers of rotation of the respective indicator wheels are displaced from the center of the main body, portions thereof such as the peripheral portions of the wheel gear portions are disposed so as to be partially located on the center of the main body.

In FIG. 37, the motors 1300 and 1400 are step motors and composed of coil blocks 1302 and 1402 having magnetic cores composed of a highly permeable material, stators 1303 and 1403 composed of a highly permeable material, rotors 1304 and 1404 composed of rotor magnets and rotor pinions, and the like.

In FIG. 37, the switching unit 1100C includes the crown 1101, which is shown in FIG. 36, fixed to an end thereof, as well as a winding stem 1128, to which a sliding pinion 1127 is fitted, a setting wheel 1129, a setting lever 1131, a setting lever spring 1132, a yoke 1133, and a train wheel setting lever 1130 at the other end thereof.

The setting lever 1131 is provided with another operation pin 1131*c* in contact the click pin 1131*b* and the setting lever rotating shaft 1131*a*. A yoke 1133, a yoke slot 1133*a* which is disposed in the shape of the train wheel setting lever 1130, and a train wheel setting lever slot 1130*a* are engaged with the operation pin 1131*c*. Further, the sliding pinion 1127 is guided by the winding stem 1128 through the center hole thereof and can be rotated together with the rotation of the winding stem 1128.

The yoke 1133 can be rotated about a yoke rotating shaft 1133*b*. Further, the extreme end of the yoke 1133 is engaged with a cut-out formed at the sliding pinion 1127. The yoke 1133 moves the sliding pinion 1127 forward and backward, thereby creating a calendar correcting state and a time correcting state. The yoke 1133 has a spring section and always applies force in the direction of the setting lever rotating shaft 1131*a* of the setting lever 1131. When the setting lever 1131 is rotated, the operation pin 1131*c* of the setting lever 1131 is also rotated thereby. Thus, the extreme end of the yoke 1133 moves the sliding pinion 1127 toward the outside in the first stage and toward the center in the second stage through the yoke slot 1133*a* which is engaged with the operation pin 1131*c*. In the first stage, a wheel gear provided with the sliding pinion 1127 is meshed with a backside calendar part to thereby permit a calendar to be corrected. In the second stage, the wheel gear disposed at the extreme end of the sliding pinion 1127 is meshed with the setting wheel 1129 to thereby permit a time to be corrected.

The train wheel setting lever 1130 sets the second wheel 1122 when the time is corrected as well as stops hand operating pulses by inputting a reset signal. Likewise the yoke 1133, the train wheel setting lever 1130 is rotated by the rotation of the operation pin 1131*c* of the setting lever 1131 about a train wheel setting lever rotating shaft 1130*b* along the train wheel setting lever slot 1130*a* with which it is engaged, thereby setting the second wheel 1122 as well as coming into contact with a reset pattern. Since it is sufficient that the action of the train wheel setting lever 1130 is applied only to the second stage, the shape of the train wheel setting lever slot 1130*a* escapes the rotational locus of the operation pin 1131*c* of the setting lever 1131 up to the zero to first stage as it is.

With the above arrangement, the winding stem 1128 is pulled to the second stage by pulling the crown 1101, a reset signal input section 1130*b* disposed to the train wheel setting lever 1130 comes into contact with the pattern of a circuit board 1704 on which the IC 1702 is mounted, thereby stopping the output of motor pulses so as to stop the operation of the hands. At the time, the rotation of the fourth wheel gear 1122*a* is set by the train wheel setting lever slot 1130*a* disposed to the train wheel setting lever 1130. When the winding stem 1128 is rotated together with the crown 1101 in this state, rotational force is transmitted from the sliding pinion 1127 to the minute wheel 1125 through the setting wheel 1129 and a minute intermediate wheel 1125*a*. Since the center wheel gear 1124*a* is coupled with the center wheel pinion 1124*b* with predetermined sliding torque, the setting wheel 1129, the minute wheel 1125, the center wheel pinion 1124*b*, and the hour wheel 1126 are rotated even if the fourth wheel 1122 is set. Therefore, an arbitrary time can be set because the minute hand 1112 and the hour hand 1111 are rotated.

In FIG. 37, the chronograph train wheel 1200G includes the train wheels of a 1/10 second CG (chronograph) intermediate wheel 1231, a 1/10 second CG wheel 1232 which is disposed at the center of the one second display unit 1230. With the above arrangement of the train wheels, chronograph 1/10 second is displayed at the position of the 9 o'clock of the watch.

Further, in FIG. 37, the chronograph train wheel 1200G includes the train wheels of a one second CG first intermediate wheel 1221, a one second CG second intermediate wheel 1222, and a one second CG wheel 1223 which is disposed at the center position of the 60 seconds display unit 1220. With the above arrangement of the train wheels, a chronograph 1 second is displayed at the position of the 12 o'clock of the watch.

Further, in FIG. 37, the chronograph train wheel 1200G includes the train wheels of a minute CG first intermediate wheel 1211, a minute CG second intermediate wheel 1212, a minute CG third intermediate wheel 1213, a minute CG fourth intermediate wheel 1214, an hour CG intermediate wheel 1215, a minute CG wheel 1216, and an hour CG wheel 1217. The minute CG wheel 1216 and the hour CG wheel 1217 are concentrically disposed at the center of the 12 hours display unit 1210. With the above arrangement of the train wheels, a chronograph minute and hour are displayed at the position of 3 o'clock of the watch. The center of rotation of the above indicator wheels are disposed to the peripheral portion of the approximate center of the main body. That is, there is a case in which the indicator wheels as a whole including the wheel gear portions thereof are disposed apart from the center of the main body and a case in which the respective indicator wheels are disposed such that although the centers of rotation of the respective indicator wheels are displaced from the center of the main body, portions thereof such as the peripheral portions of the wheel gear portions are disposed so as to be partially located on the center of the main body.

Note that only the indicator wheels of the ordinary time display unit 1110 may be disposed at the center of the main body, in addition to the case that the indicator wheels of both of the ordinary time display unit 1110 and the time information display units 1210, 1220, and 1230 are disposed to the peripheral portion of the center of the main body as shown in the embodiment.

Figure 38:
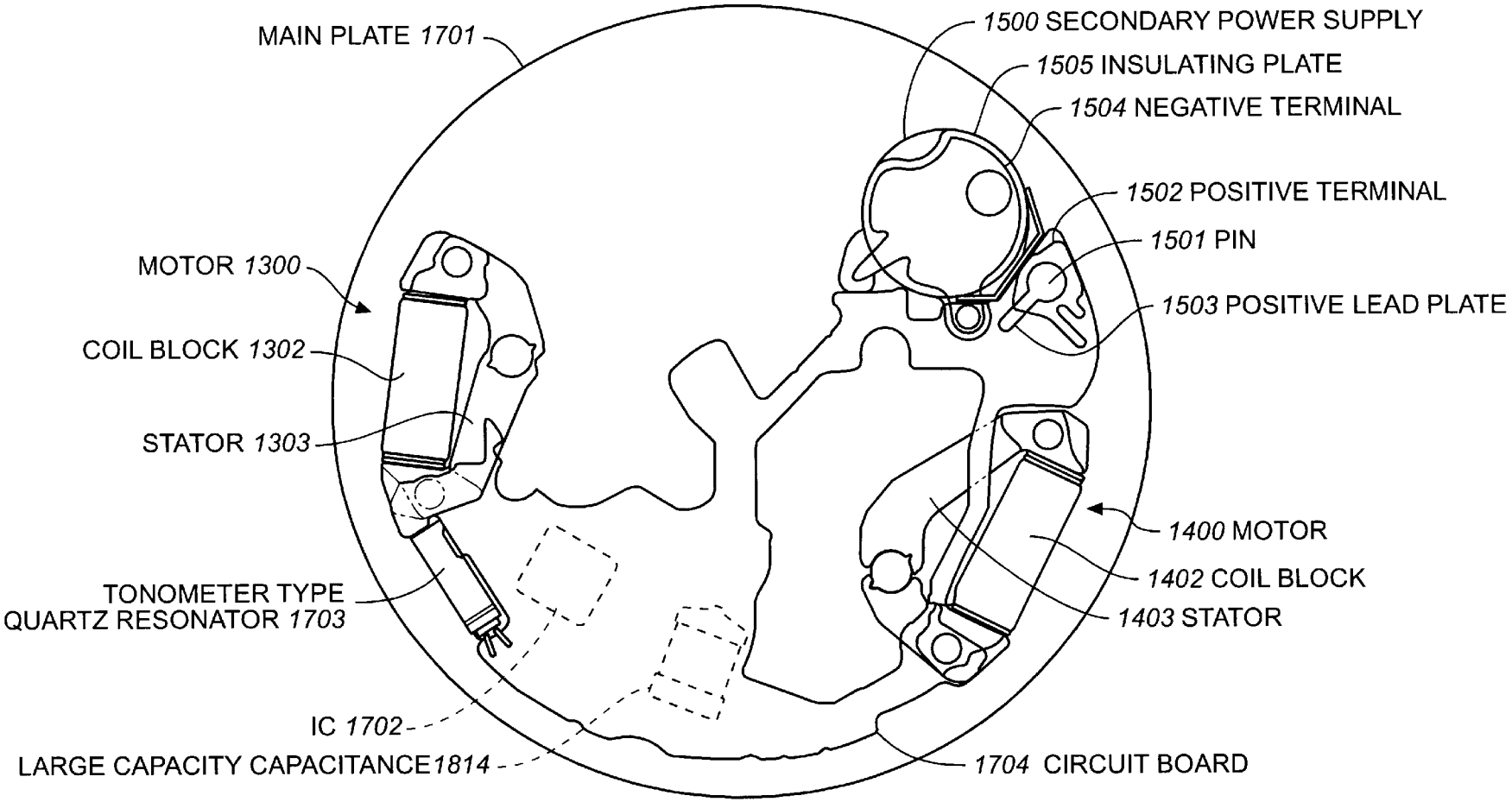
FIG. 38 is a plan view showing a circuit board disposed on the movement shown in FIG. 37 when it is viewed from the backside of the timepiece.

FIG. 38 is a plan view showing a circuit board 1704 disposed on the movement 1700 shown in FIGS. 37 when it is viewed from the backside of the timepiece 1000 and shows parts electrically connected to the circuit board 1704.

The circuit board 1704 shown in FIG. 38 is, for example, a flexible print board and has the IC 1702, the large capacity capacitor 1814 and the like mounted thereon. Then, drive pulses of an ordinary time and a chronograph are generated from the IC 1702 and transmitted to the coil blocks 1302 and 1402 of the respective motors 1300 and 1400 connected to a copper foil (not shown).

The positive terminal of the secondary power supply 1500 is connected to the circuit board 1704 in such a manner that the extreme end spring portion of a positive terminal 1502, which is guided by a pin 1501 fitted into the main plate 1701 composed of a metal, comes into contact with the side of the button type secondary power supply 1500 with predetermined spring force. A positive lead plate 1503 comes into contact with the extreme end of the pin 1501, and further the extreme end spring portion of the positive lead plate 1503 comes into contact with the positive pattern of the circuit board 1704 with predetermined spring force.

Therefore, the positive voltage is supplied through the secondary power supply 1500→the positive terminal 1502→the pin 1501→the positive lead plate 1503→the positive pattern of the circuit board 1704→the IC 1702. Further, the negative voltage of the secondary power supply 1500 is connected to the circuit board 1704 in such a manner that a spring portion, which is disposed to the outer periphery of a negative terminal 1504 welded and conducted to the end surface of the secondary power supply 1500, comes into contact with the negative pattern of the circuit board 1704 with predetermined spring force. Therefore, the negative voltage is supplied through the secondary power supply 1500→the negative terminal 1504→the negative pattern of the circuit board 1704→the IC 1702. Note that an insulating plate 1505 is mounted on the negative terminal 1504 to prevent the short-circuit of the negative terminal 1504 to the third intermediate receiving plate 2003.

Figure 39:
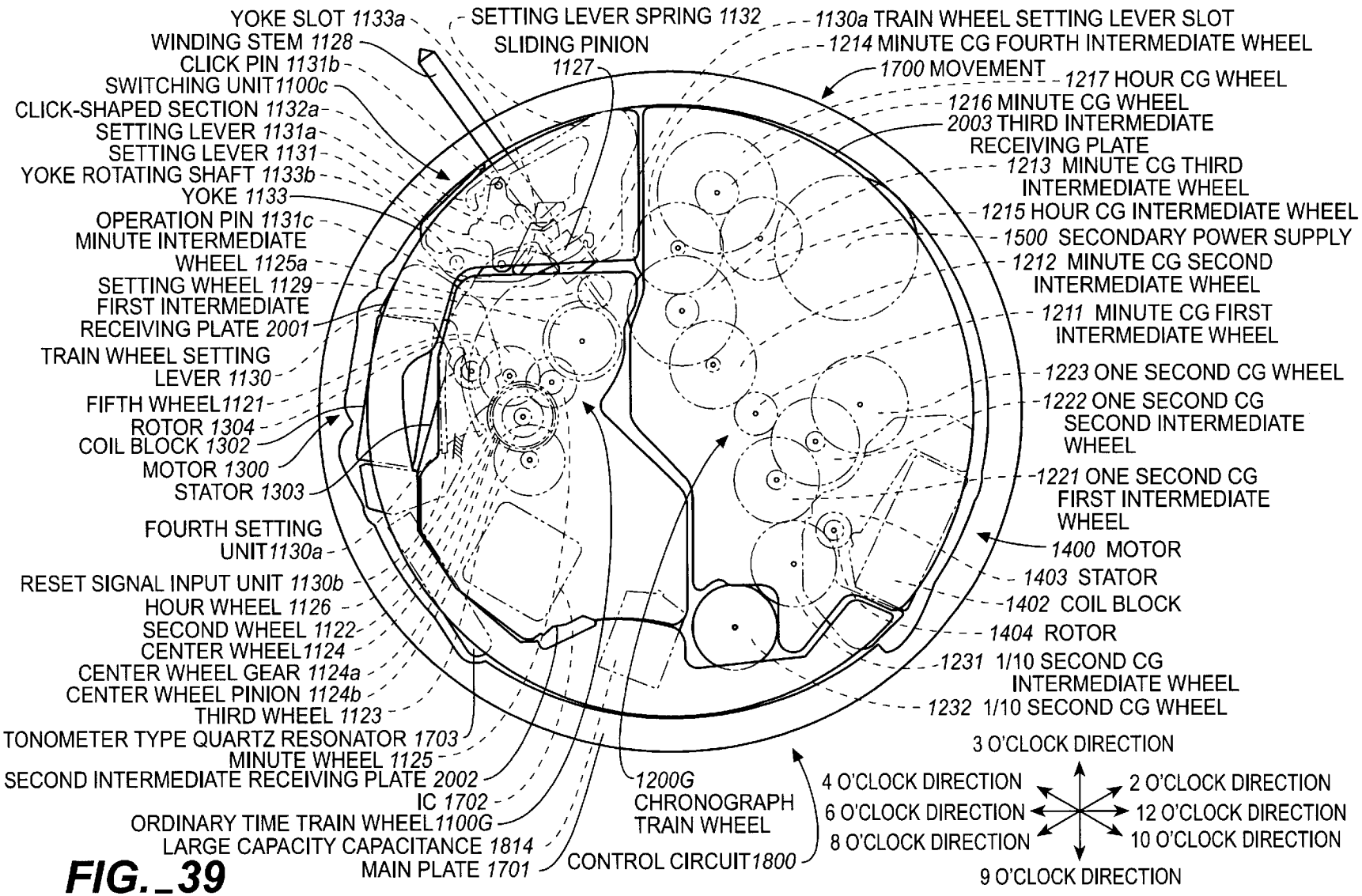
FIG. 39 is a plan view showing a first intermediate receiving plate, a second intermediate receiving plate, and a third intermediate receiving plate which are disposed on the circuit board shown in FIG. 38 when they are viewed from the backside of the timepiece.

FIG. 39 is a plan view showing a first intermediate receiving plate 2001, a second intermediate receiving plate 2002, and a third intermediate receiving plate 2003 each disposed on the circuit board shown in FIG. 38 when they are viewed from the backside of the timepiece.

As shown in FIG. 39, the first intermediate receiving plate 2001 is disposed to the outermost side in a 6 o'clock direction so as to cover the motor 1300, the switching unit 1100C, the tonometer type quartz resonator 1703 which constitutes and the control circuit 1800, the large capacity capacitance 1814, and the like. The second intermediate receiving plate 2002 is disposed inwardly of the first intermediate receiving plate 2001 so as to cover the ordinary time train wheel 1100G, the IC 1702 which constitutes the control circuit 1800, and the like. The third intermediate receiving plate 2003 is disposed in a 12 o'clock direction so as to cover the chronograph train wheel 1200G, the motor 1400, the secondary power supply 1500 such as the lithium ion power supply, and the like.

Figure 40:
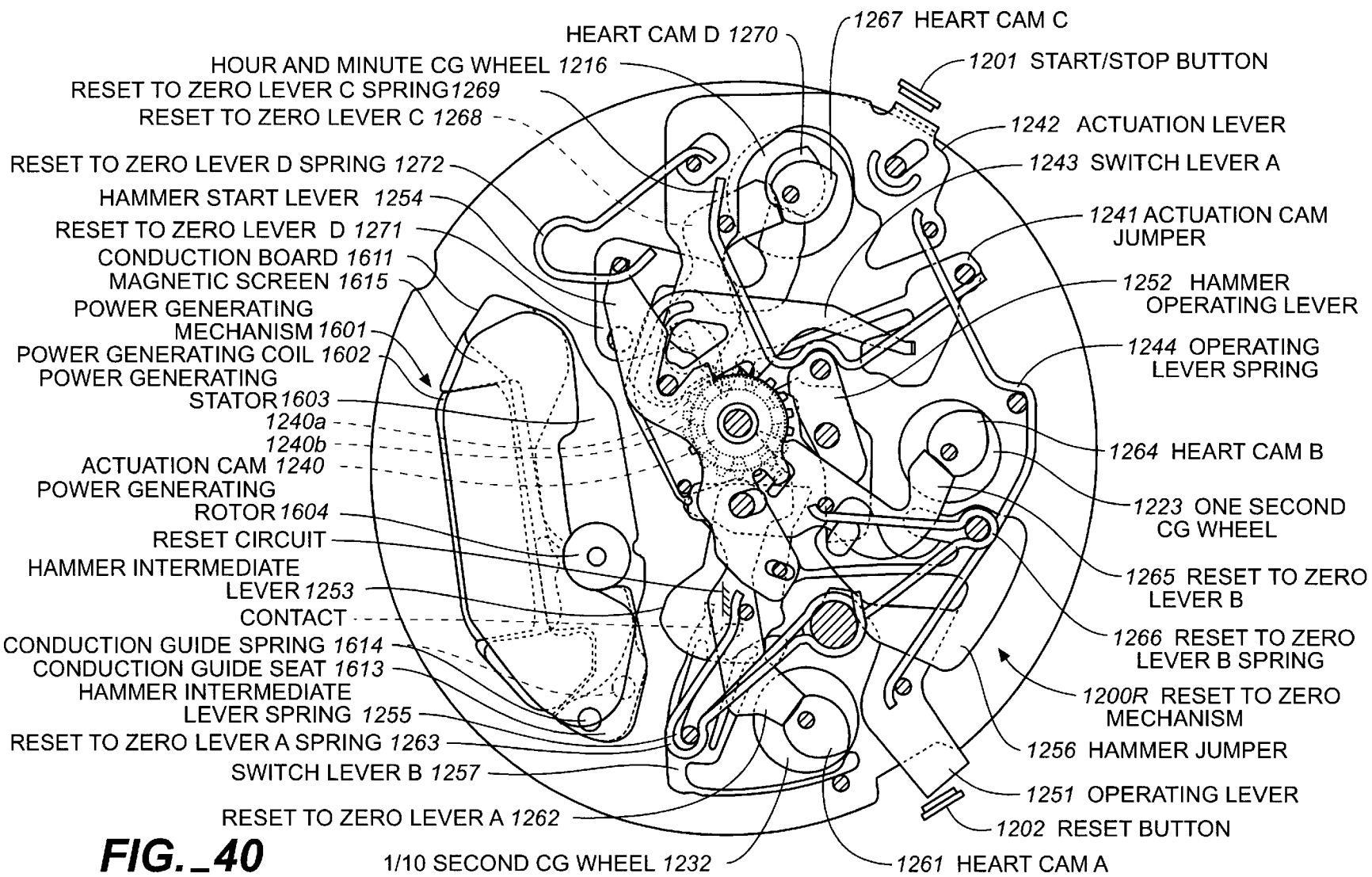
FIG. 40 is a plan view of a power generating unit (power generating mechanism excluding an oscillating weight), which is disposed on the second intermediate receiving plate shown in FIG. 39, converts mechanical energy into electric energy, and generates a voltage for driving an ordinary time measuring section and a time information measuring section, and a reset to zero mechanism, which is disposed on the third intermediate receiving plate shown in FIG. 39 and resets the measurement of time information other than an ordinary time to zero when they are viewed from the backside of the timepiece.

FIG. 40 is a plan view of a power generating unit 1600 (power generating mechanism 1601 without an oscillating weight 1605), which is disposed on the second intermediate receiving plate 2002 shown in FIG. 39, converts mechanical energy into electric energy, and generates a drive voltage for driving an ordinary time measuring section 1100. FIG. 40 also shows a time information measuring section 1200, and the reset to zero mechanism 1200R, which is disposed on the third intermediate receiving plate 2003 and a first intermediate receiving plate 2102 shown in FIG. 39 and resets the measurement of time information other than an ordinary time to zero when they are viewed from the backside of the timepiece 1000. Further, FIG. 41 is a plan view showing the oscillating weight 1605 of the power generating unit 1600 disposed on the power generating mechanism 1601 when it is viewed from the backside of the timepiece 1000.

Figure 41:
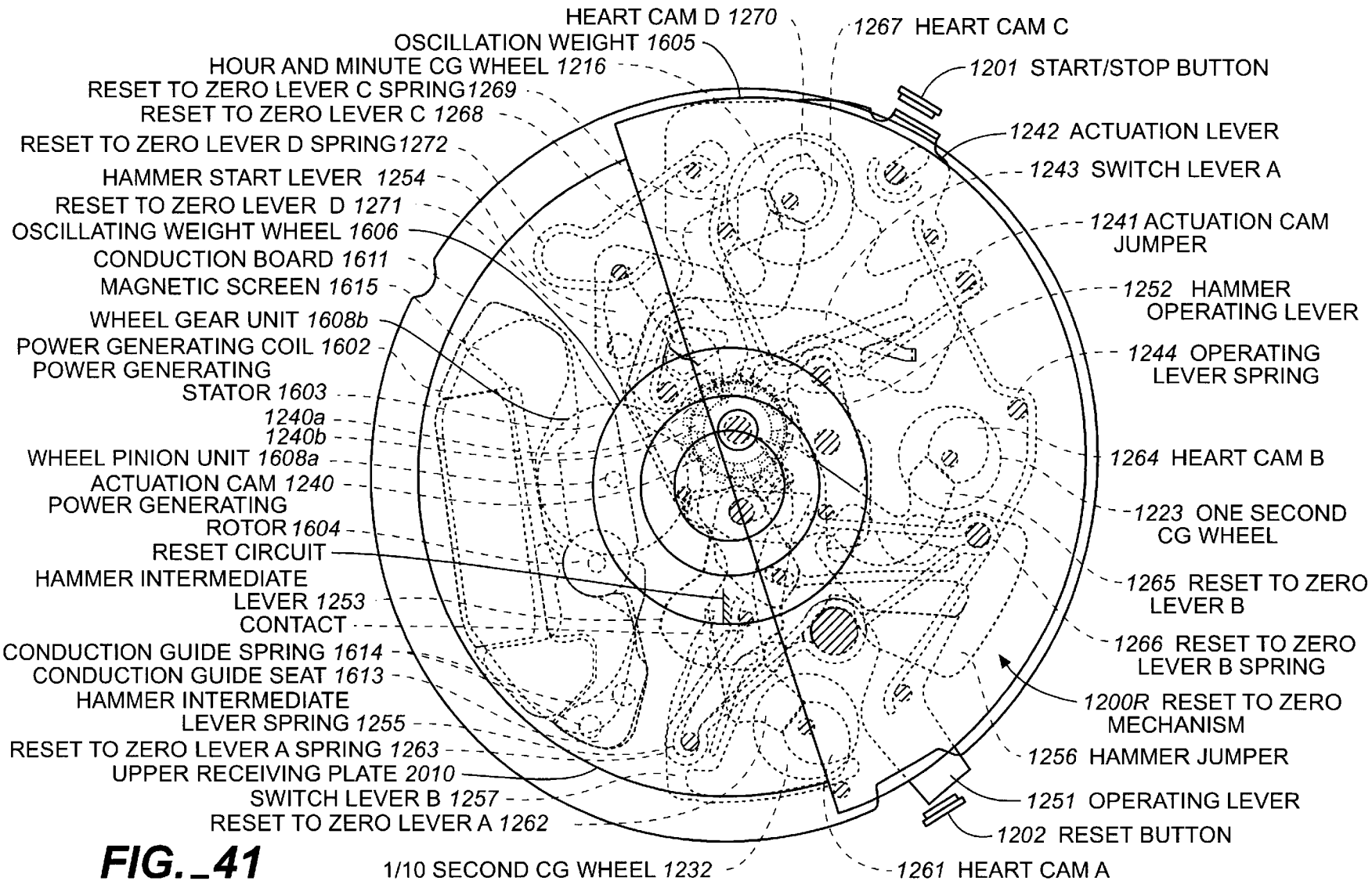
FIG. 41 is a plan view showing the oscillating weight of the power generating unit disposed on the power generating mechanism of FIG. 40 when it is viewed from the backside of the timepiece.

The power generating unit 1600 shown in FIGS. 40 and 41 is composed of a power generating coil 1602 wound around a highly permeable material, a power generating stator 1603 composed of a highly permeable material, a power generating rotor 1604 composed of a permanent magnet and a wheel pinion unit, and a one-sided oscillating weight 1605 disposed on the upper receiving plate 2010.

The oscillating weight 1605 and the oscillating weight wheel 1606 disposed below the oscillating weight 1605 are rotatably journaled by a shaft fixed to the upper receiving plate 2010, and the removal of them in an axial direction is prevented by an oscillating weight screw 1607. The oscillating weight wheel 1606 is meshed with the wheel pinion unit 1608*a* of a power generating rotor transmission wheel, and the gear portion 1608*b* of the power generating rotor transmission wheel is meshed with the wheel pinion unit of the power generating rotor 1604. The speed of the train wheel is increased from 30 times to about 200 times. The speed increasing ratio can be optionally set in accordance with the capability of the power generating unit and the specification of the watch.

In the above arrangement, when the oscillating weight 1605 is rotated by the motion of the wrist of a user, or the like, the power generating rotor 1604 is rotated at a high speed. Since the permanent magnet is fixed to the power generating rotor 1604, the direction of magnetic flux which is obliquely across the power generating coil 1602 is changed through the power generating stator 1603 each time the power generating rotor 1604 is rotated, whereby an alternating voltage is generated to the power generating coil 1602 by electromagnetic induction. The alternating voltage is rectified by a rectifying circuit mounted on the circuit board 1704 and charged to the secondary power supply 1500.

Subsequently, the structure of the reset to zero mechanism 1200R, which is a characteristic portion of the present invention, will be described.

Figure 42:
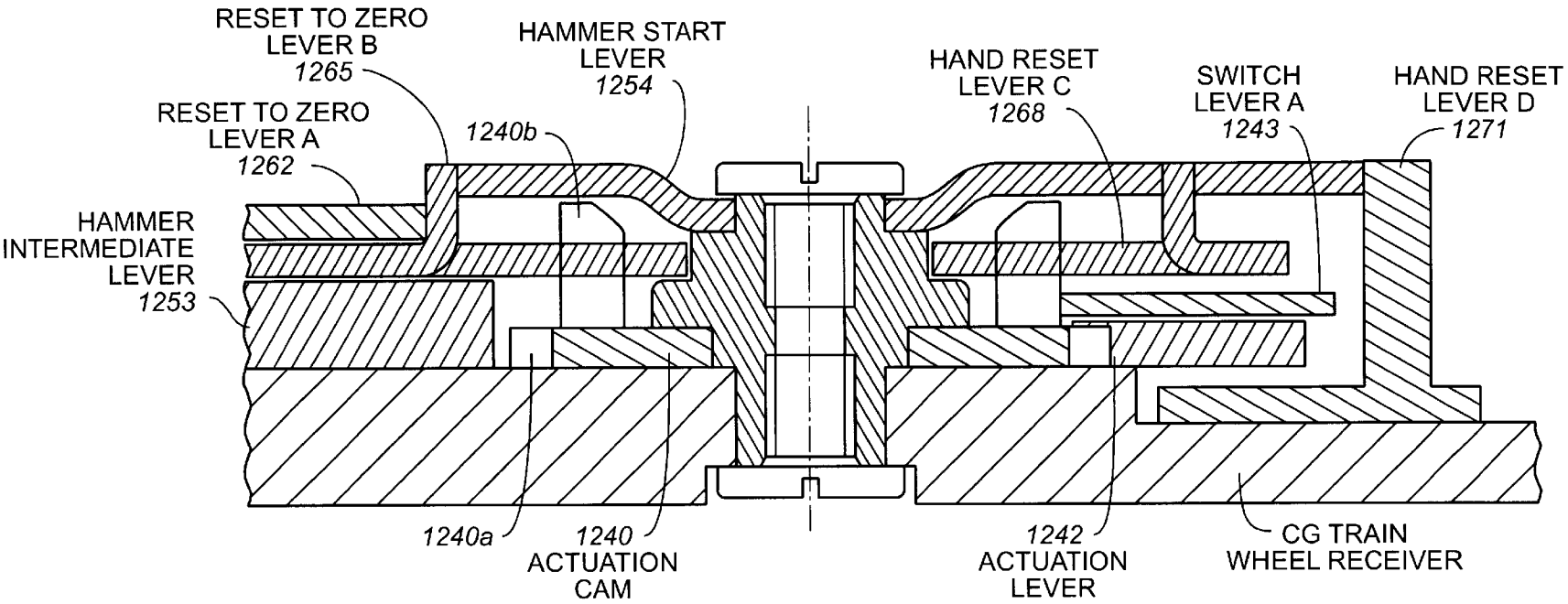
FIG. 42 is a side sectional view showing an example of the schematic arrangement of the main portion of the reset to zero mechanism of FIG. 40.

FIG. 42 is a side sectional view showing an example of the schematic arrangement of the main portion of the reset to zero mechanism 1200R. Note that the reset to zero mechanism 1200R shown in FIG. 40 shows a reset state, whereas the reset to zero mechanism 1200R shown in FIG. 42 shows a stop state.

In FIGS. 40 and 42, the reset to zero mechanism 1200R is mechanically started/stopped and reset by the rotation of an actuation cam 1240 which is disposed at approximate the center of the main body of the timepiece 1000. The actuation cam 1240 is formed in a cylindrical shape and has a plurality of tooth 1240*a* formed on the side along the periphery thereof at a predetermined pitch and columns 1240*b* formed along the periphery of an end surface thereof at a predetermined pitch. When the actuation cam 1240 is in a stationary state, the phase thereof is regulated by an actuation cam jumper 1241 which is engaged between teeth 1240*a* and rotated counterclockwise by an actuation cam rotating unit 1242*d* disposed at the extreme end of an actuation lever 1242.

Figure 43:
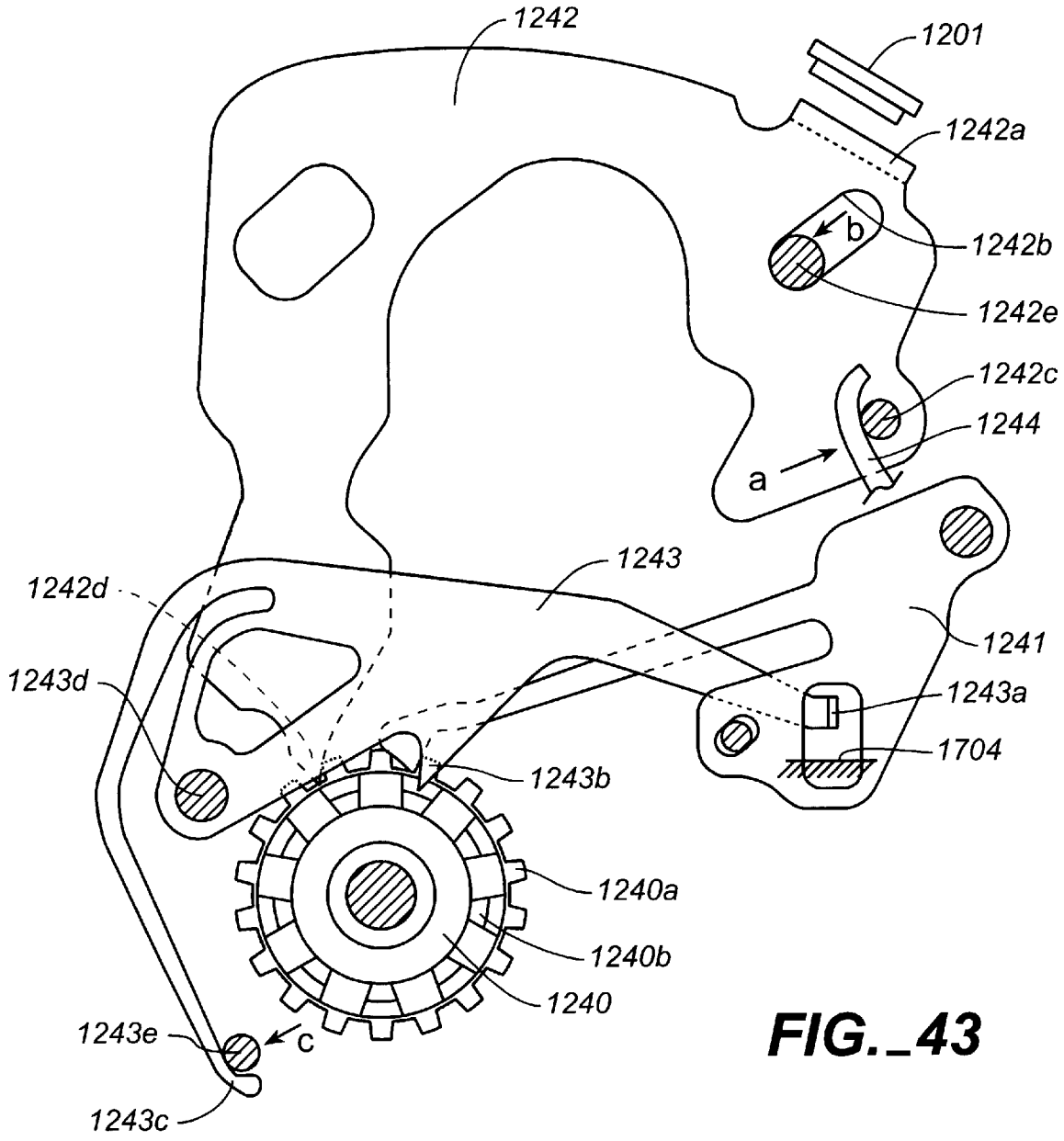
FIG. 43 is a first plan view showing an example of the operation of the start/stop actuating mechanism of the reset to zero mechanism of FIG. 42.

As shown in FIG. 43, a start/stop actuation mechanism is composed of an actuation lever 1242, a switch lever A 1243 and an operating lever spring 1244. The actuation lever 1242 is formed in an approximate flat-L-shape. At one end of the lever 1242 is a bent press section 1242*a*, an oval through hole 1242*b* and a pin 1242*c*. At the other end is an acute press section 1242*d*. The actuation lever 1242 is arranged as a start/stop actuation mechanism in such a manner that the press section 1242*d* is caused to be in contact with the start/stop button 1201. A pin 1242*e* fixed to the third intermediate receiving plate 2003 is inserted into the through hole 1242*b*, an end of the operating lever spring 1244 is engaged against the pin 1242*c*, and the press section 1242*d* is disposed in the vicinity of the actuation cam 1240.

An end of the switch lever A 1243 is arranged as a switch section 1243*a*, an approximate center thereof is provided with a flat projection 1243*b* and the other end thereof is arranged as a locking section 1243*c*. The switch lever A 1243 is arranged as the start/stop actuation mechanism in such a manner that the approximate center thereof is rotatably journaled about a pin 1243*d* fixed to the third intermediate receiving plate 2003. The switch section 1243*a* is disposed in the vicinity of the start circuit of the circuit board 1704, the projection 1243*b* is disposed to come into contact with a column 1240*b* disposed in the axial direction of the actuation cam 1240, and the locking section 1243*c* is engaged against a pin 1243*e* fixed to the third intermediate receiving plate 2003. That is, the switch section 1243*a* of the switch lever A 1243 is turned on by being caused to come into contact with the start circuit of the circuit board 1704. Note that the switch lever A 1243, which is electrically connected to the secondary power supply 1500 through the main plate 1701 and the like'has the same potential as that of the positive pole of the secondary power supply 1500.

An example of operation of the start/stop actuation mechanism arranged as described above will be described as to a case in which a chronograph is started with reference to FIG. 43 to FIG. 45.

As shown in FIG. 43, when the chronograph is in a stop state, the actuation lever 1242 is positioned in the state in which the press section 1242*a* is separated from the start/stop button 1201, the pin 1242*c* is pushed in the direction of an illustrated arrow a by the elastic force of the operating lever spring 1244, and an end of the through hole 1242*b* is pushed in the direction of an illustrated arrow b. Additionally, the extreme end 1242*d* of the actuation lever 1242 is located between teeth 1240*a* of the actuation cam 1240.

The switch lever A 1243 is positioned in the state in which the projection 1243*b* is pushed upward by a column 1240*b* of the actuation cam 1240 so as to be against the spring force of a spring section 1243*c* disposed to the other end of the switch lever A 1243 and the locking section 1243*c* is pushed in the direction of an illustrated arrow C by the pin 1243*e*. At the time, the switch section 1243*a* of the switch lever A 1243 is separated from the start circuit of the circuit board 1704 so that the start circuit is electrically shut off.

Figure 44:
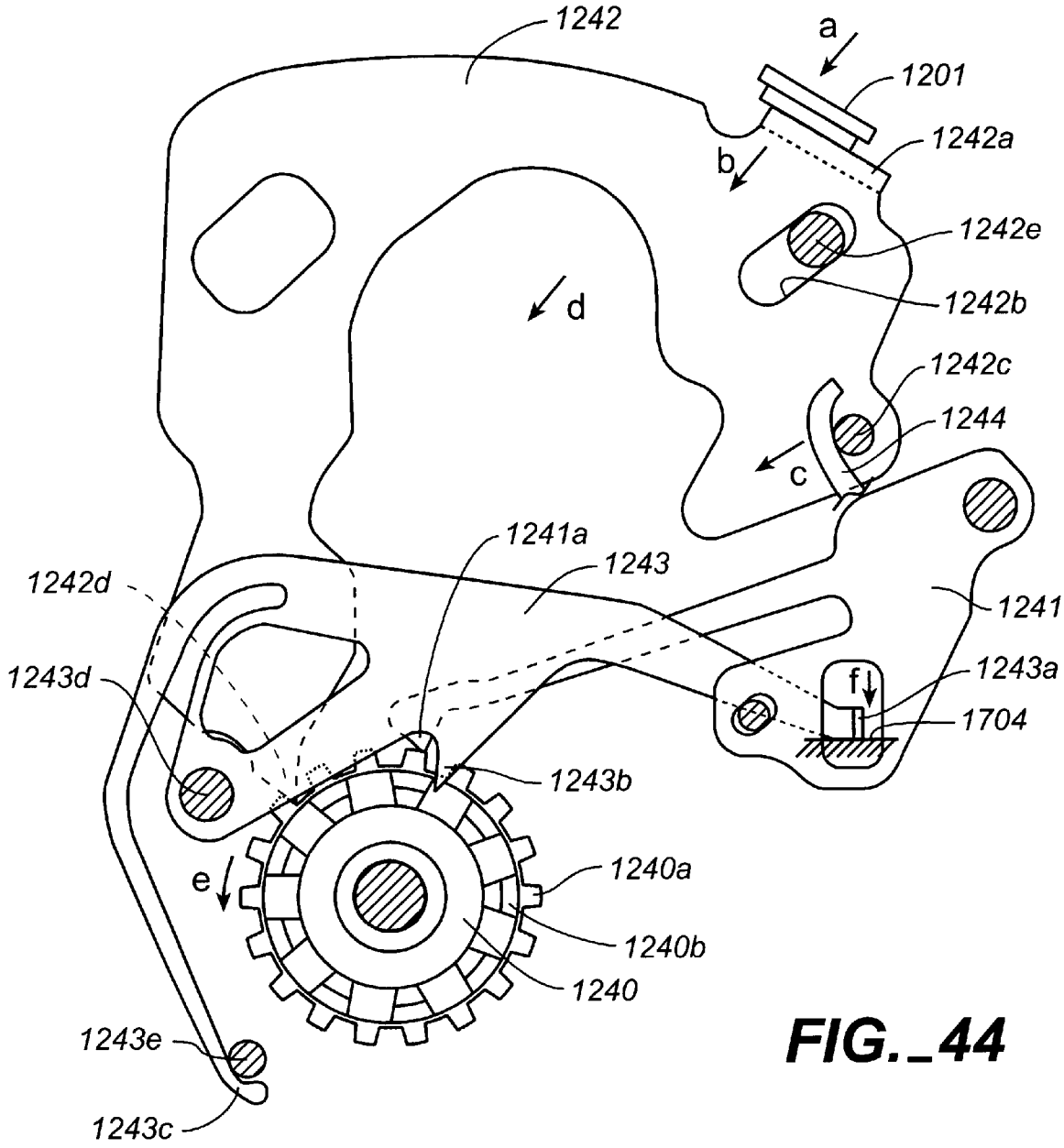
FIG. 44 is a second plan view showing an example of the operation of the start/stop actuating mechanism of the reset to zero mechanism of FIG. 42.

When the start/stop button 1201 is pressed in the direction of the illustrated arrow a to shift the chronograph to a start state from the above state as shown in FIG. 44, the press section 1242*a* of the actuation lever 1242 comes into contact with the start/stop button 1201 and is pressed in the direction of the illustrated arrow b, whereby the operating lever spring 1244 is pushed against the pin 1242*c* and elastically deformed in the direction of the illustrated arrow c. Therefore, the actuation lever 1242 is moved in the direction of an illustrated arrow d as a whole by being guided by the through hole 1242*b* and the pin 1242*e*. Additionally, the extreme end 1242*d* of the actuation lever 1242 comes into contact with and pushed against the sides of a tooth 1240*a* of the actuation cam 1240, thereby rotating the actuation cam 1240 in the direction of an illustrated arrow e.

At the same time, the phase of the sides of the columns section 1240*b* is displaced from that of the projection 1243*b* of the switch lever A 1243 by the rotation of the actuation cam 1240. When the displacement reaches the gap between columns 1240*b*, the projection 1243*b* is urged into the gap by the restoring force of the spring section 1243*c*. Therefore, the switch section 1243*a* of the switch lever A 1243 is rotated in the direction of an arrow f and comes into contact with the start circuit of the circuit board 1704 so that the start circuit is electrically conductive.

At the time, the same extreme end 1241*a* of the actuation cam jumper 1241 is pushed upward by a tooth 1240*a* of the actuation cam 1240.

Then, the above operation is continued until the teeth 1240*a* of the actuation lever 1242 is fed one pitch.

Figure 45:
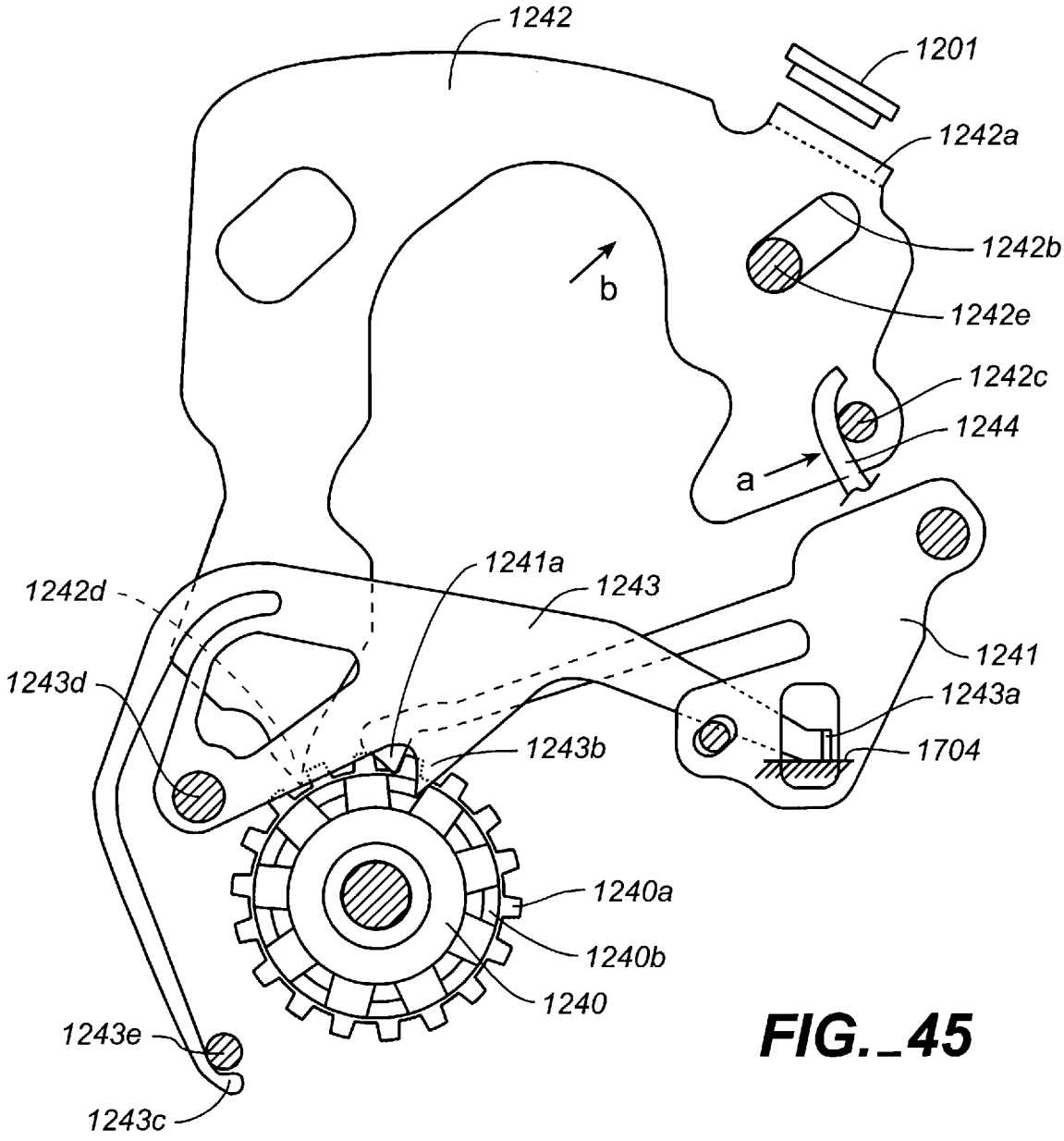
FIG. 45 is a third plan view showing an example of the operation of the start/stop actuating mechanism of the reset to zero mechanism of FIG. 42.

Thereafter, when a user hand is released from the start/stop button 1201, it is automatically returned to its original state by a spring contained therein as shown in FIG. 45. Then, the pin 1242*c* of the actuation lever 1242 is pressed in the direction of the illustrated arrow a by the restoring force of the operating lever spring 1244. Accordingly, the actuation lever 1242 is moved as a whole in the direction of the illustrated arrow b by being guided by the through hole 1242*b* and the pin 1242*e* until an end of the through hole 1242*b* comes into contact with the pin 1242*e* and is returned to the state of a position similar to that shown in FIG. 43.

Since the same projection 1243*b* of the switch lever A 1243 remains between columns 1240*b* of the actuation cam 1240 at the time, the switch section 1243*a* is in contact with the start circuit of the circuit board 1704, and thus the electric conductive state of the start circuit is maintained. Therefore, the chronograph is maintained in the start state.

At the time, the extreme end 1241*a* of the actuation cam jumper 1241 enters between teeth 1240*a* of the actuation cam 1240 to thereby regulate the reverse rotation of the actuation cam 1240.

On the other hand, when the chronograph is to be stopped, operation similar to the above start operation is carried out so that the state shown in FIG. 43 is finally restored.

As described above, the actuation lever 1242 is rotated by swinging the actuation lever 1242 by pushing the start/stop button 1201, whereby the start/stop of the chronograph can be controlled by swinging the switch lever A 1243.

As shown in FIG. 40, the reset actuation mechanism comprises the actuation cam 1240, a transmission lever 1251, an operating lever 1251, a hammer operating lever 1252, a hammer intermediate lever 1253, a hammer start lever 1254, an operating lever spring 1244, a hammer intermediate lever spring 1255, a hammer jumper 1256, and a switch lever b1257. Further, the reset actuation mechanism comprises a heart cam A 1261, a reset to zero lever A 1262, a reset to zero lever A spring 1263, a heart cam B 1264, a reset to zero lever B 1265, a reset to zero lever B spring 1266, a heart cam C 1267, a reset to zero lever C 1268, a reset to zero lever C spring 1269, a heart cam D 1270, a reset to zero lever D 1271, and a reset to zero lever D spring 1272.

The chronograph reset actuation mechanism is arranged such that it is not actuated when the chronograph is set to the stop state. The mechanism is called a safety mechanism. First, the operating lever 1251, the hammer operating lever 1252, the hammer intermediate lever 1253, the operating lever spring 1244, the hammer intermediate lever spring 1255, and the hammer jumper 1256 which constitute the safety mechanism will be described with reference to FIG. 46. Note that the hammer intermediate lever spring 1255 and the hammer jumper 1256 are omitted in the figure.

The operating lever 1251 is formed in an approximately flat-Y-shape and has a press section 1251*a* at an end and an oval through hole 1251*b* at an end of a fork, and a pin 1251*c* is interposed between the press section 1251*a* and the through hole 1251*b*. The operating lever 1251 is arranged as the reset actuation mechanism in such a manner that the press section 1251*a* is caused to be in contact with the reset button 1202, the pin 1252*c* of the hammer operating lever 1252 is inserted into the through hole 1251*b*. The other end of the fork is rotatably journaled by a pin 1251*d* fixed to the movement side and the other end of the operating lever spring 1244 is engaged against the pin 1251*c*.

The hammer operating lever 1252 is arranged such that a first hammer operating lever 1252*a* of an approximately rectangular flat-plate-shape overlaps a second hammer operating lever 1252 and is journaled by a rotatable shaft 1252*g* at an approximate center thereof each other so as to rotate. The pin 1252*c* disposed at an end of the first hammer operating lever 1252*a*, and press sections 1252*d* and 1252*e* are formed at both the ends of the second hammer operating lever 1252*b*, respectively. The hammer operating lever 1252 is arranged as the reset actuation mechanism in such a manner that the pin 1252*c* is inserted into the through hole 1251*b* of the operating lever 1251, the other end of the first hammer operating lever 1252*a* is rotatably journaled by a pin 1252*f* fixed to the third intermediate receiving plate 2003. Further the press section 1252*d* is caused to be in contact with the press section 1253*c* of the hammer intermediate lever 1253, and the press section 1252*e* is disposed in the vicinity of the actuation cam 1240.

The hammer intermediate lever 1253 is formed in an approximately rectangular flat shape and has pins 1253*a* and 1253*b* disposed at an end and an intermediate section, respectively. In addition, one of the corner portions of the other end of the hammer intermediate lever 1253 is formed as the press section 1253*c*. The hammer intermediate lever 1253 is arranged as the reset actuation mechanism in such a manner that an end of the hammer intermediate lever spring 1255 is engaged against the pin 1253*a*. An end of the hammer jumper 1256 is engaged against the pin 1253*b*, the press section 1253*c* is caused to be in contact with the press section 1252*d* of the second hammer operating lever 1252*b*, and the other corner portion of the other end is rotatably journaled by a pin 1253*d* fixed to the third intermediate receiving plate 2003.

An example of operation of the safety mechanism arranged as described above will be described with reference to FIG. 46 to FIG. 49.

Figure 46:
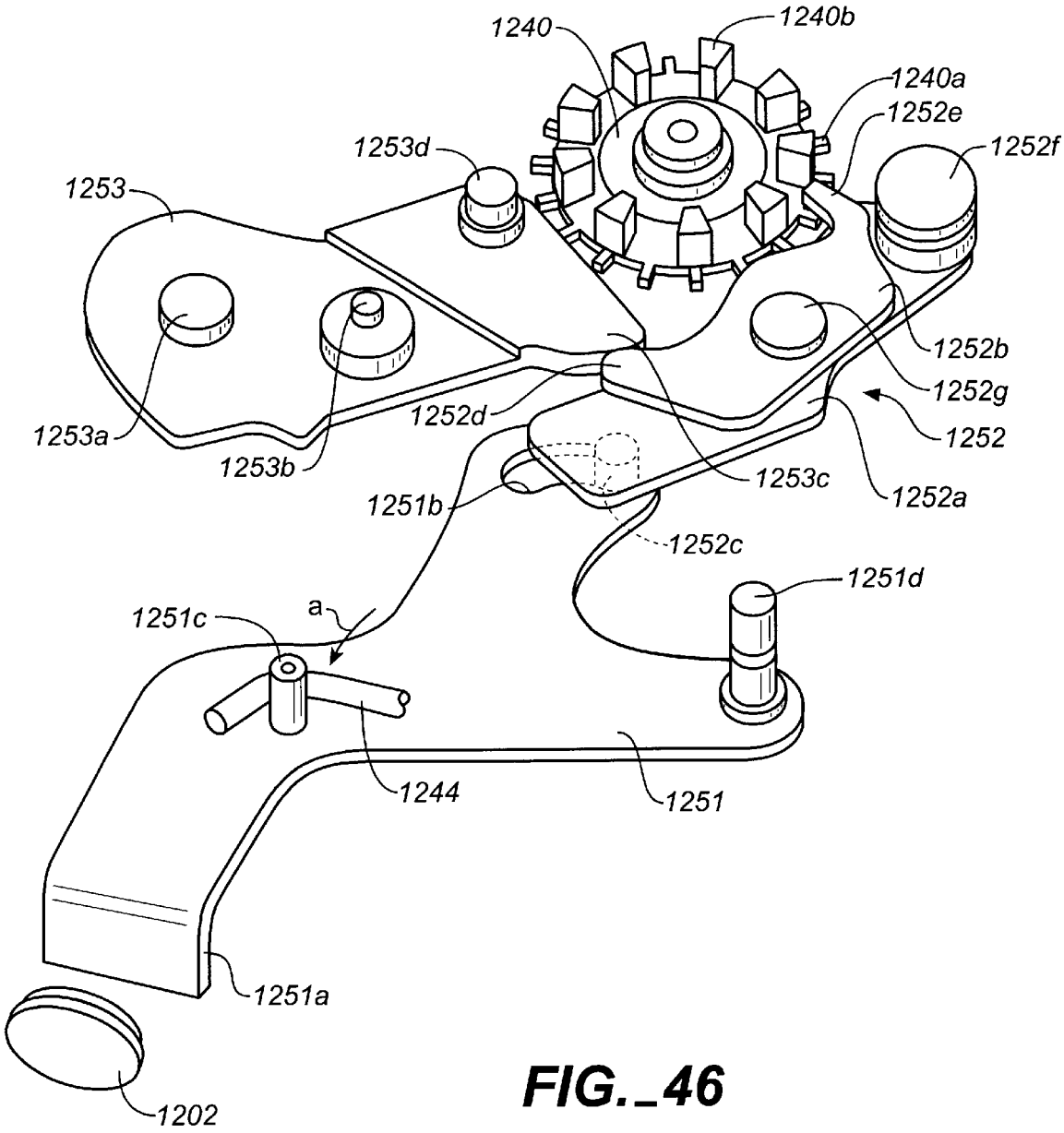
FIG. 46 is a first perspective view showing an example of the operation of the safety mechanism of the reset to zero mechanism of FIG. 42.

When the chronograph is in the start state, the operating lever 1251 is positioned in the state in which the press section 1251*a* is separated from the reset button 1202 and the pin 1251*c* is pushed in the direction of an illustrated arrow a by the elastic force of the operating lever spring 1244 as shown in FIG. 46. At the same time, the press section 1252*e* of the second hammer operating lever 1252*b* is positioned outwardly of the gap between columns 1240*b* of the actuation cam 1240.

Figure 47:
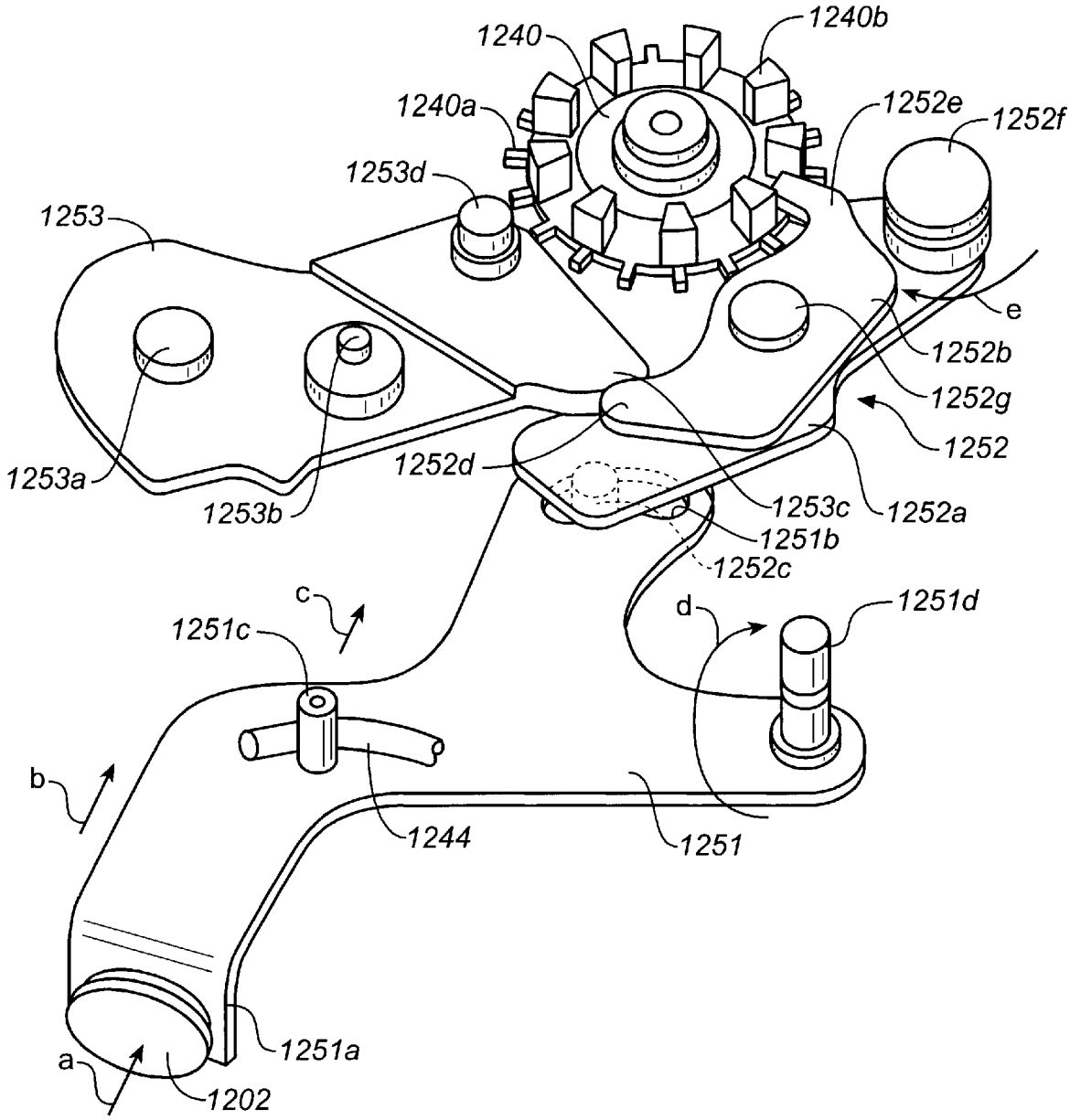
FIG. 47 is a second perspective view showing an example of the operation of the safety mechanism of the reset to zero mechanism of FIG. 42.

When the reset button 1202 is pressed in the direction of the illustrated arrow a in this state as shown in FIG. 47, the press section 1251*a* of the operating lever 1251 comes into contact with the reset button 1202 and pressed in the direction of an arrow b, whereby the pin 1251*c* presses the operating lever spring 1244 and elastically deforms it in the direction of an arrow c. Therefore, the actuation lever 1251 is rotated as a whole in the direction of an illustrated arrow d about the pin 1251*d*. Since the pin 1252*c* of the first hammer operating lever 1252*a* is moved along the through hole 1251*b* of the operating lever 1251 by the rotation, the first hammer operating lever 1252*a* is rotated in the direction of an illustrated arrow e about the pin 1252*f*.

At the same time, since the press section 1252*e* of the second hammer operating lever 1252*b* enters the gap between columns 1240*b* of the actuation cam 1240, even if the press section 1252*d* comes into contact with the press section 1253*c* of the hammer intermediate lever 1253, the second hammer operating lever 1252*b* is rotated about the shaft 1252*g* and stroke is absorbed. Thus, the press section 1253*c* is not pressed by the press section 1252*d*. Therefore, the manipulating force of the reset button 1202 is interrupted by the hammer operating lever 1252 and is not transmitted to the reset actuation mechanism located rearward of the hammer intermediate lever 1253 to be described later. Accordingly, even if the reset button 1202 is erroneously pressed when the chronograph is in the start state, the chronograph is prevented from being reset.

Figure 48:
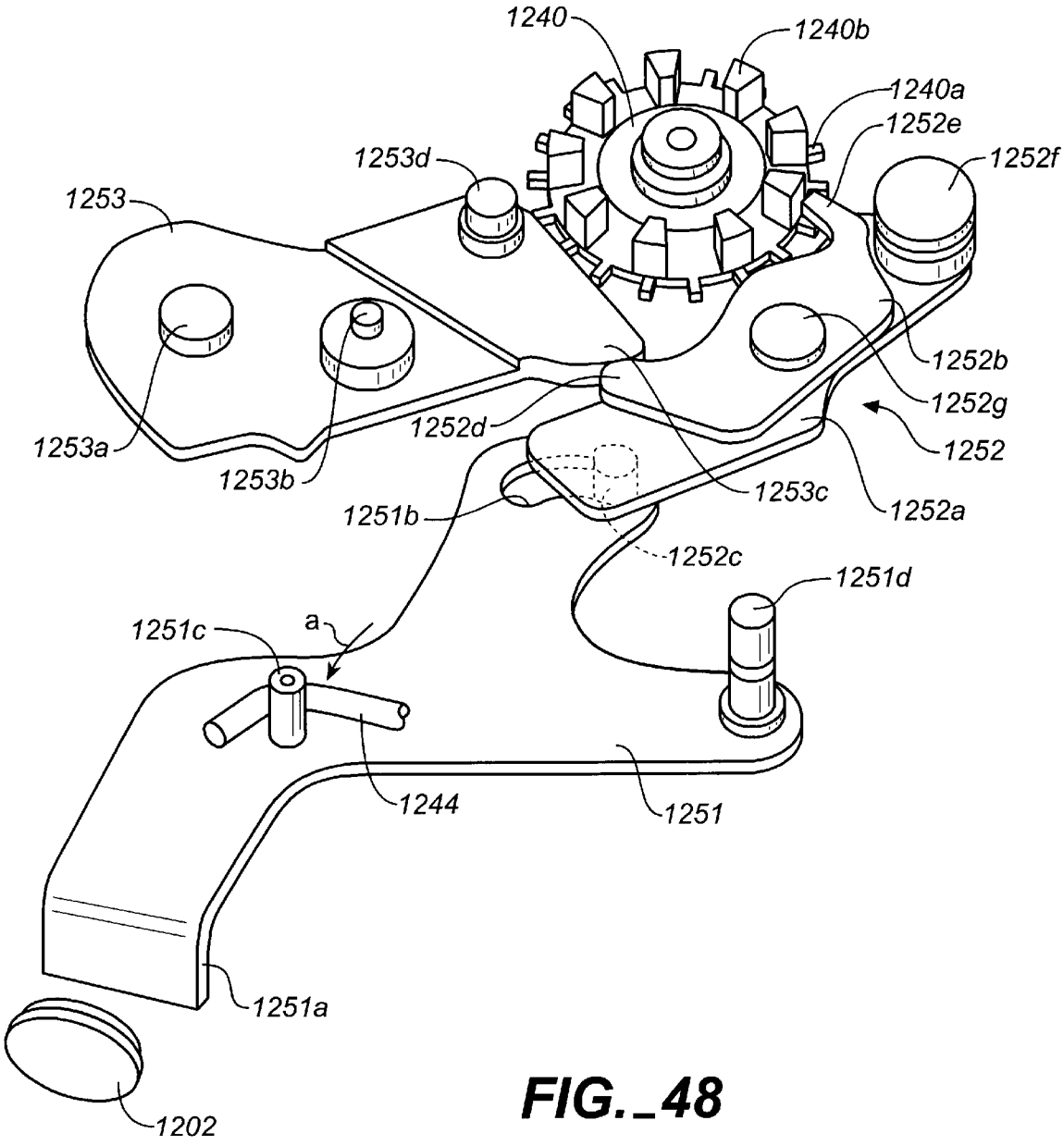
FIG. 48 is a third perspective view showing an example of the operation of the safety mechanism of the reset to zero mechanism of FIG. 42.

When the chronograph is in the stop state, the operating lever 1251 is positioned in the state in which the press section 1251*a* is separated from the reset button 1202 and the pin 1251*c* is pressed in the direction of an illustrated arrow a by the elastic force of the operating lever spring 1244 as shown in FIG. 48. At the same time, the press section 1252*e* of the second hammer operating lever 1252*b* is in contact with the side of a column 1240*b* of the actuation cam 1240.

Figure 49:
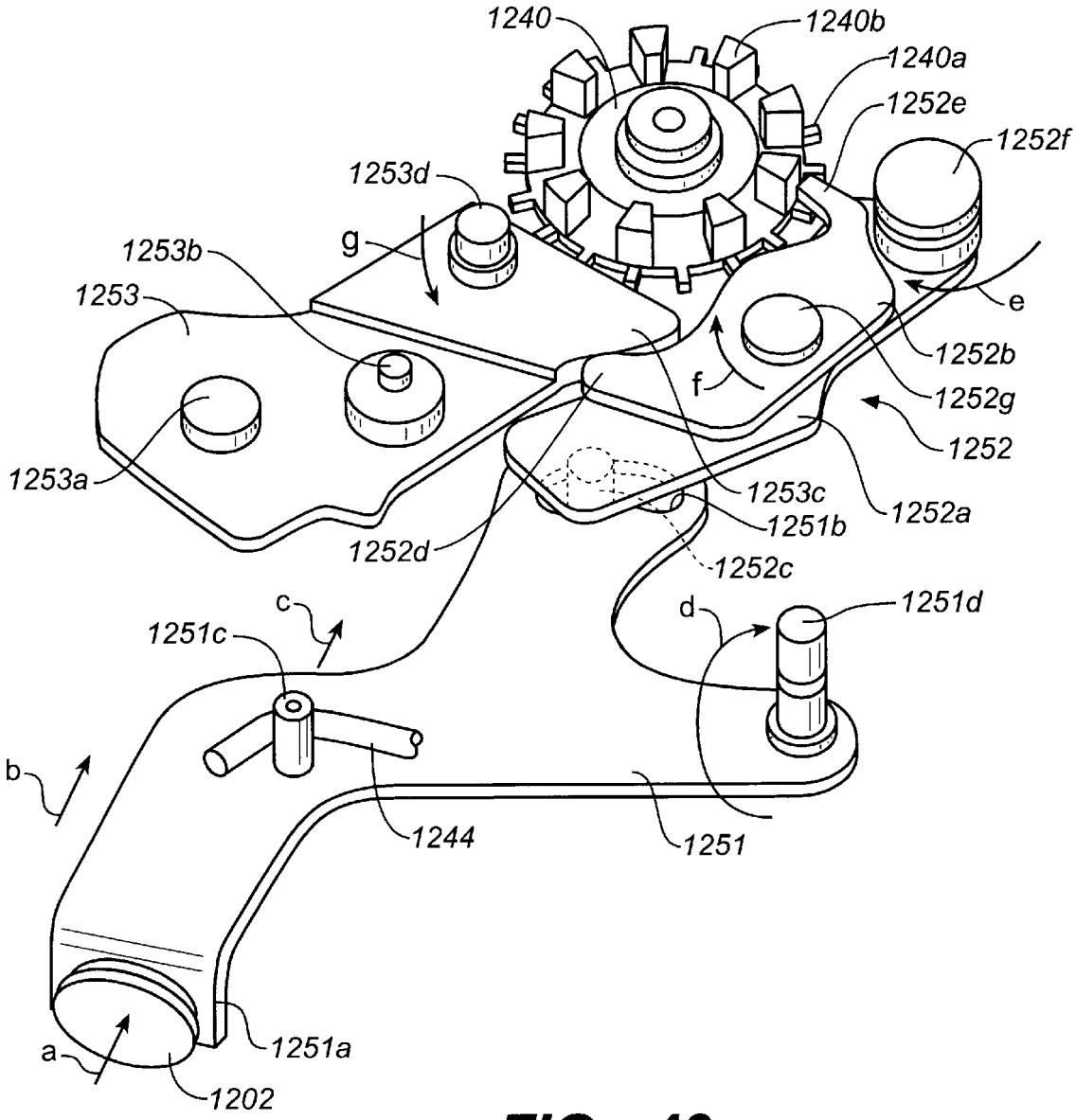
FIG. 49 is a fourth perspective view showing an example of the operation of the safety mechanism of the reset to zero mechanism of FIG. 42.

When the reset button 1202 is pressed with a hand in the direction of an illustrated arrow a in this state as shown in FIG. 49, the press section 1251*a* of the operating lever 1251 comes into contact with the reset button 1202 and is pressed in the direction of an arrow b, whereby the pin 1251*c* presses the operating lever spring 1244 and elastically deforms it in the direction of an arrow c. Therefore, the actuation lever 1251 is rotated as a whole in the direction of an illustrated arrow d about the pin 1251*d*. Since the pin 1252*c* of the first hammer operating lever 1252*a* is moved along the through hole 1251*b* by the rotation, the first hammer operating lever 1252*a* is rotated in the direction of an illustrated arrow e about the pin 1252*f*.

Since the press section 1252*e* of the second hammer operating lever 1252*b* is stopped by the side of a column 1240*b* of the actuation cam 1240, the second hammer operating lever 1252*b* is rotated in the direction of the illustrated arrow f about the shaft 1252*g*. Since the rotation causes the press section 1252*d* of the second hammer operating lever 1252*b* to come into contact with and pushes the press section 1253*c* of the hammer intermediate lever 1253 and to press it, the hammer intermediate lever 1253 is rotated in the direction of the illustrated arrow g about the pin 1253*d*. Therefore, since the manipulating force of the reset button 1202 is transmitted to the reset actuation mechanism located rearward of the hammer intermediate lever 1253 , the chronograph can be reset by pressing the reset button 1202 when the chronograph is in the stop state. Note that when the chronograph is reset, the contact of the switch lever B 1257 comes into contact with the reset circuit of the circuit board 1704, whereby the chronograph is electrically reset.

Next, description will be made with reference to FIG. 50 as to the hammer start lever 1254, the heart cam A 1261, the reset to zero lever A 1262, the reset to zero lever A spring 1263, the heart cam B 1264, the reset to zero lever B 1265, the reset to zero lever B spring 1266, the heart cam C 1267, the reset to zero lever C 1268, the reset to zero lever C spring 1269, the heart cam D 1270, the reset to zero lever D 1271, and the reset to zero lever D spring 1272 which constitute the main mechanisms of the chronograph reset actuation mechanism shown in FIG. 40.

The hammer start lever 1254 is formed in one approximate flat-I-shape and has an end at which an oval through hole 1254*a* is formed and another end at which a lever D suppressing section 1254*b* is formed. Further, the hammer start lever 1254 has a lever B suppressing section 1254*c* and a lever C suppressing section 1254*d* formed at the center thereof. The hammer start lever 1254 is arranged as the reset actuation mechanism in such a manner that the central portion thereof is rotatably fixed and the pin 1253*b* of the hammer intermediate lever 1253 is inserted into the through hole 1254*a*.

The heart cams A 1261, B 1264, C 1267, and D 1270 are fixed to the respective rotating shafts of the 1/10 second CG wheel 1232, the one second CG wheel 1223, the minute CG wheel 1216, and the hour CG wheel 1217, respectively.

An end of the reset to zero lever A 1262 is arranged as a hammer unit 1262*a* for striking the heart cam A 1261, the other end thereof is provided with a rotation regulating section 1262*b*, and the central portion thereof is provided with a pin 1262*c*. The reset to zero lever A 1262 is arranged as the reset actuation mechanism in such a manner that the other end is rotatably journaled about the pin 1253*d* fixed to the third intermediate receiving plate 2003 and an end of the reset to zero lever A spring 1263 is engaged against the pin 1262*c*.

An end of the reset to zero lever B 1265 is formed as a hammer unit 1265*a* for striking the heart cam B 1264, the other end is provided with a rotation regulating section 1265*b* and a press section 1265*c*, and a central portion is provided with a pin 1265*d*. The reset to zero lever B 1265 is arranged as the reset actuation mechanism in such a manner that the other end is rotatably journaled by the pin 1253*d* fixed to the third intermediate receiving plate 2003 and an end of the reset to zero lever B spring 1266 is engaged against the pin 1265*d*.

An end of the reset to zero lever C 1268 is arranged as a hammer unit 1268*a* for striking the heart cam B 1267, the other end is provided with a rotation regulating section 1268*b* and a press section 1268*c*, and the central portion is provided with a pin 1268*d*. The reset to zero lever C 1268 is arranged as the reset actuation mechanism in such a manner that the other end is rotatably journaled about a pin 1268*e* fixed to the third intermediate receiving plate 2003 and an end of the reset to zero lever C spring 1269 is engaged against the pin 1268*d*.

An end of the reset to zero lever D 1271 is arranged as a hammer unit 1271*a* for striking the heart cam D 1270, and the other end is provided with a pin 1271*b*. The reset to zero lever D 1271 is arranged as the reset actuation mechanism in such a manner that the other end is rotatably journaled by a pin 1271*c* fixed to the third intermediate receiving plate 2003 and an end of the reset to zero lever D spring 1272 is engaged against the pin 1271*b*.

An example of operation of the reset actuation mechanism arranged as described above will be explained with reference to FIGS. 50 and 51.

Figure 50:
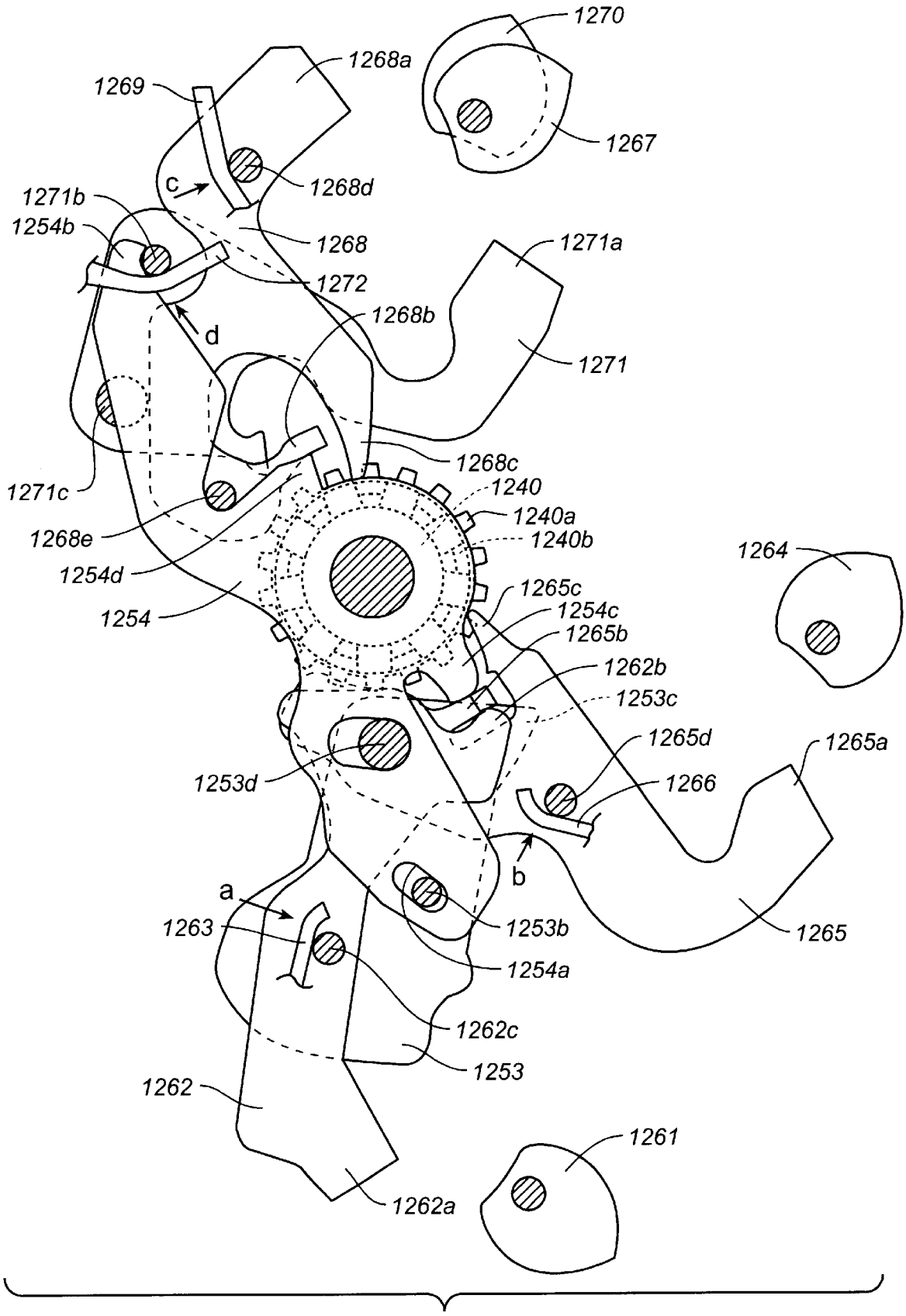
FIG. 50 is a first plan view showing an example of the operation of the main mechanism of the reset actuating mechanism of the reset to zero mechanism of FIG. 42.
Figure 51:
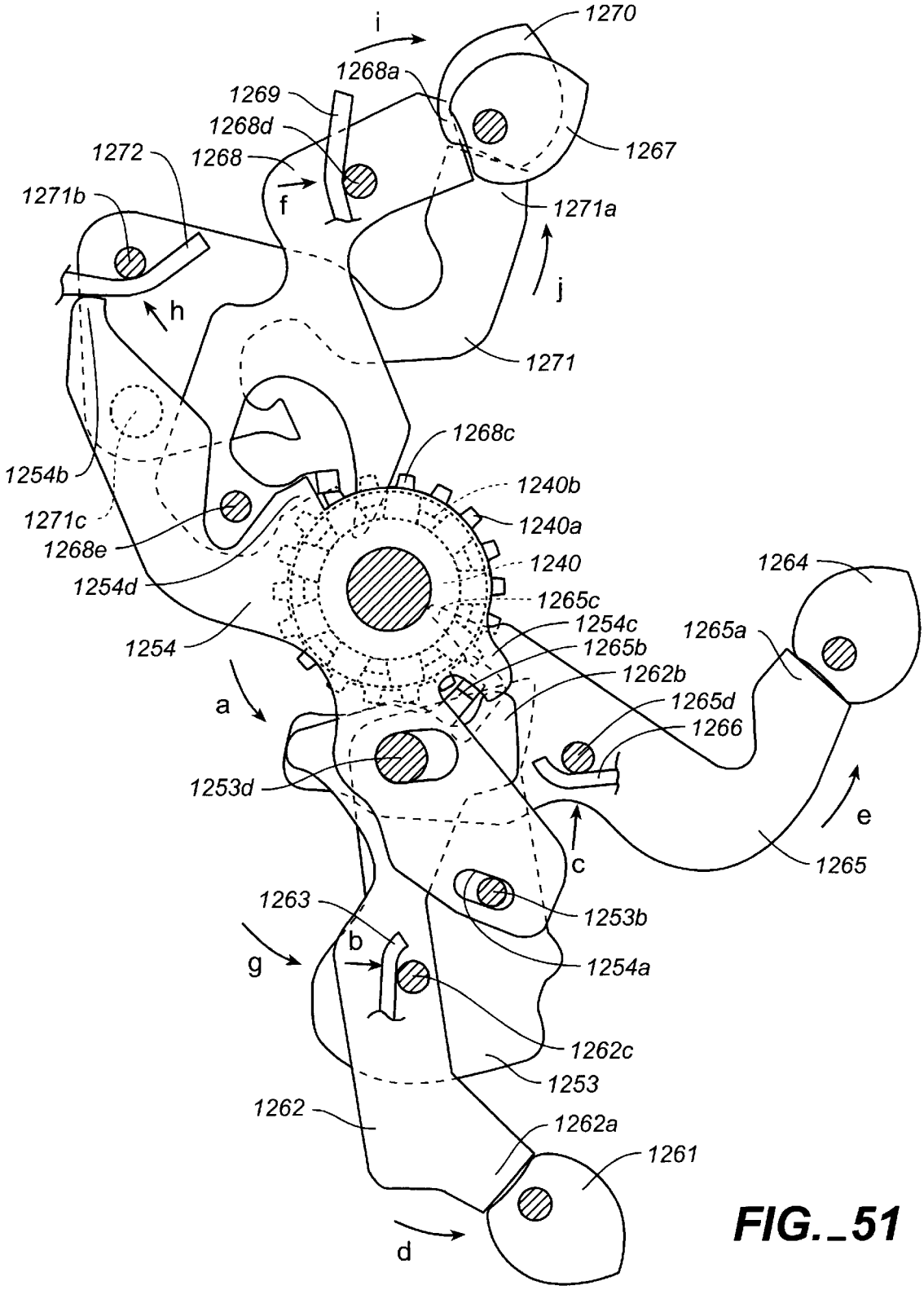
FIG. 51 is a second plan view showing an example of the operation of the main mechanism of the reset actuating mechanism of the reset to zero mechanism of FIG. 42.

When the chronograph is in the stop state, the reset to zero lever A 1262 is positioned in the state in which the rotation regulating section 1262*b* is locked to the rotation regulating section 1265*b* of the reset to zero lever B 1265, and the pin 1262*c* is biased in the direction of the illustrated arrow a by the elastic force of the operating lever spring 1263 as shown in FIG. 50.

The reset to zero lever B 1265 is positioned in the state in which the rotation regulating section 1265*b* is locked to the lever B suppressing section 1254*c* of the hammer start lever 1254, the press section 1265*c* is pushed against the side of a column section 1240*b*, and the pin 1265*d* is pushed in the direction of an illustrated arrow b by the elastic force of the reset to zero lever B spring 1266.

The reset to zero lever C 1268 is positioned in the state in which the rotation regulating section 1268*b* is engaged against the lever C suppressing section 1254*d* of the hammer start lever 1254, the press section 1268*c* is pushed against the side of a column 1240*b* of the actuation cam 1240, and the pin 1268*d* is pressed in the direction of the illustrated arrow c by the elastic force of the reset to zero lever C spring 1269.

The reset to zero lever D 1271 is positioned in the state in which the pin 1271*b* is engaged against the lever D suppressing section 1254*b* of the hammer start lever 1254 and is also pushed in the direction of an illustrated arrow d by the elastic force of the reset to zero lever D spring 1272.

Therefore, the respective hammer unit 1262*a*, 1265*a*, 1286*a*, and 1271*a* of the reset to zero levers A 1262, B 1265, C 1268, and D 1271 are positioned by being spaced apart from the respective heart cams A 1261, B 1264, C 1267, and D 1270 a predetermined distance.

When the hammer intermediate lever 1253 is rotated in the direction of the illustrated arrow g about the pin 1253*d* in this state as shown in FIG. 49, since the pin 1253*b* of the hammer intermediate lever 1253 is moved in the through hole 1254*a* of the hammer start lever 1254 while pushing the through hole 1254*a* of the hammer start lever 1254 in the through hole 1254*a*, the hammer start lever 1254 is rotated in the direction of the illustrated arrow a.

Thus, the rotation regulating section 1265*b* of the reset to zero lever B 1265 is removed from the lever B suppressing section 1254*c* of the hammer start lever 1254, and the press section 1265*c* of the reset to zero lever B 1265 enters the gap between column sections 1240*b* of the actuation cam 1240. With this operation, the pin 1265*d* of the reset to zero lever B 1265 is pushed in the direction of the illustrated arrow c by the restoring force of the reset to zero lever B spring 1266.

At the same time, the regulation of the rotation regulating section 1262*b* is released and the pin 1262*c* of the reset to zero lever A 1262 is pushed in the direction of the illustrated arrow b by the restoring force of the reset to zero lever A spring 1263. Therefore, the reset to zero lever A 1262 and the reset to zero lever B 1265 are rotated in the directions of illustrated arrows d and e about the pin 1253*d*, and the respective hammer units 1262*a* and 1265*a* strike the respective heart cams A 1261 and B 1264 and rotate them, and reset the 1/10 second chronograph hand 1231 and the one second chronograph hand 1221 to zero, respectively.

At the same time, the rotation regulating section 1268*b* of the reset to zero lever C 1268 is removed from the lever C suppressing section 1254*d* of the hammer start lever 1254, the press section 1268*c* of the reset to zero lever C 1268 enters the gap between columns 1240*b* of the actuation cam 1240, and the pin 1268*d* of the reset to zero lever C 1268 is pushed in the direction of an illustrated arrow f by the restoring force of the reset to zero lever C spring 1269. Further, the pin 1271*b* of the reset to zero lever D 1271 is removed from the lever D suppressing section 1254*b* of the hammer start lever 1254. With this operation, the pin 1271*b* of the reset to zero lever D 1271 is pushed in the direction of an illustrated arrow h by the restoring force of the reset to zero lever D spring 1272. Therefore, the reset to zero lever C 1268 and the reset to zero lever D 1271 are rotated in the directions of illustrated arrows i and i about the pin 1268*e* and the pin 1271*c*, respectively. The respective hammer units 1268*a* and 1271*a* strike and rotate the heart cams C 1267 and D 1270 and reset the 1/10 second chronograph hand 1231 and the one second chronograph hand 1221 to zero, respectively.

With a series of the above operation, when the chronograph is in the stop state, the chronograph can be reset by pressing the reset button 1202. As described above, the 12 hours display section 1210, the 60 seconds display section 1220, and the one second display section 1230 are radially disposed at the positions which are equally apart from the center of the main body of the timepiece 1000 and the actuation cam 1240 is disposed the approximate center of the main body of the timepiece 1000. Accordingly, the reset to zero mechanism 1200R can be arranged compact as a whole and the main body of the timepiece 1000 can be reduced in size. Further, the reset to zero lever A 1262, the reset to zero lever B 1265, the reset to zero lever C 1268, and the reset to zero lever D 1271 have approximately the same lengths and the respective reset to zero levers can be operated by the single actuation cam 1240. Thus, it is possible to design the respective reset to zero levers so that they strike heart cams A 1261, B 1261, C 1267, and D 1270 with the same torque and the same timing and to use the same hands as the respective chronograph hands 1231, 1221, 1211 and 1212, whereby accuracy can be more enhanced.

Figure 52:
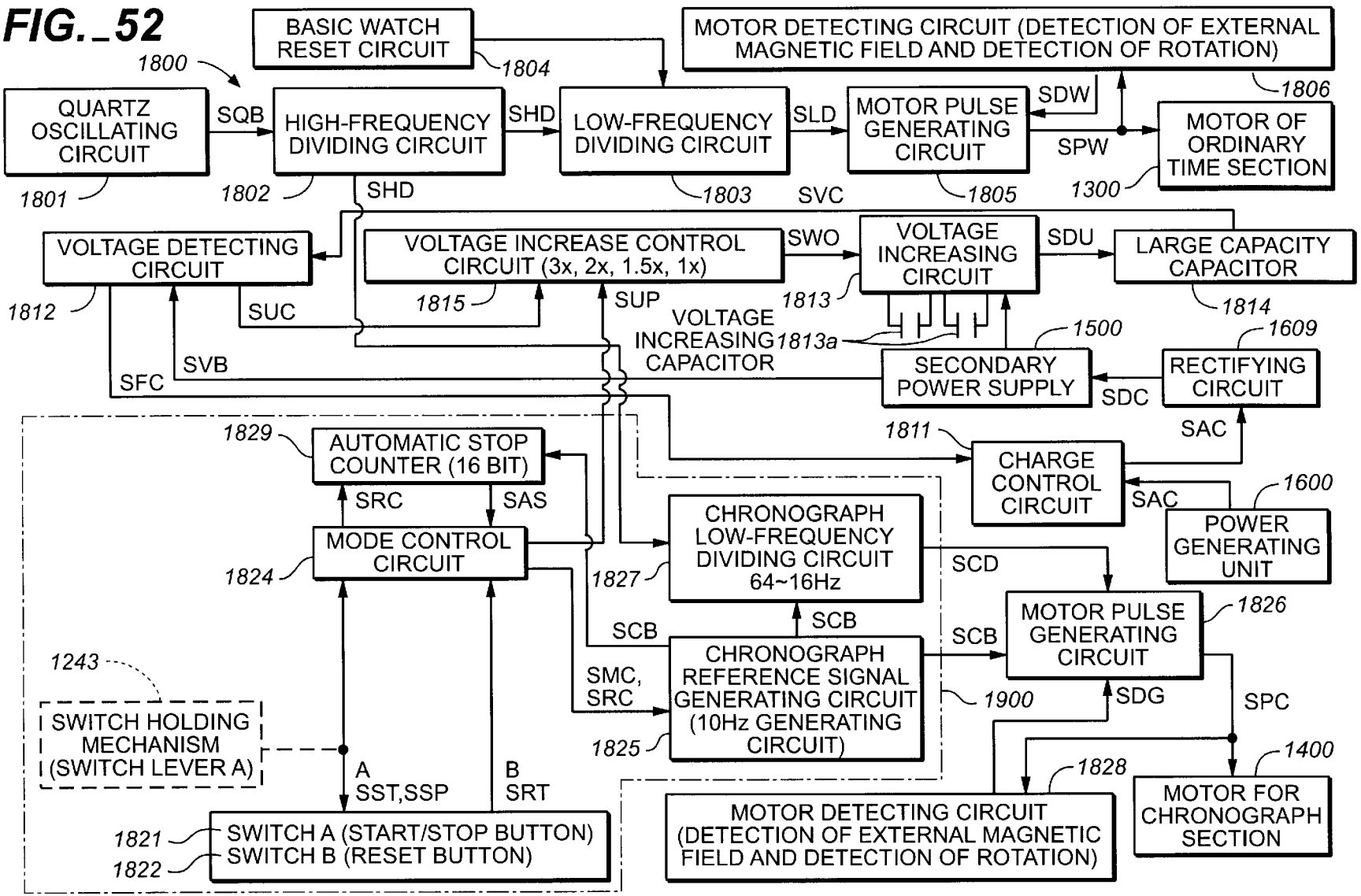
FIG. 52 is a schematic block diagram showing an example of the arrangement of a control circuit used in the timepiece of FIG. 36.
Figure 53:
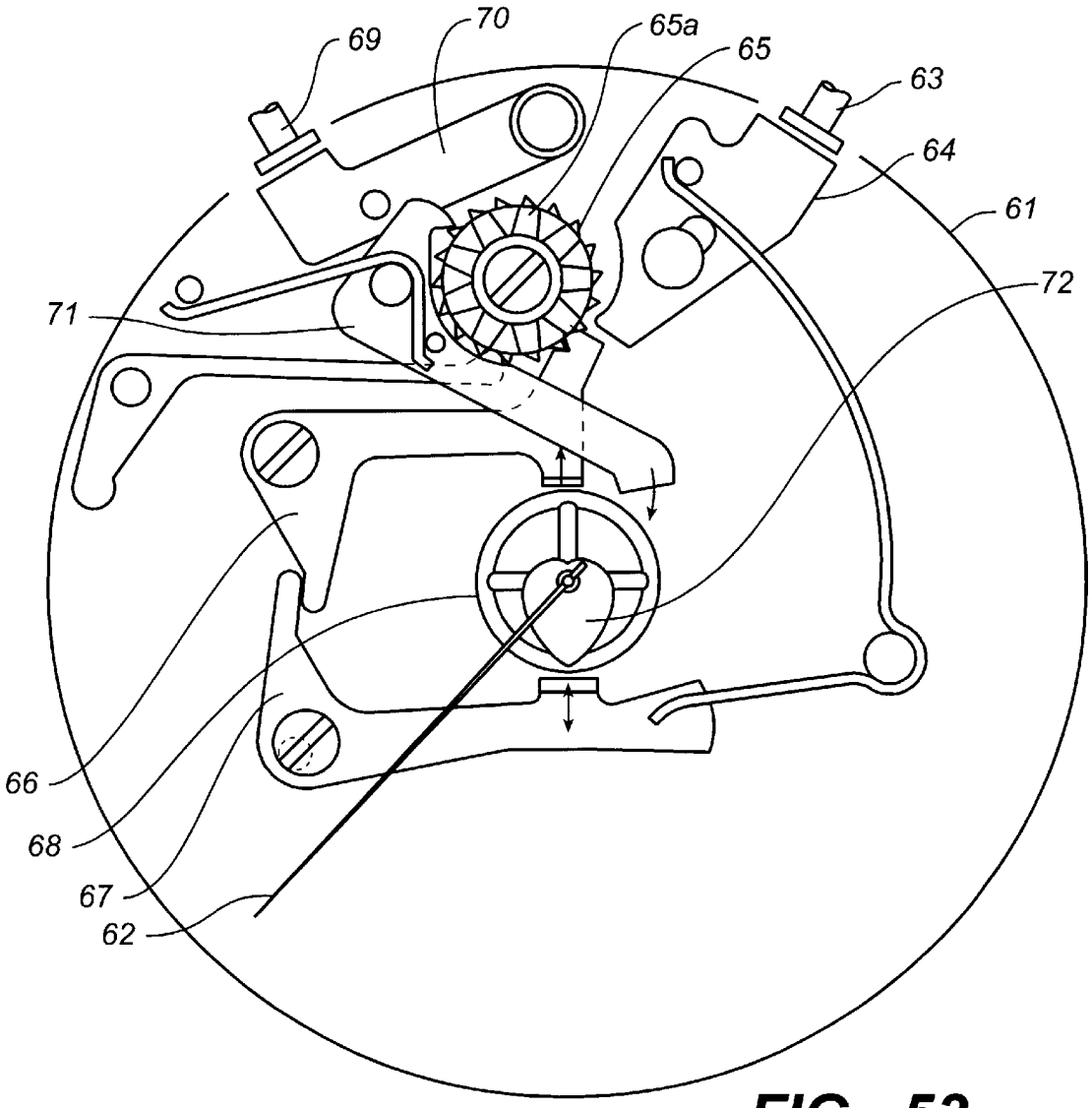
FIG. 53 (PRIOR ART)
FIG. 53 is a plan view showing an example of the reset to zero mechanism of a conventional timepiece.

FIG. 52 is a schematic block diagram showing an example of the arrangement of the system as a whole excluding the mechanical portion of the timepiece 1000 of FIG. 36.

A signal SQB having an oscillating frequency of, for example, 32 kHz, which is output from a quartz oscillating circuit 1801 including the tonometer type quartz resonator 1703, is input to a high frequency dividing circuit 1802 and divided to frequencies from 16 kHz to 128 Hz. A signal SHD divided by the frequency dividing circuit 1802 is input to a low frequency dividing circuit 1803 and divided to frequencies from 64 Hz to 1/80 Hz. Note that the frequency generated by the low frequency dividing circuit 1803 can be reset by a basic watch reset circuit 1804 connected to the low frequency dividing circuit 1803.

A signal SLD divided by the low frequency dividing circuit 1803 is input to a motor pulse generating circuit 1805 as a timing signal, and when the divided signal SLD is made active at, for example, each 1 second or 1/10second, pulses for driving a motor and pulses SPW for detecting the rotation and the like of the motor are created. The motor drive pulses SPW created by the motor pulse generating circuit 1805 are supplied to the motor 1300 of the ordinary time measuring section 1100 so as to drive the motor. Further, the pulses SPW for detecting the rotation of the motor and the like are supplied to a motor detecting circuit 1806 at a timing different from that of the above pulses so that the external magnetic field of the motor 1300 and the rotation of the rotor of the motor 1300 are detected. Then, the external magnetic field detecting signal and the rotation detecting signal SDW detected by the motor detecting circuit 1806 are fed back to the motor pulse generating circuit 1805.

The alternating voltage SAC generated by the power generating unit 1600 is input to the rectifying circuit 1609 through a charge control circuit 1811, subjected to, for example, half-wave rectification, made to a direct current voltage SDC and charged in the secondary power supply 1500. The voltage SVB across both ends of the secondary power supply 1500 is detected by the voltage detecting circuit 1812 at all time or when necessary. A corresponding charge control command SFC is input to the charge control circuit 1811 depending upon the excessive or insufficient state of the charged amount of the secondary power supply 1500. Then, the start/stop of the supply of the alternating voltage SAC generated by the power generating unit 1600 to a rectifying circuit 1609 is controlled in response to the charge control command SFC.

In contrast, the direct current voltage SDC charged in the secondary power supply 1500 is input to a voltage increase circuit 1813 including a voltage increasing capacitor 1813*a* and increased to a predetermined times of a voltage. Then, the increased direct current voltage SDU is charged in a large capacitance capacitor 1814.

The voltage increase is a means for securing reliable operation even if the voltage of the secondary power supply 1500 is lower than the operating voltage of the motors and circuits. That is, the motors and the circuits are driven by the electric energy stored in the large capacity capacitor 1814. However, when the voltage of the secondary power supply 1500 is increased to an approximate 1.3V, the large capacity capacitor 1814 and the secondary power supply 1500 are used by being connected in parallel with each other.

The voltage SVC across both ends of the large capacity capacitor 1814 is detected by the voltage detecting circuit 1812 at all times or when necessary, and a corresponding voltage increase command SUC is input to a voltage increase control circuit 1815 depending upon the remaining state of the amount of electricity in the large capacity capacitor 1814. Then, a voltage increasing ratio SWC in the voltage increase circuit 1813 is controlled based on the voltage increase command SUC. The voltage increasing ratio means a multiplying ratio when the voltage of the secondary power supply 1500 is increased and generated by the large capacity capacitor 1814 and controlled at a multiplying ratio of 3 times, 2 times, 1.5 times, 1 time and the like when it is represented by (voltage of the large capacity capacitor 1814)/(voltage of the secondary power supply 1500).

The start signal SST, the stop signal SSP and the reset signal SRT, which are supplied from the switch A 1821 provided with the start/stop button 1201 and the switch B 1822 provided with the reset button 1202, are input to a mode control circuit 1824 for controlling the respective modes in the chronograph through either a switch input circuit 1823, which determines whether the start/stop button 1201 is pressed or not, or a switch input circuit/chattering prevention circuit 1823, which determines whether the reset button 1202 is pressed or not. Note that switch A 1821 includes a switch lever A 1243 as a switch holding mechanism, and switch B 1822 includes a switch lever B 1257.

Further, the signal SHD divided by the frequency dividing circuit 1802 is also input to the mode control circuit 1824. Then, a start/stop control signal SMC is supplied from the mode control circuit 1824 in response to the start signal SST. The chronograph reference signal SCB created by a chronograph reference signal generating circuit 1825 is input to the motor pulse generating circuit 1826 in response to the start/stop control signal SMC.

On the other hand, the chronograph reference signal SCB created by the chronograph reference signal generating circuit 1825 is also input to a chronograph low frequency dividing circuit. The signal SHD divided by the frequency dividing circuit 1802 is divided from a frequency of 64 Hz to a frequency of 16 Hz in synchronism with the chronograph reference signal SCB. Then, the signal SCD divided by the frequency dividing circuit 1827 is input to the motor pulse generating circuit 1826.

Then, the chronograph reference signal SCB and the dividing signal SCD are input to the motor pulse generating circuit 1826 as timing signals. For example, the dividing signal SCD is made active in response to the output timing of the chronograph reference signal SCB which is issued, for example, each 1/10 second or 1 second, and pulses for driving a motor and pulses SPC for detecting the rotation and the like of the motor are created in response to the dividing signal SCD and the like. The motor drive pulses SPC created by the motor pulse generating circuit 1826 is supplied to the chronograph motor 1400 so as to drive it. Further, the pulse SPC for detecting the rotation and the like of the motor is supplied to a motor detecting circuit 1828 at a timing different from that of the above pulse so that the external magnetic field of the motor 1400 and the rotation of the rotor of the motor 1400 are detected. Then, the external magnetic field detecting signal and the rotation detecting signal SDG detected by the motor detecting circuit 1828 are fed back to the motor pulse generating circuit 1826.

Further, the chronograph reference signal SCB created by the chronograph reference signal generating circuit 1825 is also input to an automatic stop counter 1829 of, for example, 16 bits and counted thereby. Then, when the count reaches a predetermined count value, that is, a measurement limit time is reached, an automatic stop signal SAS is input to the mode control circuit 1824. At that time, the stop signal SSP is input to the chronograph reference signal generating circuit 1825, whereby the chronograph reference signal generating circuit 1825 is stopped and reset.

Further, when the stop signal SSP is input to the mode control circuit 1824, the output of the start/stop control signal SMC is stopped and the creation of the chronograph reference signal SCB also is stopped so that the drive of the chronograph motor 1400 is stopped. After the creation of the chronograph reference signal SCB is stopped, that is, after the creation of the start/stop control signal SMC, which will be described later, is stopped, the reset signal SRT, which has been input to the mode control circuit 1824, is supplied to the chronograph reference signal generating circuit 1825 and the automatic stop counter 1829 as a reset control signal SRC. Thus, the chronograph reference signal generating circuit 1825 and the automatic stop counter 1829 are reset as well as the respective chronograph hands are reset (to zero).

The present invention is by no means limited to the above embodiment and various modification can be made within the range which does not depart from claims.

For example, although the two motors, that is, the ordinary time drive motor 1300 and the chronograph drive motor 1400 are independently provided, respectively in the above embodiment, when the ordinary time unit and the chronograph unit are arranged so that they are driven by a single drive motor, it is possible to further reduce the size and to further save electric power.

Further, while the electronic watch having the analog display type chronograph function has been described as the timepiece, the present invention is not limited thereto and also is applicable to an analog display type multi-function timepiece.

As described above, according to the present invention, since the actuation cam is disposed at the approximate center of the main body of the timepiece, a useless space can be saved as well as the number of parts can be reduced and the size of the main body of the timepiece can be reduced by effectively disposing the reset to zero mechanism as a whole.

According to the present invention, the disposition of the indicator wheels, to which the indicator hands of the ordinary time display section and the time information display section are attached, to the peripheral portion of the approximate center of the main body of the timepiece permits the actuation cam to be disposed at the approximate center of the main body of the timepiece as well as the number of parts to be reduced, whereby the size of the main body of the timepiece can be reduced.

According to the present invention, the lengths of a plurality of the reset to zero levers can be made approximately the same and the respective reset to zero levers can be operated by the single actuation lever. Therefore, it is possible to design the respective reset to zero levers so that they strike the respective heart cams with the same torque at the same timing, to design the respective reset to zero levers so as to have the same torque and the same timing, and to use the same hands as the respective chronograph hands, whereby accuracy can be more enhanced and the cost of parts can be lowered. A plurality of hands are operated in a mechanical reset to zero structure, the failure of even one of the hands is critical. Accordingly, it is indispensable to maintain the same life and the same capability of the respective reset to zero levers by designing them so as to have the same structure and to operate at the same timing.

According to the present invention, since battery replacement and the like is unnecessary, maintenance cost is lowered. Additionally, as internal pollution and defective waterproofing, which may result during battery replacement, can be prevented.

According to the present invention, the effect of storage can be enhanced.

According to the present invention, since storage can be automatically carried out, an operation failure due to the sudden drop of the voltage of the power supply can be prevented in measurement so that the measurement can be carried out in a good state at all times.

According to the present invention, there can be provided a chronograph of small size which is not conventionally available and does not require replacement cell and the like. Further, a shock applied to the oscillating weight when the timepiece is dropped can be resisted by disposing the oscillating weight at the approximate center of the timepiece. Thus, the backlash of the chronograph and the backlash of the reset to zero mechanism can be secured and the timepiece can be normally operated. Furthermore, the disposition of the actuation cam at the approximate center permits the position of the button and the layout of the chronograph to be arbitrarily set.

According to the present invention, since at least two kinds of the time units can be displayed, time information of higher accuracy and time information of a long period of time can be obtained.

According to the present invention, since at least two kinds of the time units are mechanically displayed by the train wheels, the reliability of the display can be increased.

According to the present invention, the timepiece can be arranged as the small wrist watch which is not conventionally available and does not require replacing a cell and the like.

According to the present invention, since the timepiece is composed of a quartz, it can be arranged as the chronograph having pinpoint accuracy which cannot be obtained by conventional mechanical chronographs.

Industrial Applicability

As described above, the present invention is suitably used as a multi-function-timepiece and a time measuring method.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A timepiece having an ordinary time measuring section for measuring an ordinary time and a chronograph measuring section for measuring chronograph information, wherein the ordinary time measuring section has an ordinary time train wheel, an ordinary time drive unit including a first motor for driving the ordinary time train wheel and an ordinary time display unit including hands for indicating time, and the chronograph measuring section has chronograph train wheels, a chronograph drive unit including a second motor for driving the chronograph train wheels and a chronograph display unit including hands for indicating chronograph information, wherein the first motor and the second motor are independent of one another, and wherein the ordinary time display unit and the chronograph display unit are driven by a single quartz resonator, and w(herein the ordinary time display unit and the chronograph display unit are entirely disposed on a display surface of the timepiece without overlapping each other.

2. A timepiece according to claim 1, wherein at least one part of the ordinary time train wheel and at least one part of the ordinary time drive unit overlap on a plane.

3. A timepiece according to claim 1, wherein at least one part of the chronograph train wheels and at least one part of the chronograph drive unit overlap on a plane.

4. A timepiece according to claim 1, wherein at least one part of the ordinary time train wheel and at least one part of the ordinary time drive unit overlap on a first plane, and at least one part of the chronograph train wheels and at least one part of the chronograph drive unit overlap on a second plane which may be the same as or different than the first plane.

5. A timepiece according to claim 1, wherein the ordinary time display unit and the chronograph display unit are disposed at locations other than the approximate center of the display surface of the timepiece and the ordinary time display unit and the chronograph display unit are separately disposed at an outer peripheral location which has an arbitrary distance from the approximate center.

6. A timepiece according to claim 5, wherein the chronograph display unit comprises a plurality of chronograph display units, and wherein the ordinary display unit is disposed at a position of approximately 6 o'clock on the display surface of the timepiece and the plurality of chronograph display units are separately disposed at positions other than at the position of approximately 6 o'clock on the display surface of the timepiece.

7. A timepiece according to claim 6, wherein the chronograph display units are separately disposed at positions of approximately 2 o'clock, approximately 12 o'clock, and approximately 10 o'clock on the display surface of the timepiece, respectively.

8. A timepiece according to claim 1, wherein the ordinary time drive unit is an ordinary time motor which is disposed at a location corresponding to a position of approximately 6 o'clock on the display surface of the timepiece.

9. A timepiece according to claim 1, wherein the chronograph drive unit is a chronograph motor which is disposed at a location corresponding to a position between approximately 9 o'clock and approximately 12 o'clock on the display surface of the timepiece.

10. A timepiece according to claim 6, wherein the chronograph drive unit is a single chronograph motor which drives the chronograph display units, which are separately disposed on the display surface of the timepiece, through the chronograph train wheels.

11. A timepiece according to claim 1, wherein a power supply unit as a power supply for the ordinary time measuring section and the chronograph measuring section is disposed at a location corresponding to a position between approximately 1 o'clock and approximately 2 o'clock on the display surface of the timepiece.

12. A timepiece according to claim 1, wherein an electric signal output unit of the ordinary time measuring section and the time information measuring section is disposed at a location corresponding to a position of approximately 8 o'clock on the display surface of the timepiece.

13. A timepiece according to claim 1, wherein a time correcting unit of the ordinary time measuring section is disposed at a location corresponding to a position of approximately 4 o'clock on the display surface of the timepiece.

14. A timepiece according to claim 13, wherein the time correcting unit of the ordinary time measuring section comprises an external manipulating member, and is disposed at a location corresponding to a position of approximately 4 o'clock on the display surface of the timepiece.

15. A timepiece according to claim 1, further having a reset to zero mechanism for mechanically resetting the measurement of chronograph information to zero, wherein a timepiece main body is composed of a plurality of layers and the reset to zero mechanism is disposed on a layer whose height in a sectional direction is different from that of a layer on which the ordinary time measuring section and the chronograph measuring section are disposed.

16. A timepiece according to claim 15, wherein the chronograph measuring section has a display for at least two kinds of chronograph units.

17. A timepiece according to claim 16, wherein the display has train wheels.

18. A timepiece according to 15, wherein the timepiece is a wrist watch.

19. A timepiece according to 15, wherein the timepiece is a quartz type watch.

20. A timepiece according to claim 1, further having a reset to zero mechanism including a reset to zero lever for mechanically resetting the chronograph display unit to zero and an actuation cam for actuating the reset to zero lever, wherein the actuation cam is disposed at an approximate center of a timepiece main body.

21. A timepiece according to claim 20, wherein the center of rotation of an indicator wheel, to which the indicator hands of the ordinary time display unit are attached, is disposed in a peripheral area of the approximate center of the timepiece main body.

22. A timepiece according to claim 20, wherein the center of rotation of an indicator wheel, to which the indicator hands of the chronograph display unit are attached, is disposed in a peripheral area of the approximate center of the timepiece main body.

23. A timepiece according to claim 20, wherein the center of rotation of an indicator wheel, to which the indicator hands of the ordinary time display unit are attached, and the position of the center of rotation of an indicator wheel, to which the indicator hands of the chronograph display unit are attached, are disposed in respective peripheral areas of the approximate center of the timepiece main body.

24. A timepiece according to claim 20, wherein for the chronograph display unit displays at least two kinds of chronograph information.

25. A timepiece according to claim 24, wherein the chronograph display unit has train wheels.

26. A timepiece according to 20, wherein the timepiece is a wrist watch.

27. A timepiece according to 20, wherein the timepiece is a quartz type watch.

28. A timepiece having an ordinary time measuring section for measuring an ordinary time, a chronograph measuring section for measuring chronograph information, and a power generating unit for converting mechanical energy into electric energy and generating a drive voltage for driving the ordinary time measuring section and the chronograph measuring section, wherein a timepiece main body is composed of a plurality of layers and the power generating unit is disposed on a layer whose height in a sectional direction is different from that of a layer on which the ordinary time measuring section and the chronograph measuring section are disposed, and wherein the power generating unit is covered by a magnetic screen.

29. A timepiece having an ordinary time measuring section for measuring an ordinary time, a chronograph measuring section for measuring chronograph information, a reset to zero mechanism for mechanically resetting the measurement of chronograph information to zero, and a power generating unit for converting mechanical energy into electric energy and generating a drive voltage for driving the ordinary time measuring section and the chronograph measuring section, wherein a timepiece main body is composed of a plurality of layers and the reset to zero mechanism and the power generating unit are disposed on a layer whose height in a sectional direction is different from that of a layer on which the ordinary time measuring section and the chronograph measuring section are disposed, and wherein the power generating unit is covered by a magnetic screen.

30. A timepiece having an ordinary time measuring section for measuring an ordinary time, a chronograph measuring section for measuring chronograph information, and a reset to zero mechanism for mechanically resetting the measurement of chronograph information to zero, wherein a timepiece main body is composed of a plurality of layers and the reset to zero mechanism is disposed on a layer whose height in a sectional direction is different from that of a layer on which the ordinary time measuring section and the chronograph measuring section are disposed, and wherein the reset to zero mechanism overlaps the chronograph measuring section on a plane in the disposition thereof.

31. A timepiece having an ordinary time measuring section for measuring an ordinary time, a chronograph measuring section for measuring chronograph information, and a power generating unit for converting mechanical energy into electrical energy and generating a drive voltage for driving the ordinary time measuring section and chronograph measuring section, wherein a timepiece main body is composed of a plurality of layers and the power generating unit is disposed on a layer whose height in a sectional direction is different from that of a layer on which the ordinary time measuring section and the chronograph measuring section are disposed, and wherein the power generating unit overlaps the ordinary time measuring section on a plane in the disposition thereof.

32. A timepiece having an ordinary time measuring section for measuring an ordinary time, a chronograph measuring section for measuring chronograph information, a reset to zero mechanism for mechanically resetting the measurement of chronograph information to zero, and a power generating unit for converting mechanical energy into electrical energy and generating a drive voltage for driving the ordinary time measuring section and the chronograph measuring section, wherein a timepiece main body is composed of a plurality of layers and the reset to zero mechanism and the power generating unit are disposed on a layer whose height in a sectional direction is different from that of a layer on which the ordinary time measuring section and the chronograph measuring section are disposed, and wherein the reset to zero mechanism and the power generating unit are disposed on the same layer.

33. A timepiece having an ordinary time measuring section for measuring an ordinary time, a chronograph measuring section for measuring chronograph information, a reset to zero mechanism for mechanically resetting the measurement of chronograph information to zero, and a power generating unit for converting mechanical energy into electrical energy and generating a drive voltage for driving the ordinary time measuring section and the chronograph measuring section, wherein a timepiece main body is composed of a plurality of layers and the reset to zero mechanism and the power generating unit are disposed on a layer whose height in a sectional direction is different from that of a layer on which the ordinary time measuring section and the chronograph measuring section are disposed, and wherein the reset to zero mechanism and the power generating unit are disposed on different layers.

34. A timepiece having an ordinary time measuring section for measuring an ordinary time, a chronograph measuring section for measuring chronograph information, and a power generating unit for converting mechanical energy into electrical energy and generating a drive voltage for driving the ordinary time measuring section and chronograph measuring section, wherein a timepiece main body is composed of a plurality of layers and the power generating unit is disposed on a layer whose height in a sectional direction is different from that of a layer on which the ordinary time measuring section and the chronograph measuring section are disposed, and wherein the power generating unit, the ordinary time measuring section and the time information measuring section are connected to each other through elastic members.

35. A timepiece having an ordinary time measuring section for measuring an ordinary time, a chronograph measuring section for measuring chronograph information, and a power generating unit for converting mechanical energy into electrical energy and generating a drive voltage for driving the ordinary time measuring section and chronograph measuring section, wherein a timepiece main body is composed of a plurality of layers and the power generating unit is disposed on a layer whose height in a sectional direction is different from that of a layer on which the ordinary time measuring section and the chronograph measuring section are disposed, and wherein a magnetic shield member is disposed on at least one of the upper layer side and the lower layer side of the power generating unit.

36. A timepiece having an ordinary time measuring section for measuring an ordinary time, a chronograph measuring section for measuring chronograph information, and a power generating unit for converting mechanical energy into electrical energy and generating a drive voltage for driving the ordinary time measuring section and chronograph measuring section, wherein a timepiece main body is composed of a plurality of layers and the power generating unit is disposed on a layer whose height in a sectional direction is different from that of a layer on which the ordinary time measuring section and the chronograph measuring section are disposed, and wherein the power generating unit comprises a power generating rotor and a power generating coil.

37. A timepiece according to claim 36, wherein the power generating rotor is rotated by an oscillating weight.

38. A timepiece having an ordinary time measuring section for measuring ordinary time, a chronograph measuring section including a chronograph display unit for measuring chronograph information, and a reset to zero mechanism including a plurality of reset to zero levers for mechanically resetting the chronograph display unit to zero and an actuation cam for actuating the plurality of reset to zero levers, wherein the actuation cam is disposed at an approximate center of a timepiece main body.

39. A timepiece having an ordinary time measuring section including an ordinary time display unit for measuring ordinary time, a chronograph measuring section including a chronograph display unit for measuring chronograph information, and a reset to zero mechanism including a reset to zero lever for mechanically resetting the chronograph display unit to zero and an actuation cam for actuating the plurality of reset to zero levers, wherein the actuation cam is disposed at an approximate center of a timepiece main body, said timepiece further comprising a power generating unit for converting mechanical energy into electric energy and generating a drive voltage for driving the ordinary time display unit and the chronograph display unit.

40. A timepiece according to claim 39, wherein the power generating unit comprises a power generating rotor and a power generating coil.

41. A timepiece according to claim 40, wherein the power generating rotor is rotated by an oscillating weight.

* * * * *

UNITED STATES PATENT AND TRADEMARK OFFICE

CERTIFICATE OF CORRECTION

PATENT NO. : 6,567,345 B1
DATED : May 20, 2003
INVENTOR(S) : Tsuneaki Furukawa et al.

It is certified that error appears in the above-identified patent and that said Letters Patent is hereby corrected as shown below:

Title page,
Item [54], change "CLOCKING DEVICE" to -- TIMEPIECE --; and
Item [75], change "Eiichi Hiraya, Shiojiro (JP)" to -- Eiichi Hiraya, Shiojiri (JP) --

Signed and Sealed this

Twenty-first Day of October, 2003

JAMES E. ROGAN
*Director of the United States Patent and Trademark Office*